US007191964B2

(12) United States Patent
Trapp

(10) Patent No.: US 7,191,964 B2
(45) **Date of Patent: *Mar. 20, 2007**

(54) FIRE-FIGHTING MONITOR WITH REMOTE CONTROL

(75) Inventor: James M Trapp, Galien, MI (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 31 days.

This patent is subject to a terminal disclaimer.

(21) Appl. No.: 10/984,047

(22) Filed: Nov. 9, 2004

(65) Prior Publication Data

US 2005/0167122 A1 Aug. 4, 2005

Related U.S. Application Data

(63) Continuation-in-part of application No. 10/405,372, filed on Apr. 2, 2003, now Pat. No. 6,994,282.

(51) Int. Cl.
*B05B 15/08* (2006.01)

(52) U.S. Cl. ..... 239/587.2; 239/587.1; 239/280; 239/71; 169/24; 169/60; 285/920

(58) Field of Classification Search ..... 239/587.1, 239/587.2, 280, 456, 457, 458, 71, 73; 169/52, 169/60, 24, 51; 285/277, 920
See application file for complete search history.

(56) References Cited

U.S. PATENT DOCUMENTS 2,360,397 A 10/1944 Carpenter
2,729,295 A 1/1956 Edwards
3,106,247 A 10/1963 Lacks et al.
3,575,351 A * 4/1971 Warren ..... 239/227
3,583,637 A * 6/1971 Miscovich ..... 239/203
3,612,408 A 10/1971 Holleman
3,675,721 A 7/1972 Davidson et al.
3,762,478 A 10/1973 Cummins
3,770,062 A 11/1973 Riggs (Continued)

FOREIGN PATENT DOCUMENTS

DE 1952689 5/1971

(Continued)

*Primary Examiner*—Dinh Q. Nguyen
(74) *Attorney, Agent, or Firm*—Van Dyke, Gardner, Linn & Burkhart, LLP

(57) ABSTRACT

A fire-fighting monitor for directing the flow of fluid from a fluid source includes a base, which is adapted to connect to a fluid source, and a monitor housing. The monitor housing includes an inlet and an outlet, with the inlet releasably mounted on the base and for receiving fluid through the base. The outlet is in fluid communication with the inlet for discharging fluid from the housing. A rotatable connection is provided between the inlet and the base. The inlet is rotatable about the base at the rotatable connection about a first axis. A drive mechanism is associated with the rotatable connection for rotating the inlet about the base at the rotatable connection. The monitor further includes a control system for selectively actuating the drive mechanism and includes a receiver for receiving an input signal from a transmitter remote from the monitor. The control system actuates the drive mechanism in response to the receiver receiving the input signal.

42 Claims, 54 Drawing Sheets

U.S. PATENT DOCUMENTS

| | | | | |
|---|---|---|---|---|
| 3,786,869 | A | 1/1974 | McLoughlin | |
| 3,836,084 | A * | 9/1974 | Luke | 239/587.2 |
| 4,007,793 | A | 2/1977 | Hux et al. | |
| 4,535,846 | A | 8/1985 | Gagliardo et al. | |
| 4,674,686 | A | 6/1987 | Trapp | |
| 4,776,403 | A | 10/1988 | Lejosne | |
| 4,875,526 | A | 10/1989 | Latino et al. | |
| 4,949,794 | A | 8/1990 | Petit et al. | |
| 5,249,632 | A * | 10/1993 | Sparling et al. | 169/52 |
| 5,301,756 | A | 4/1994 | Relyea et al. | |
| 5,860,479 | A | 1/1999 | LaFollette | |
| 6,109,360 | A | 8/2000 | Mandzukic et al. | |
| 6,305,621 | B1 | 10/2001 | Kolacz et al. | |
| 6,655,613 | B1 * | 12/2003 | Brown | 239/587.1 |
| 6,786,426 | B1 | 9/2004 | Trapp | |

FOREIGN PATENT DOCUMENTS

| | | |
|---|---|---|
| DE | 29600355 | 6/1997 |
| GB | 485161 | 5/1938 |

* cited by examiner

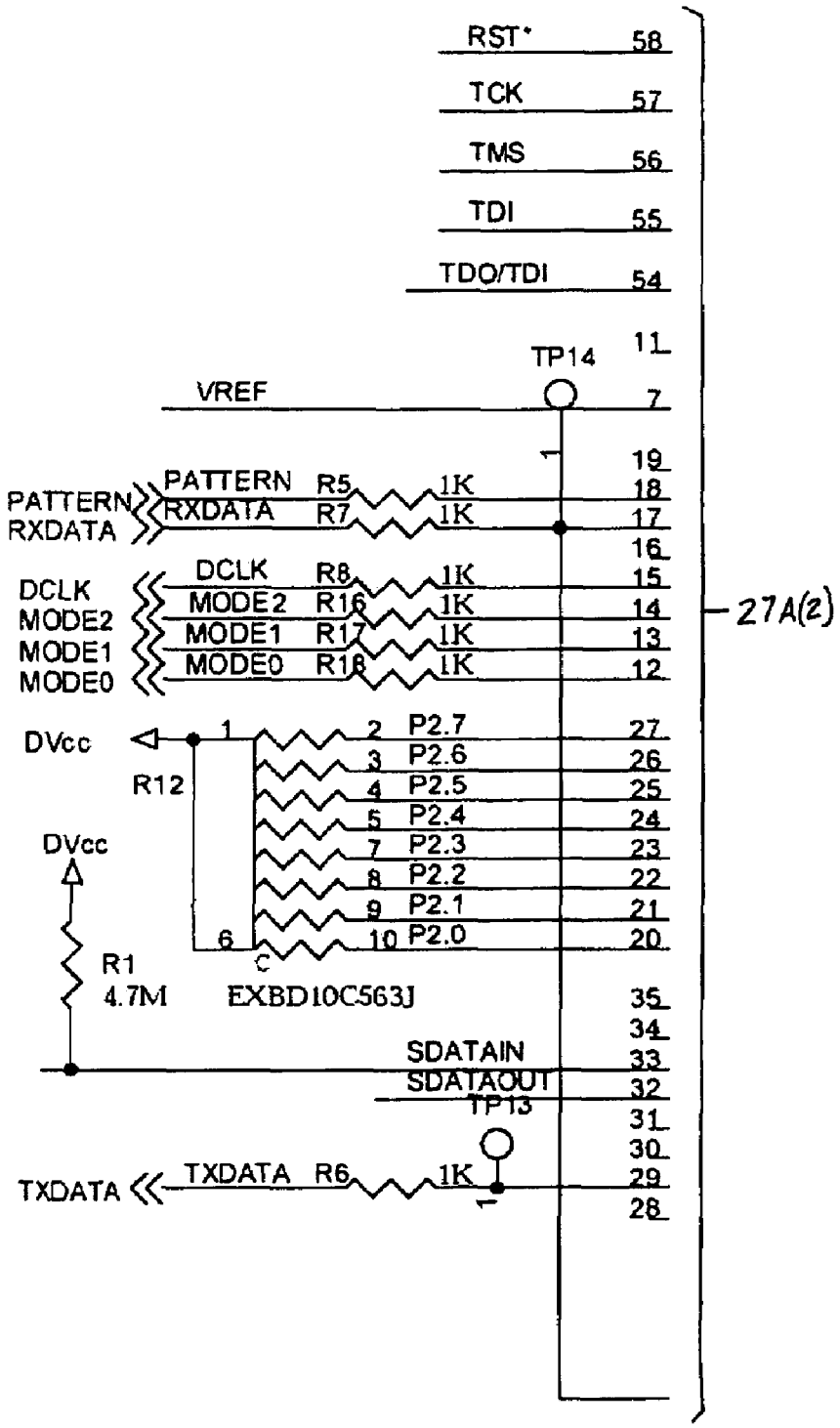
Fig. 27A(1)

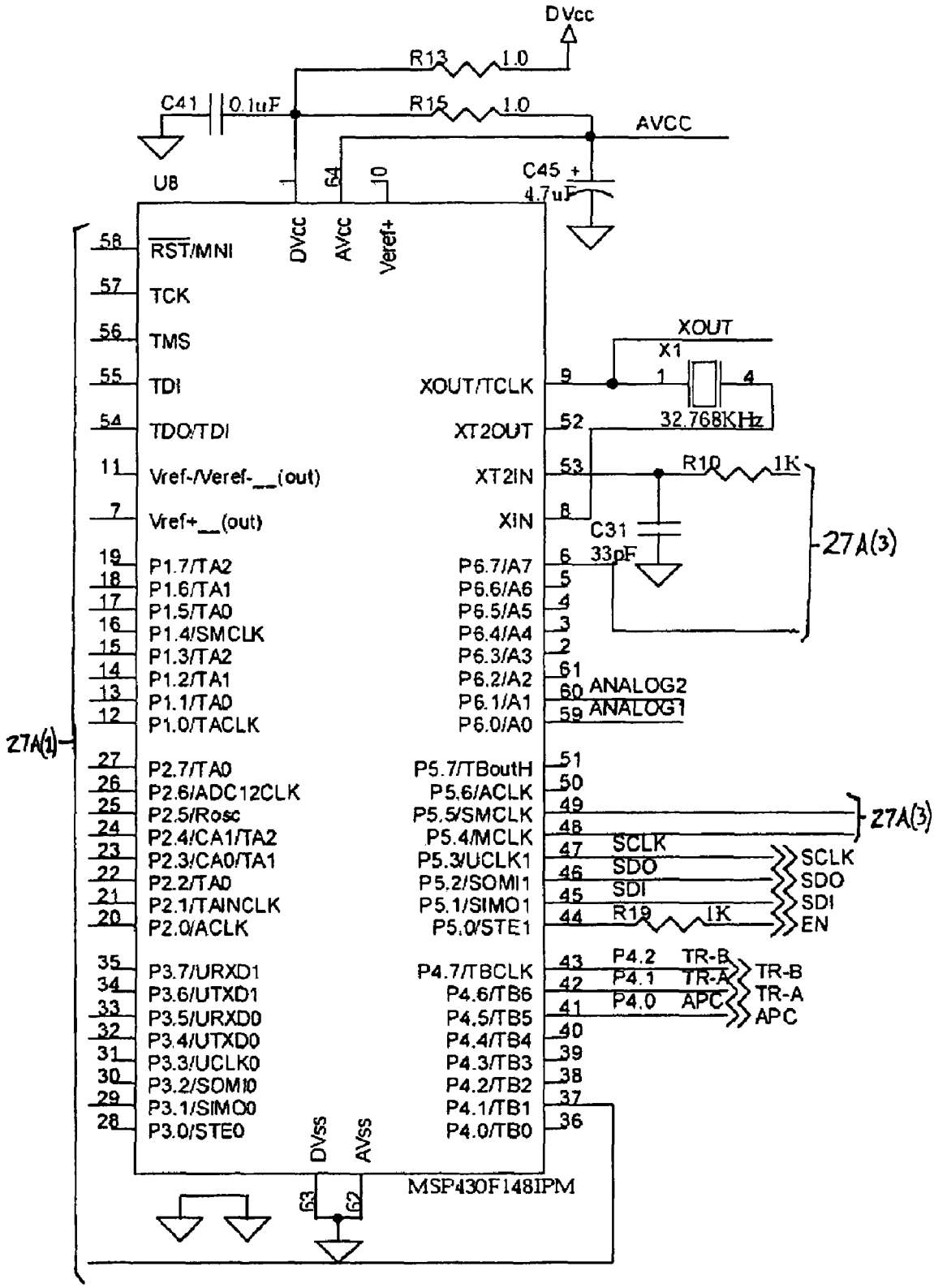
Fig.27A(2)

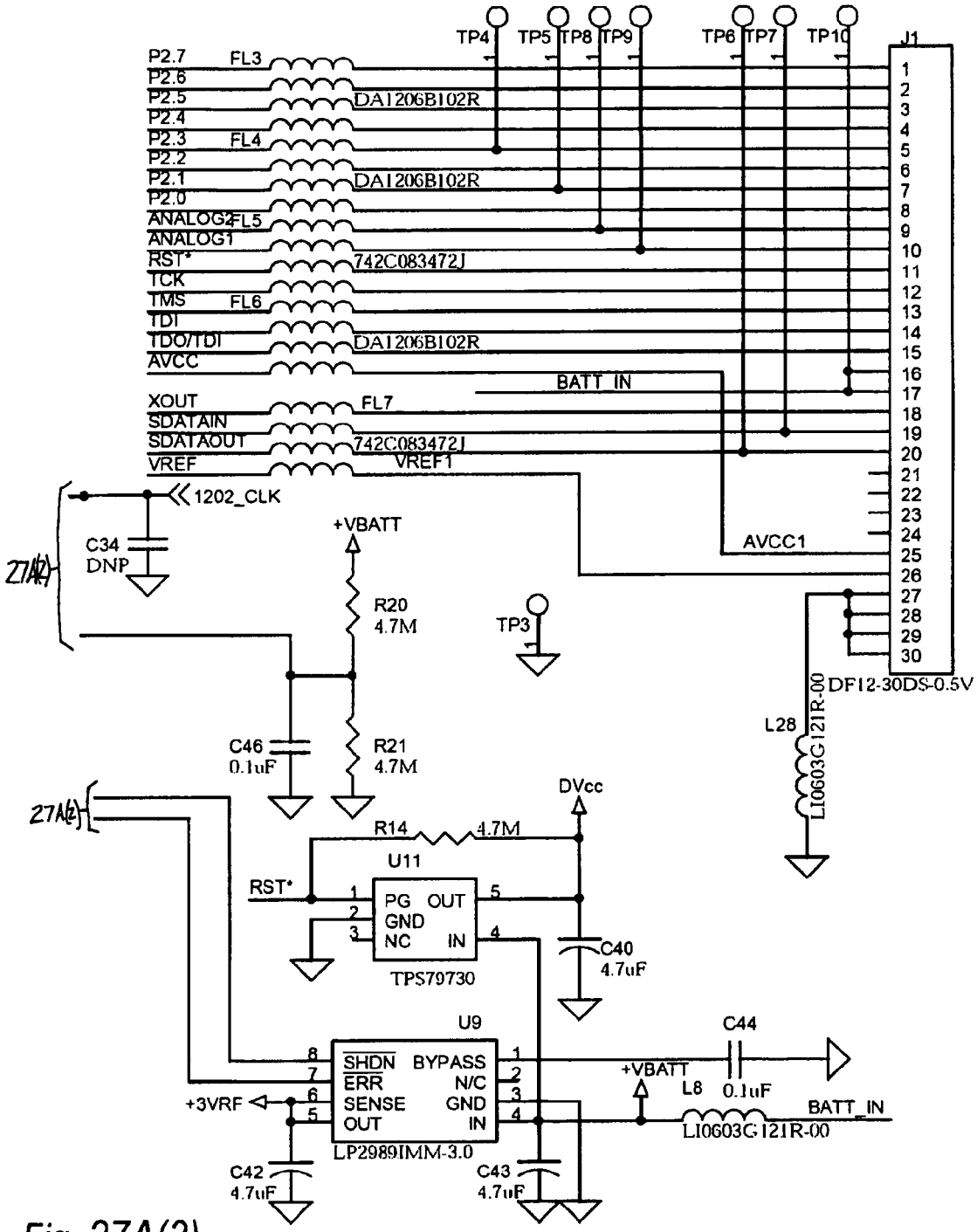
Fig. 27A(3)

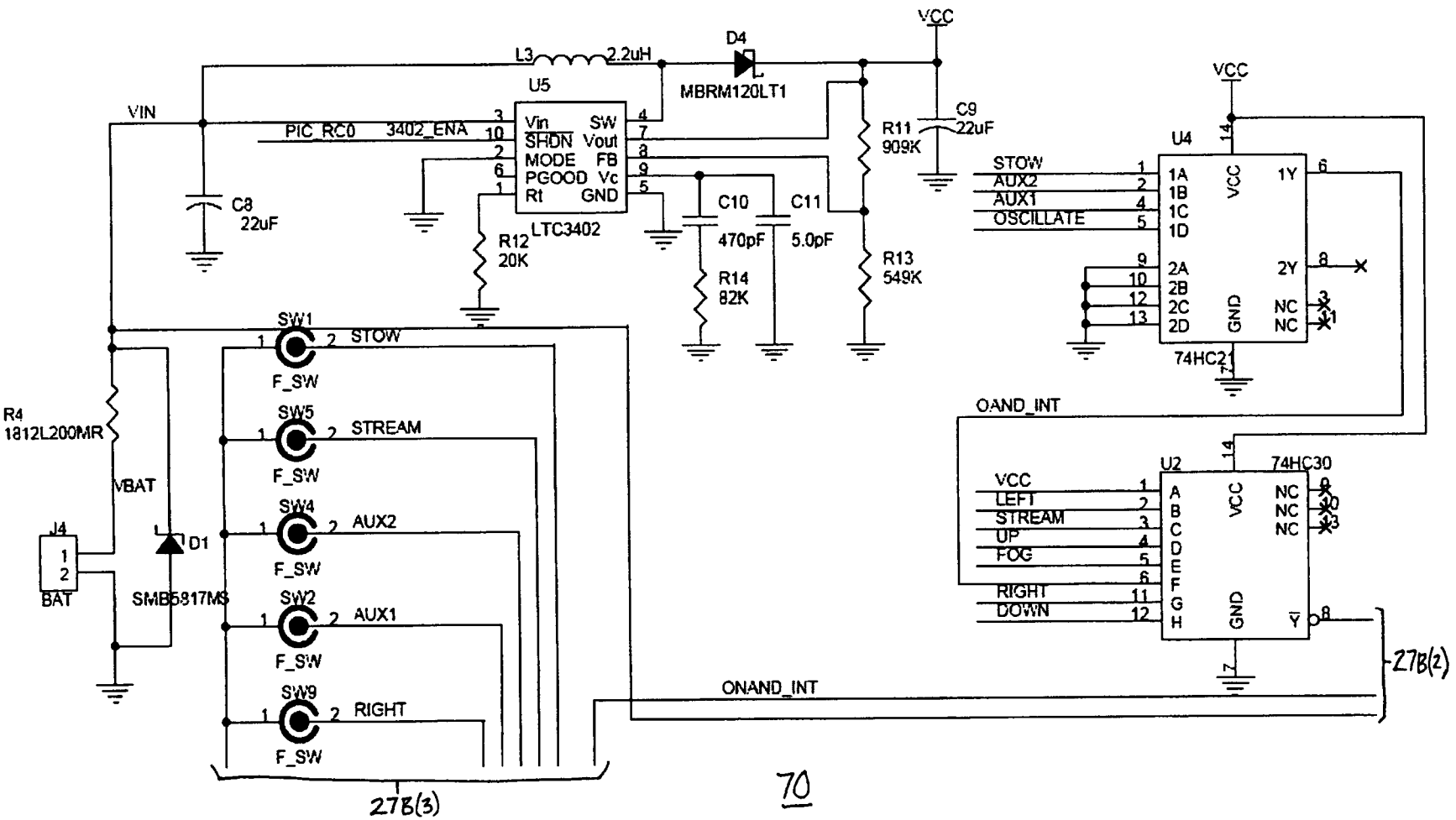
FIG. 27B(1)

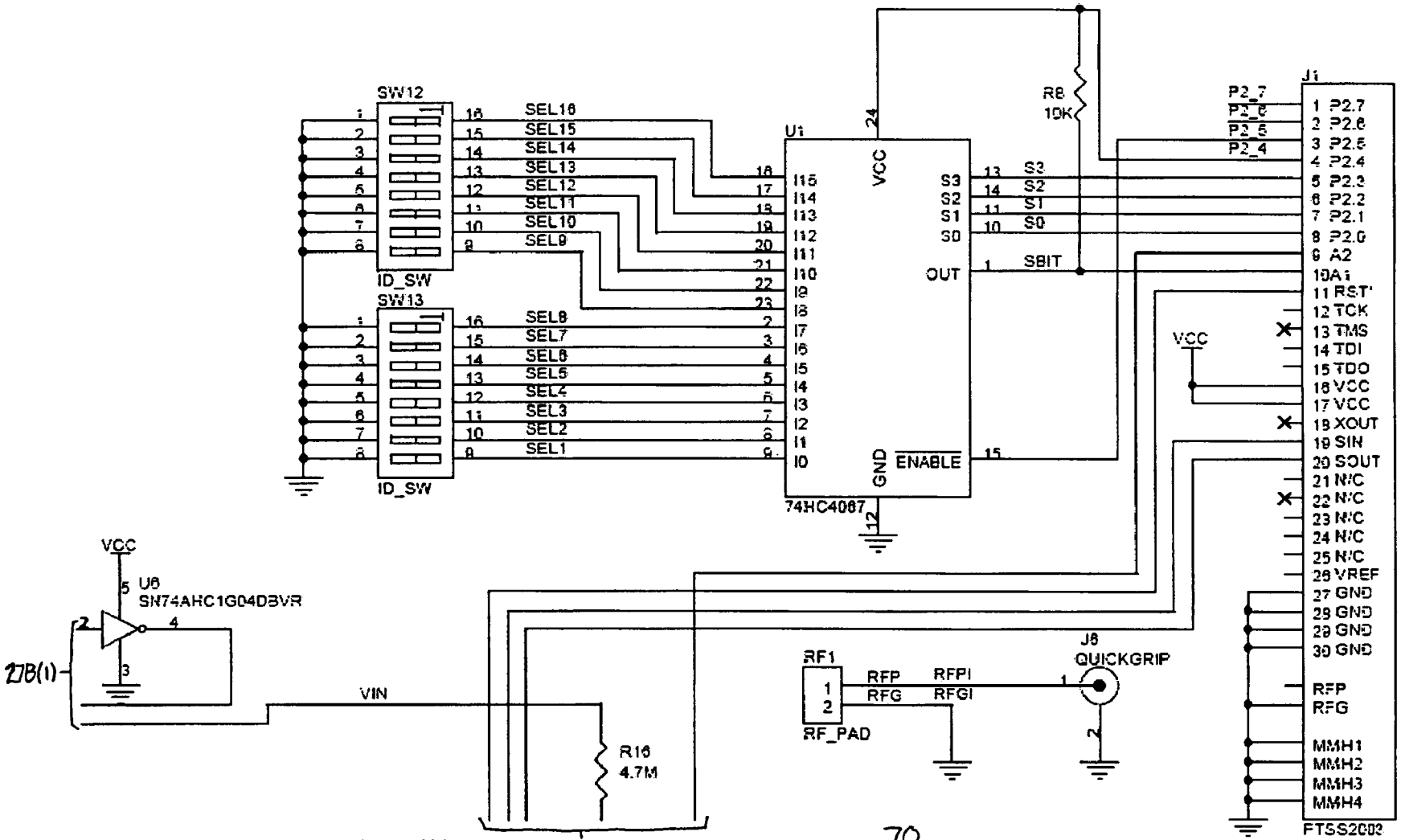
FIG. 27B(2)

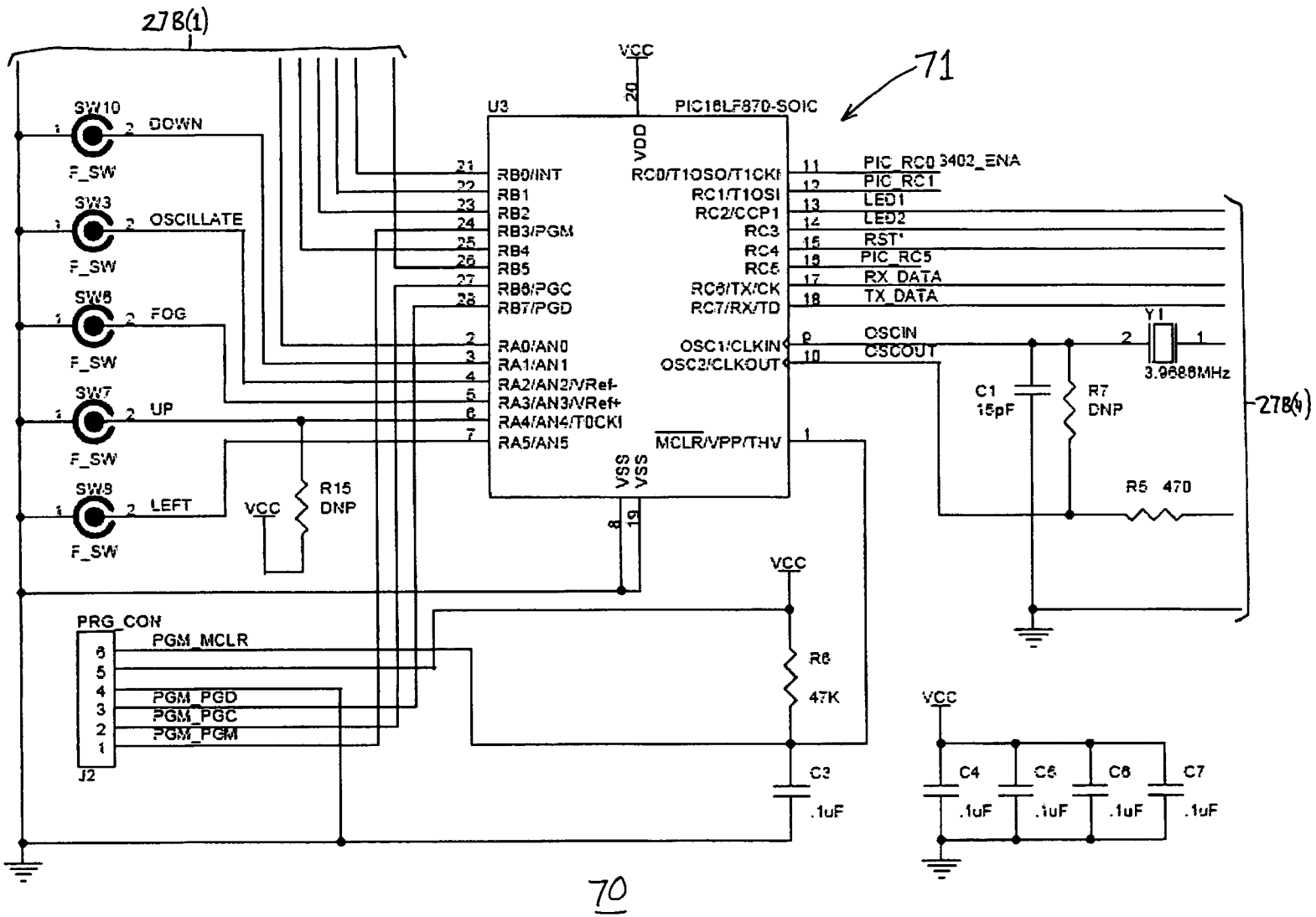
FIG. 27B(3)

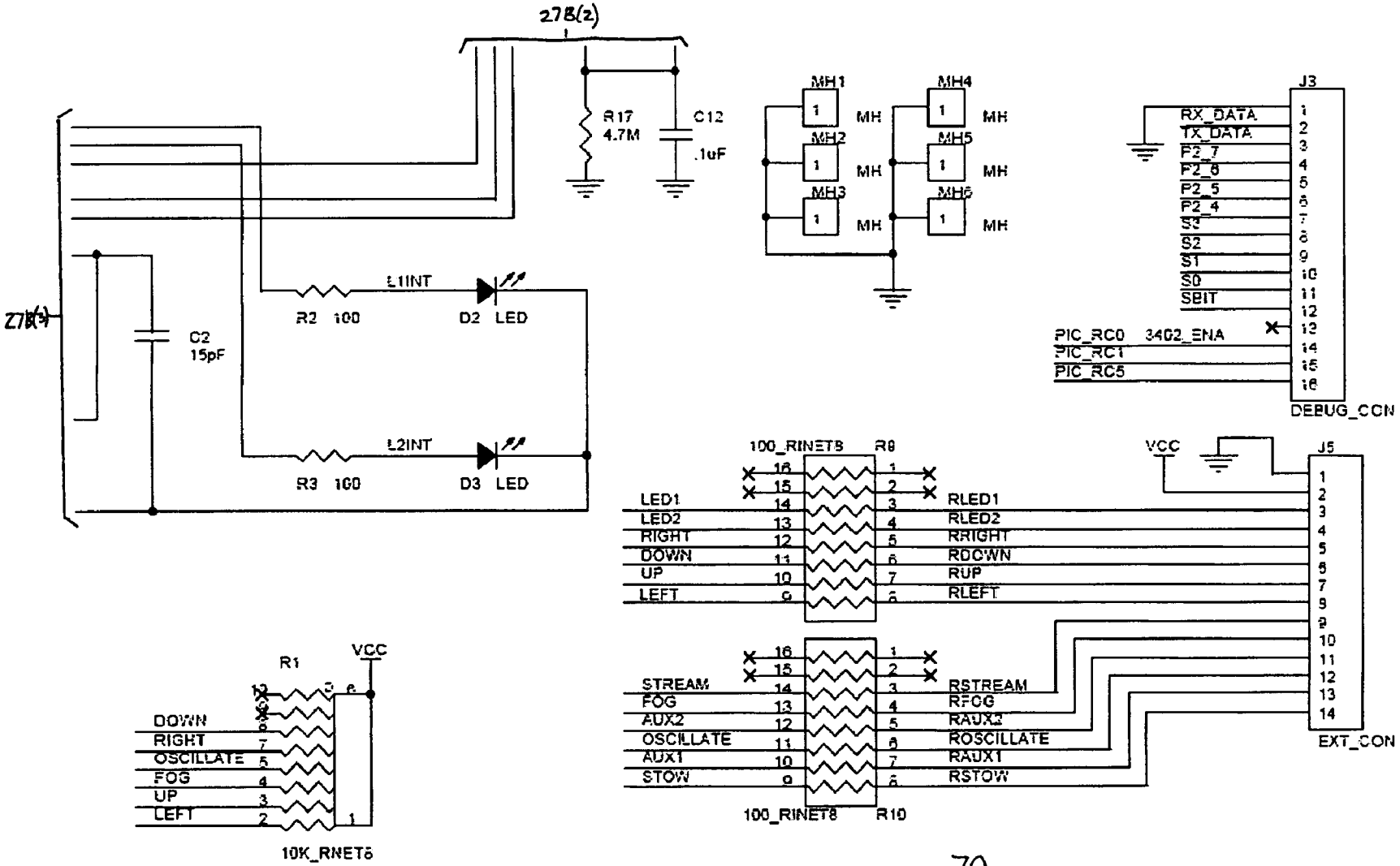
70
FIG. 27B(4)

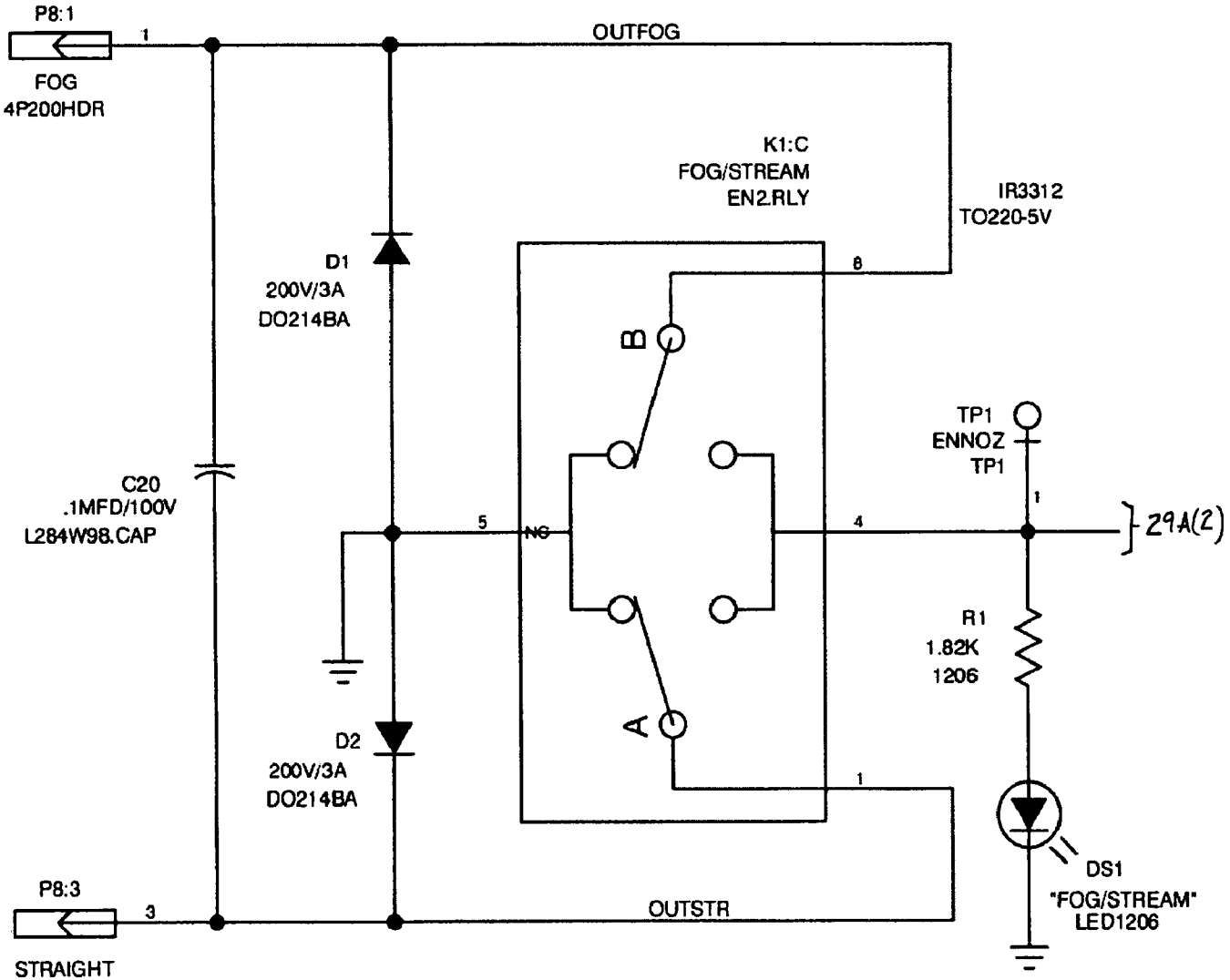
FIG. 29A(1)

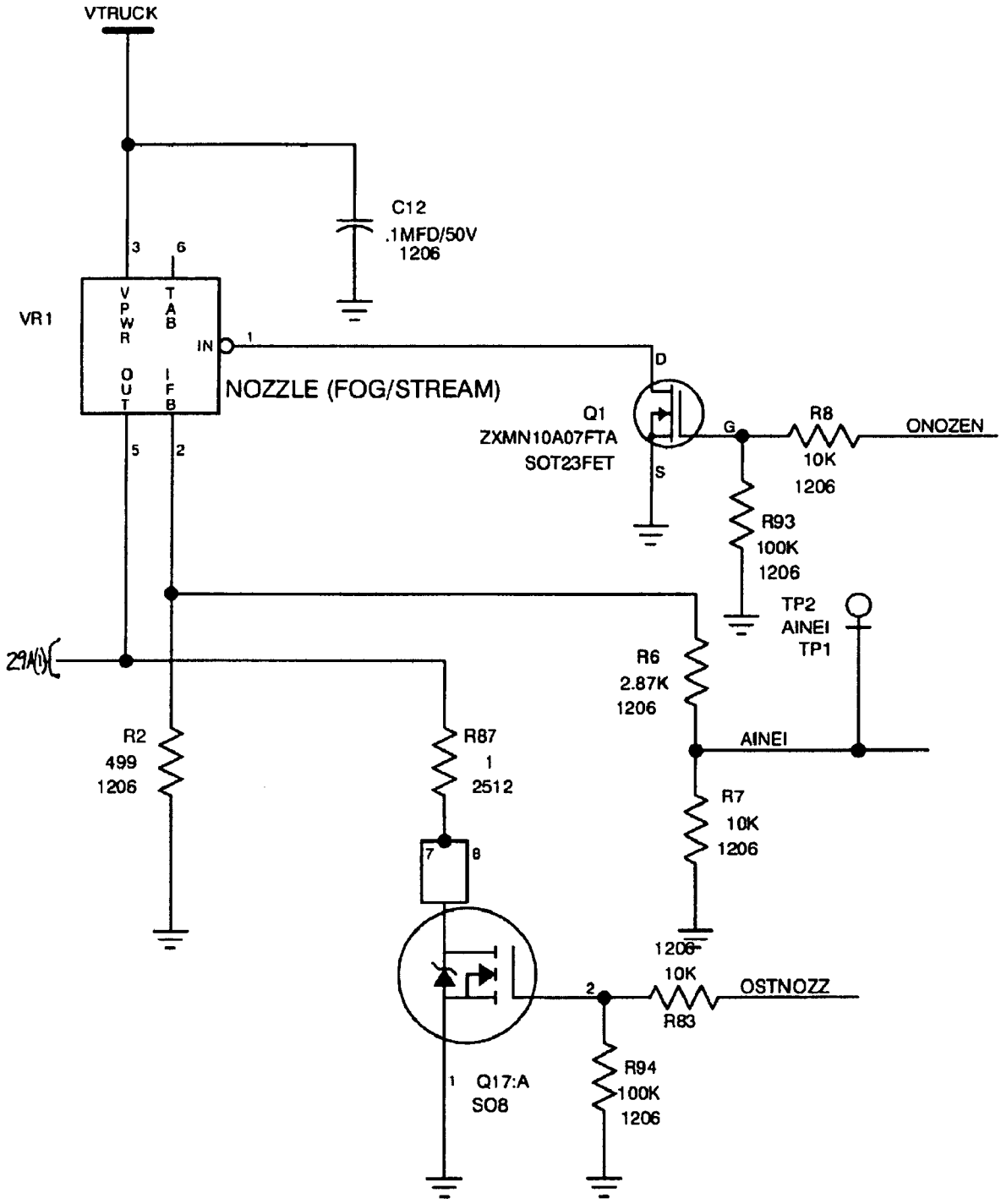
*FIG. 29A(2)*

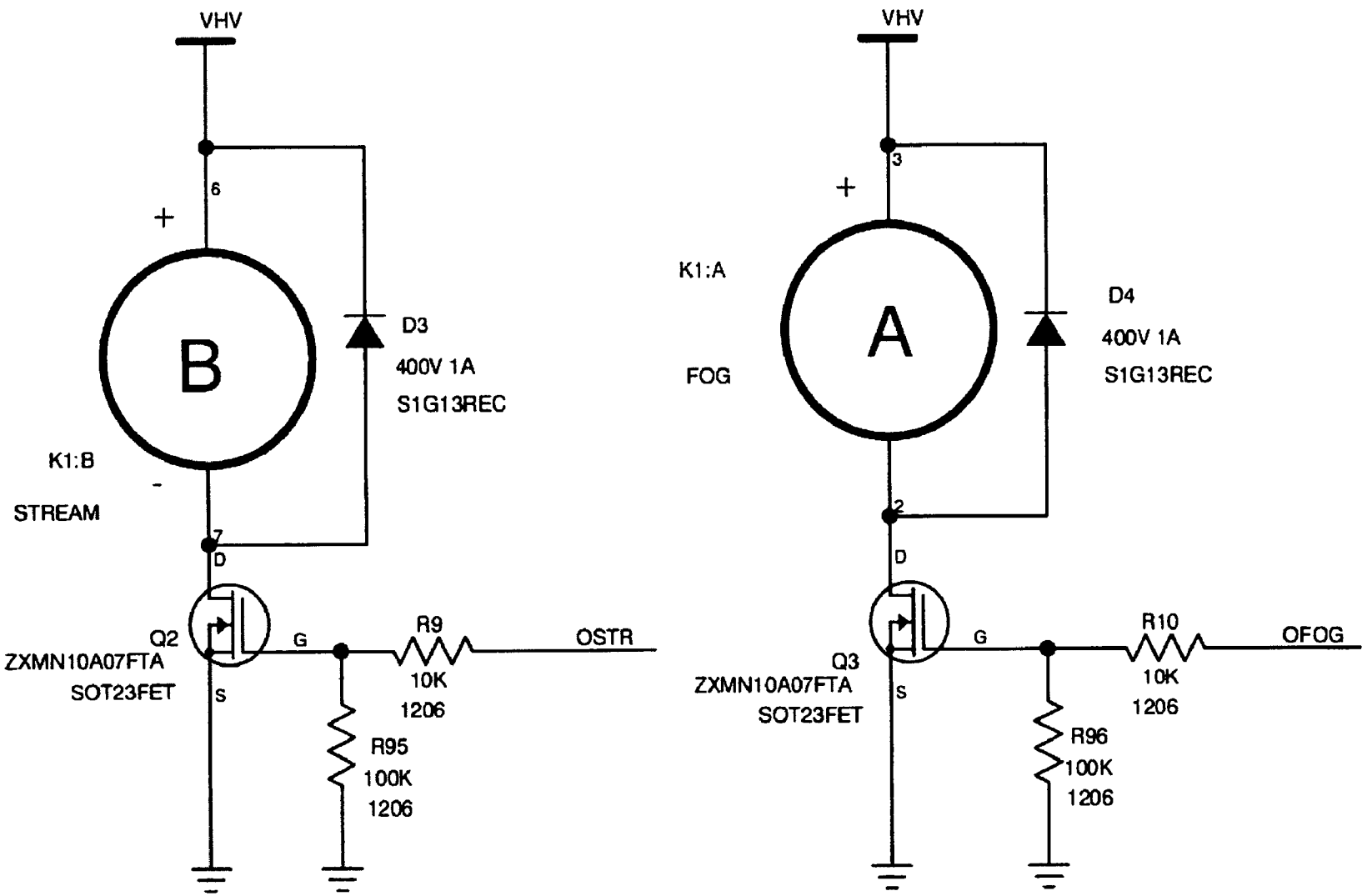
FIG. 29A(3)

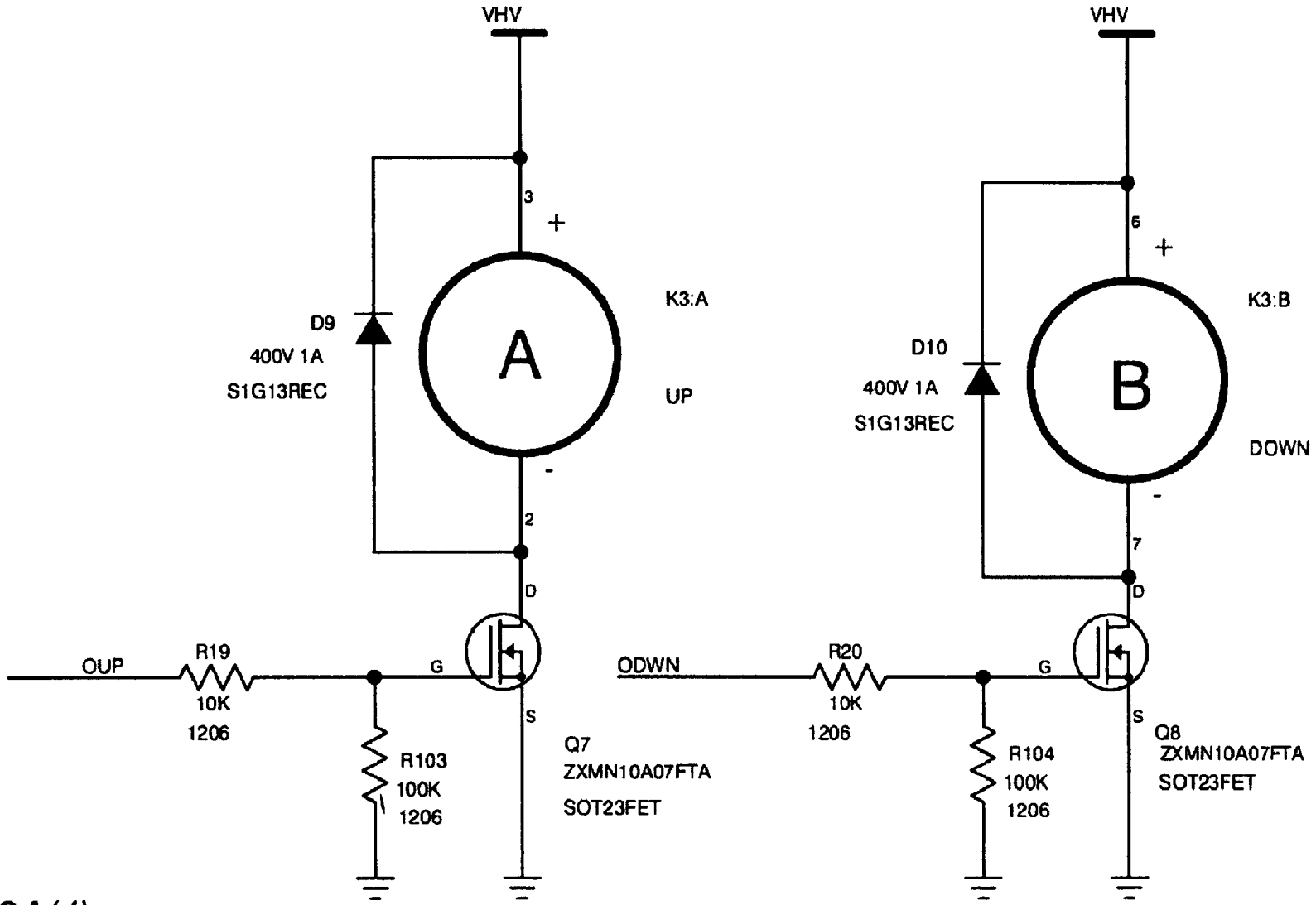
FIG. 29A(4)

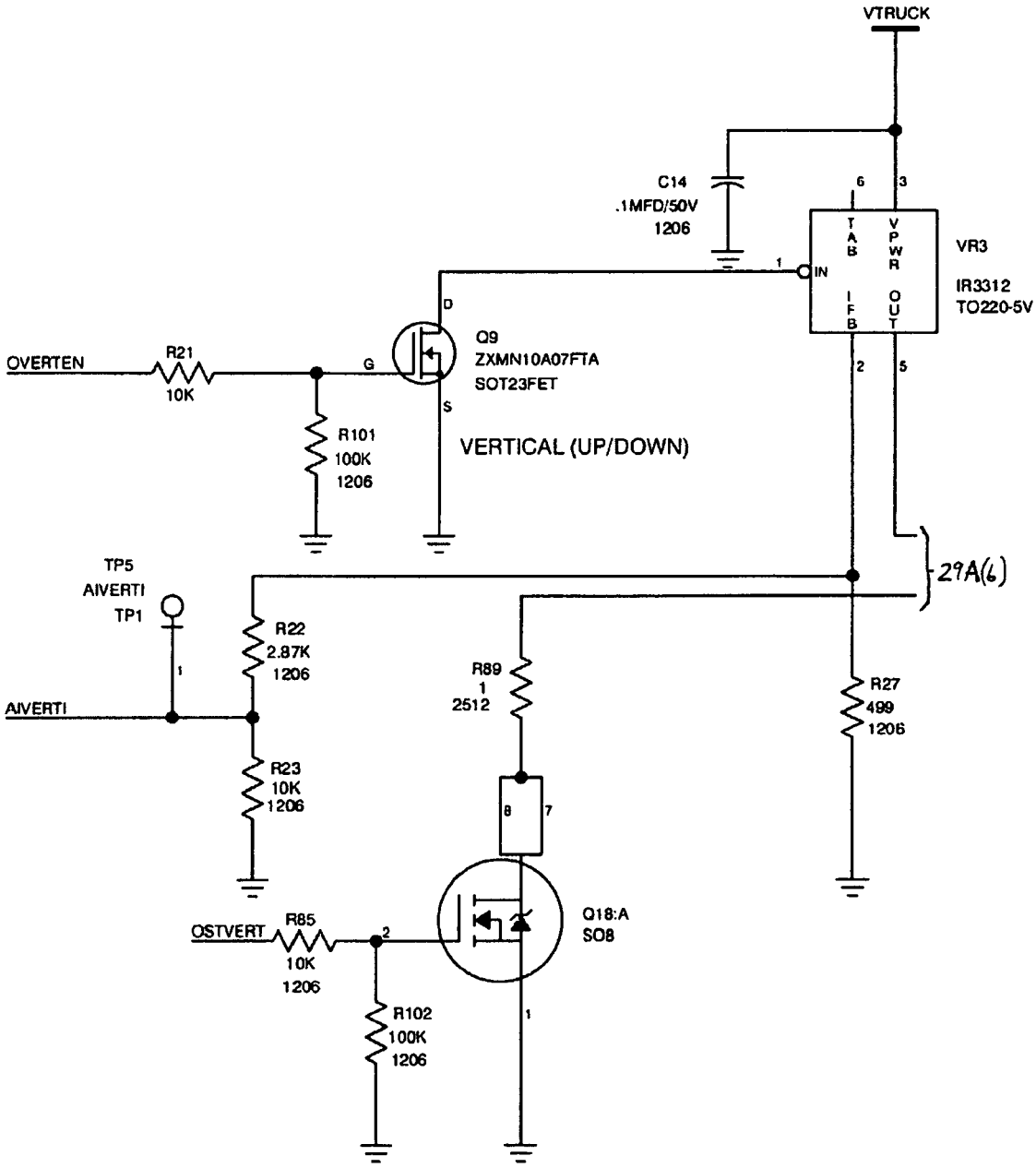
*FIG. 29A(5)*

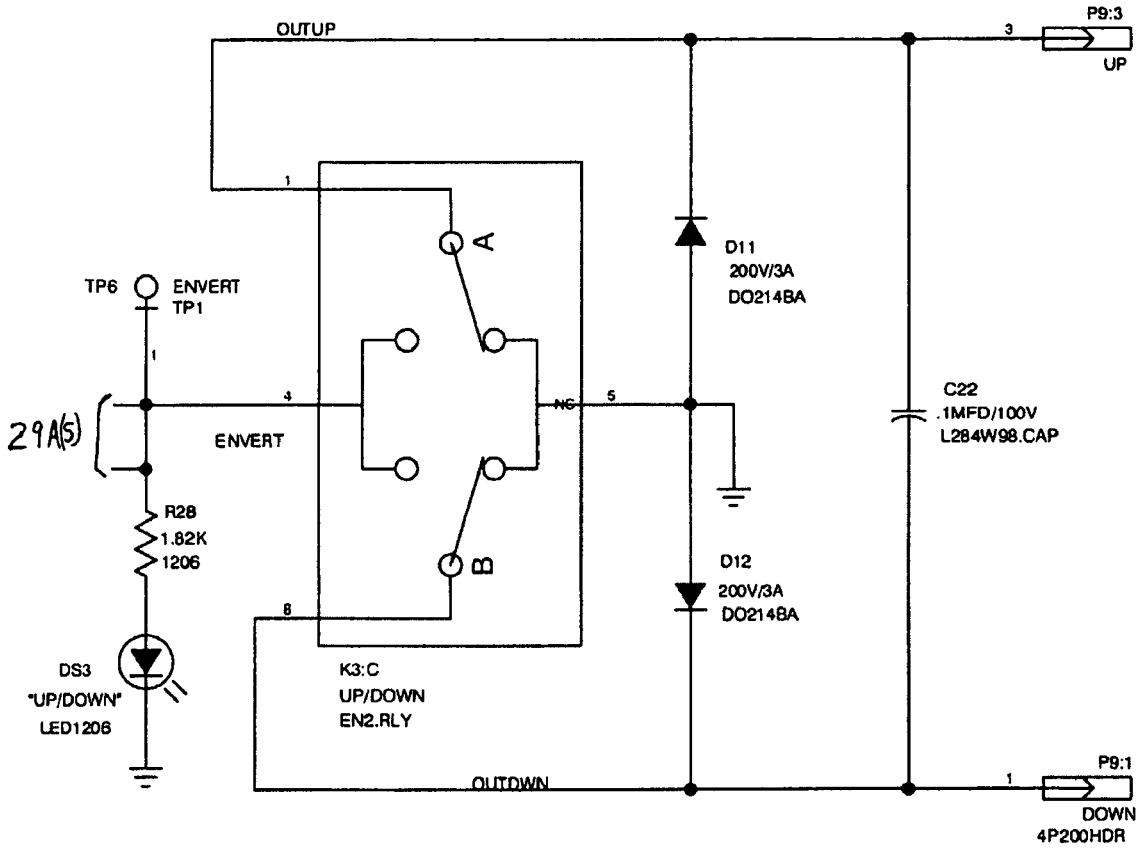
*FIG. 29A(6)*

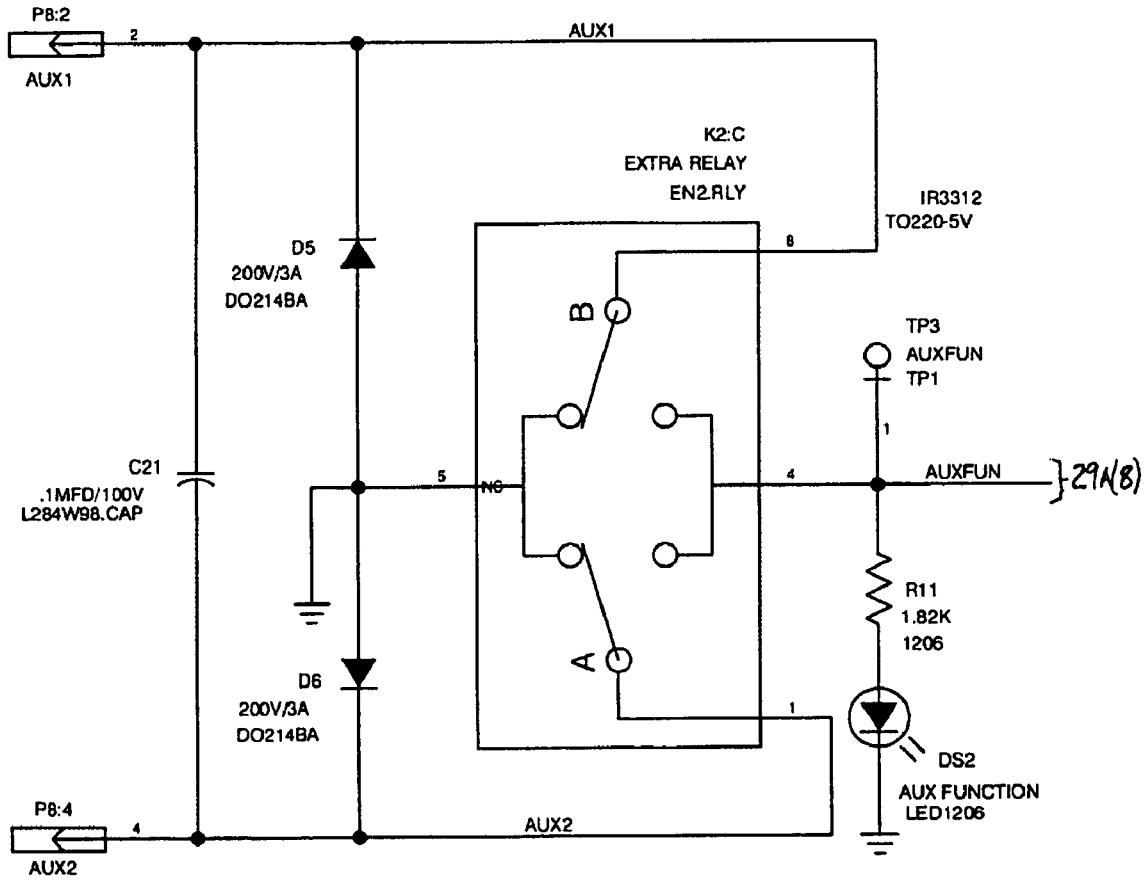
FIG. 29A(7)

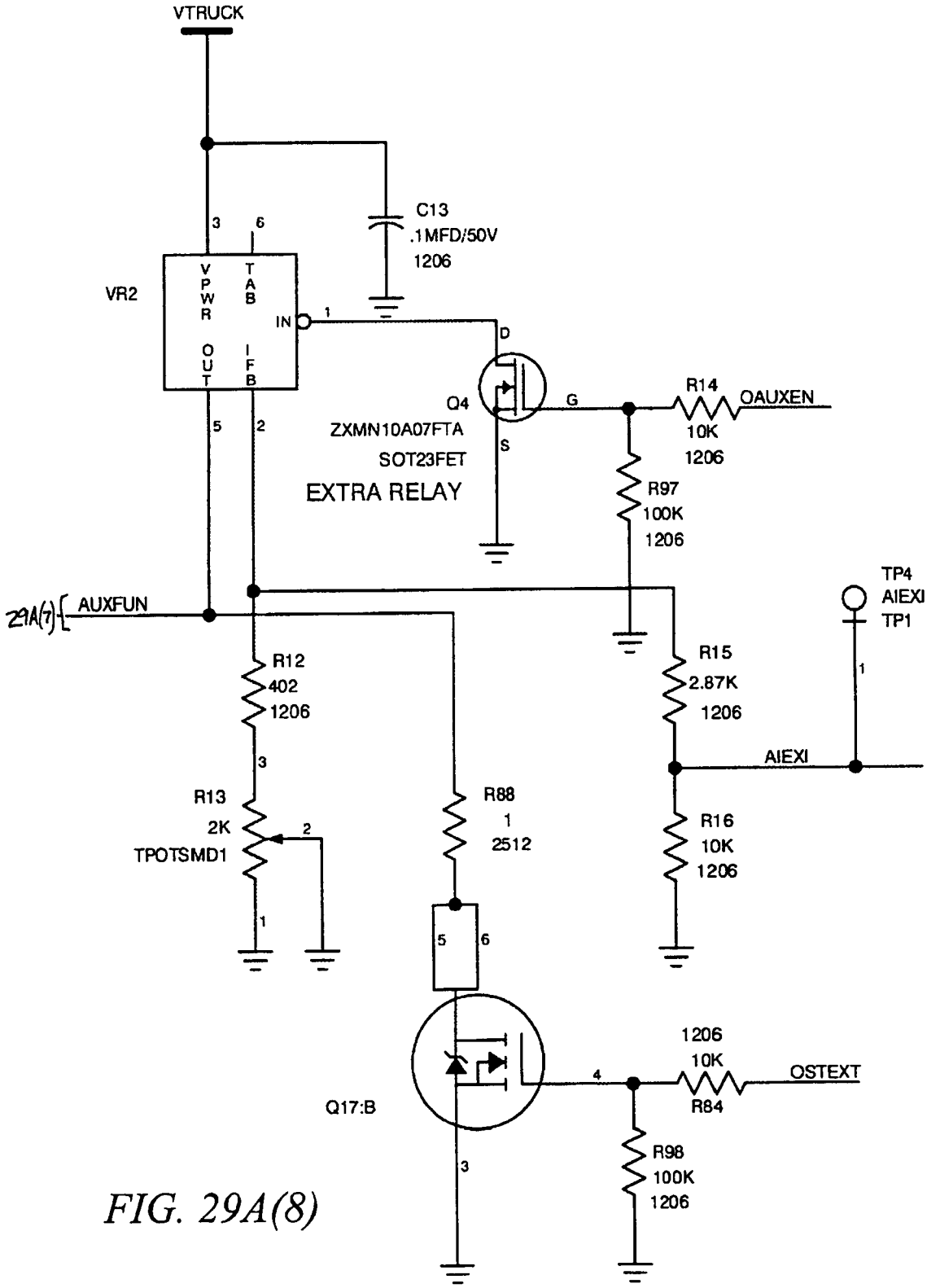
FIG. 29A(8)

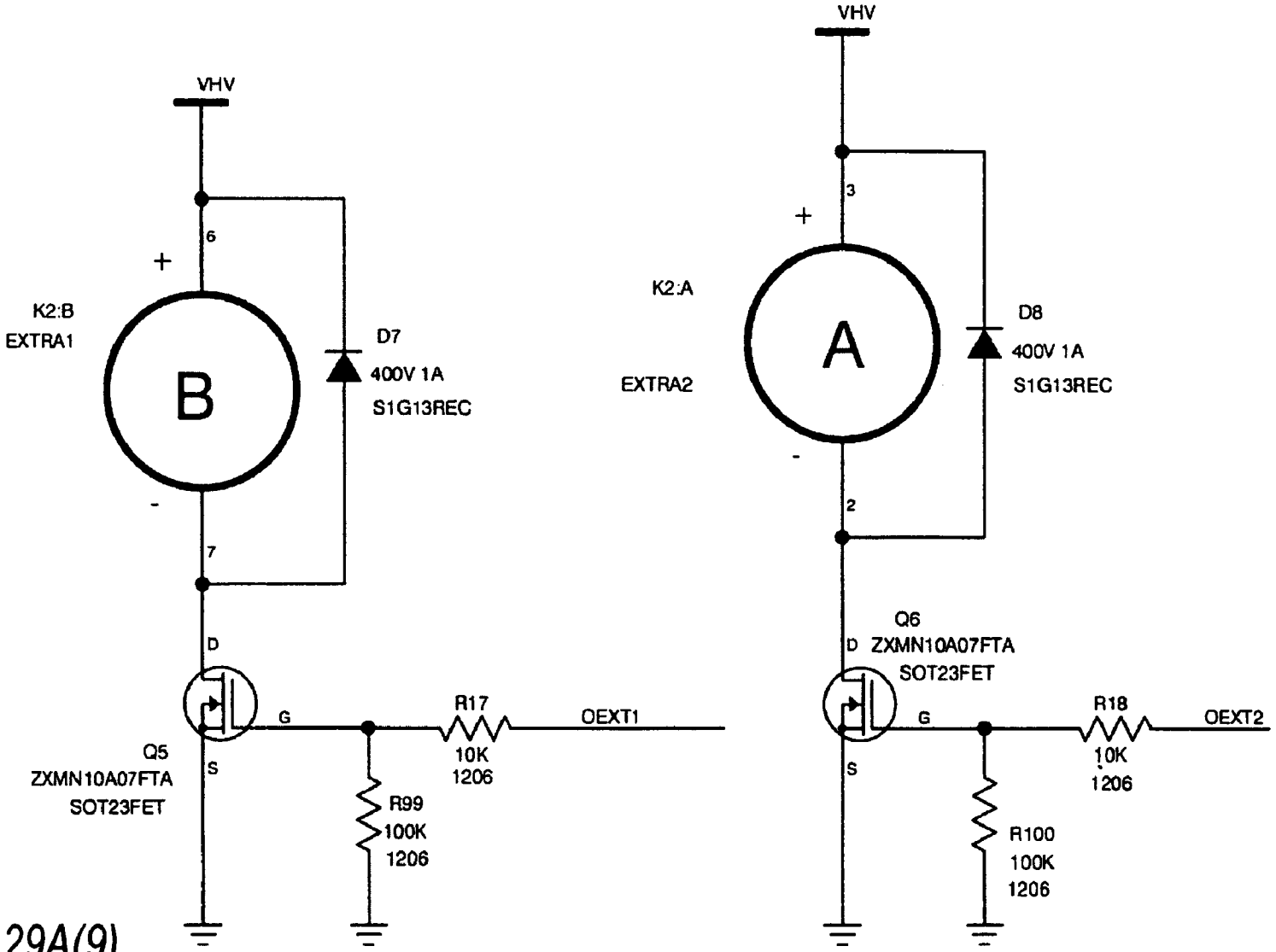
FIG. 29A(9)

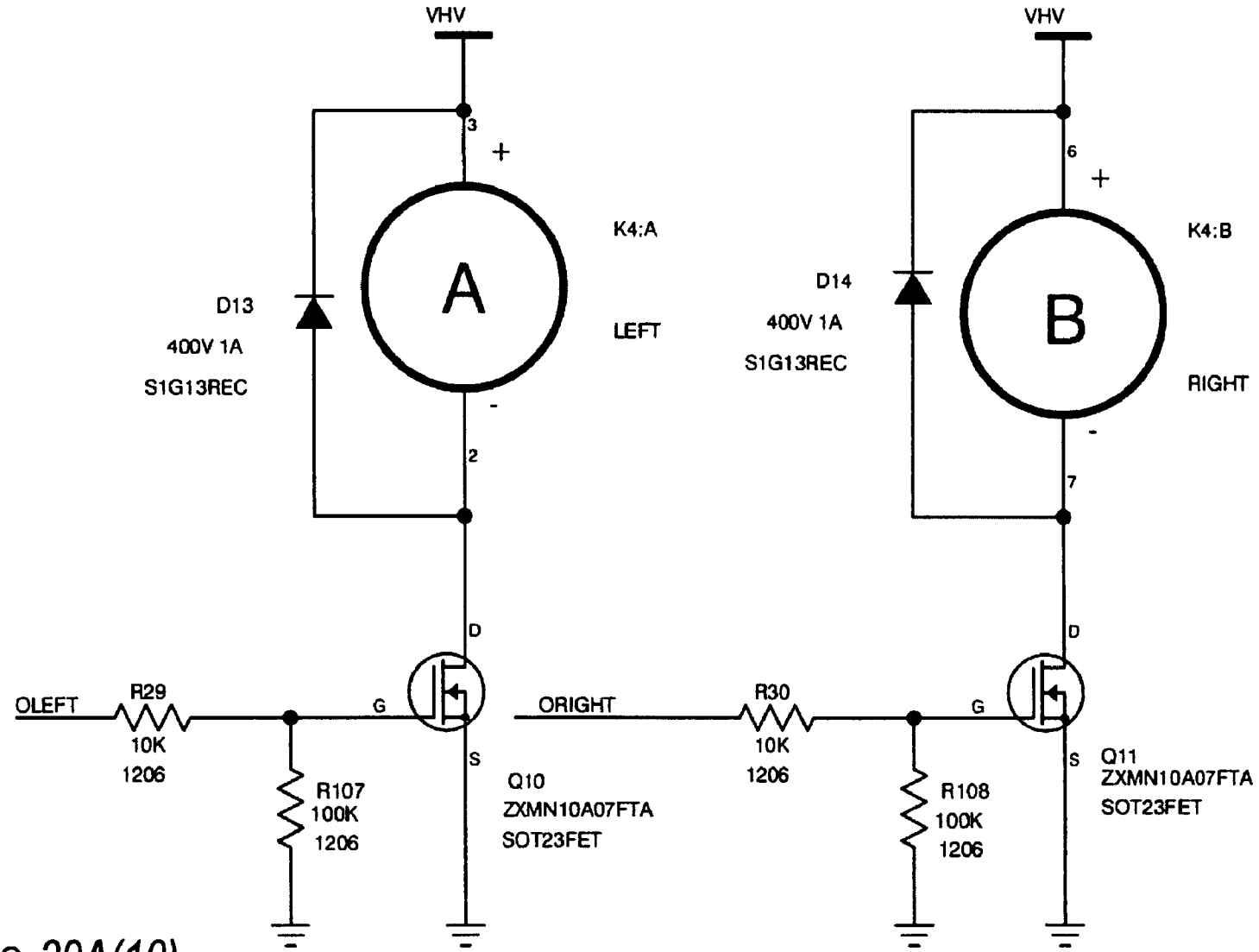
FIG. 29A(10)

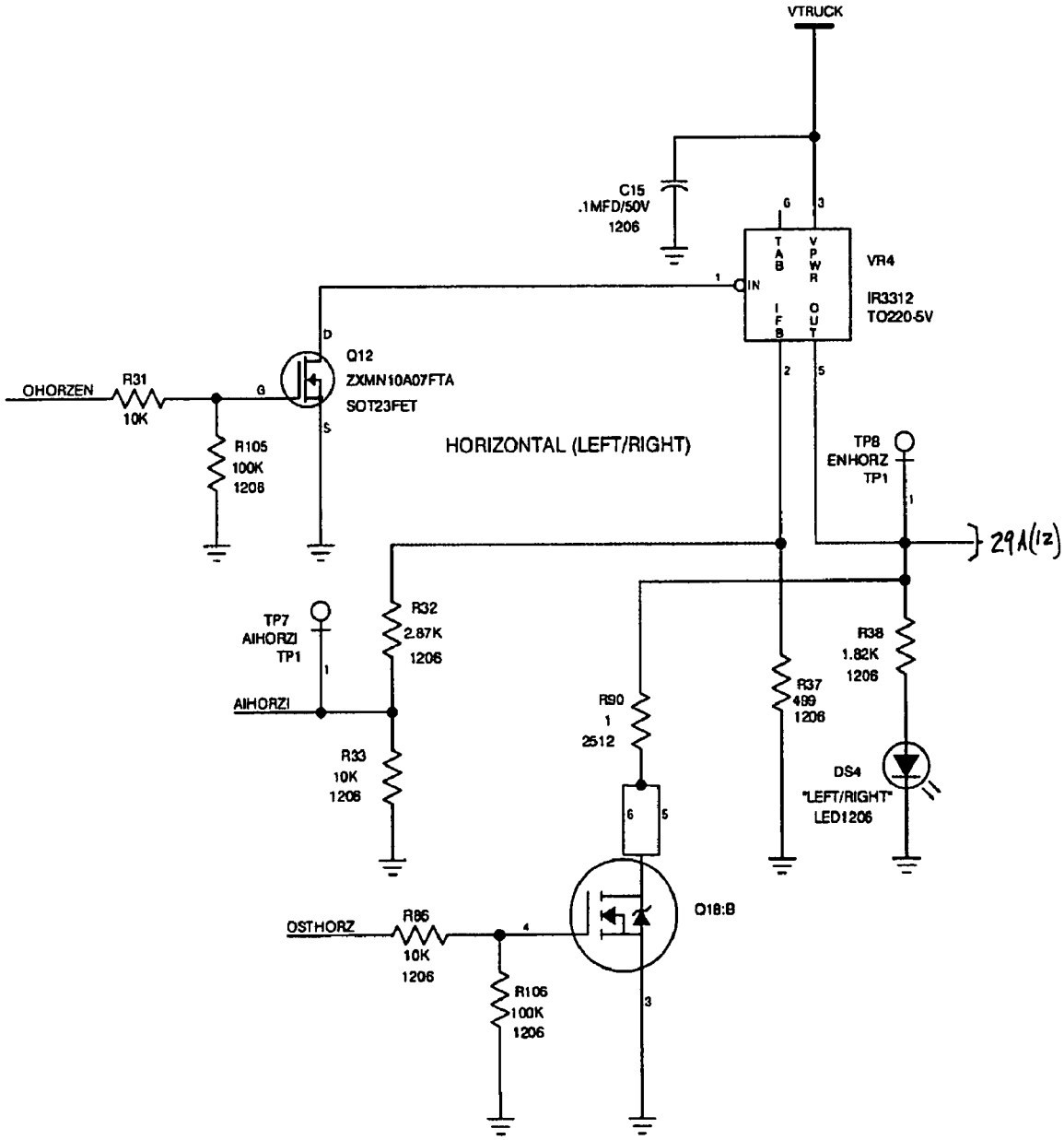
FIG. 29A(11)

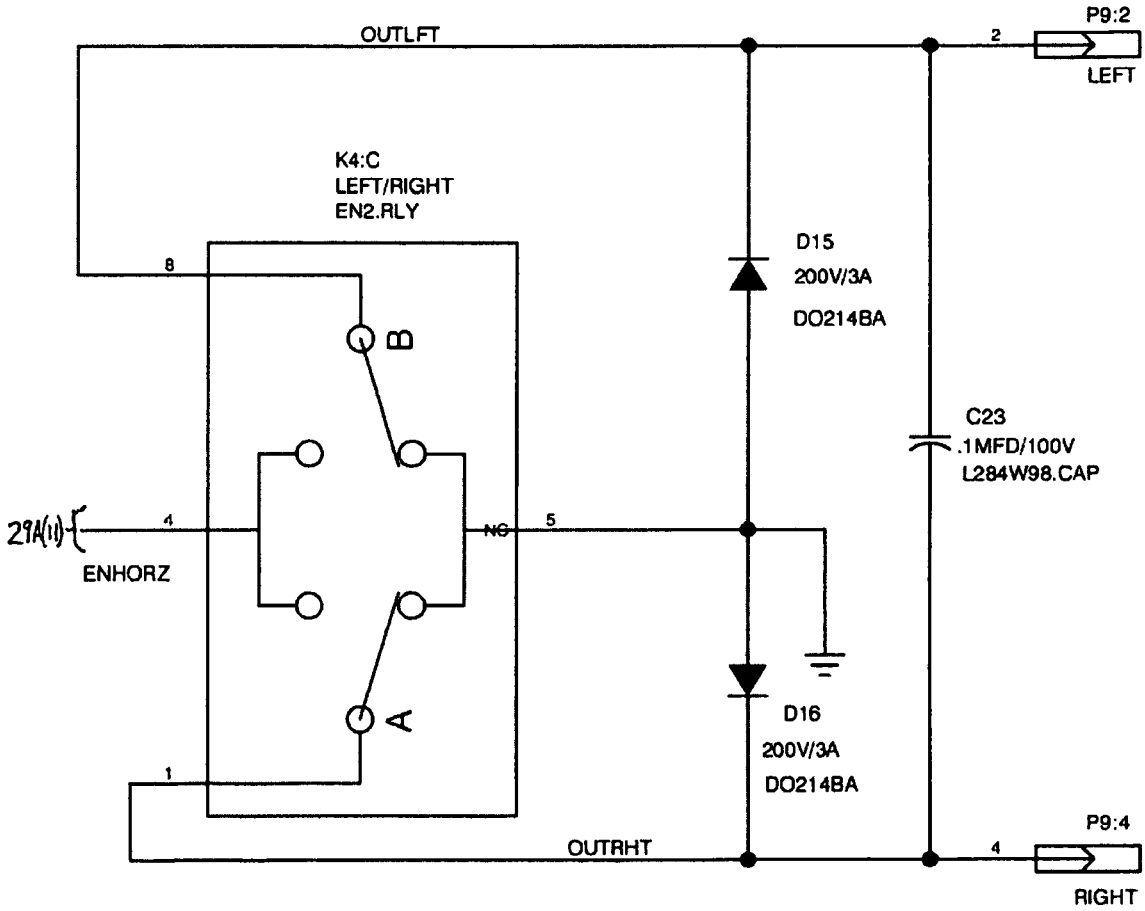
FIG. 29A(12)

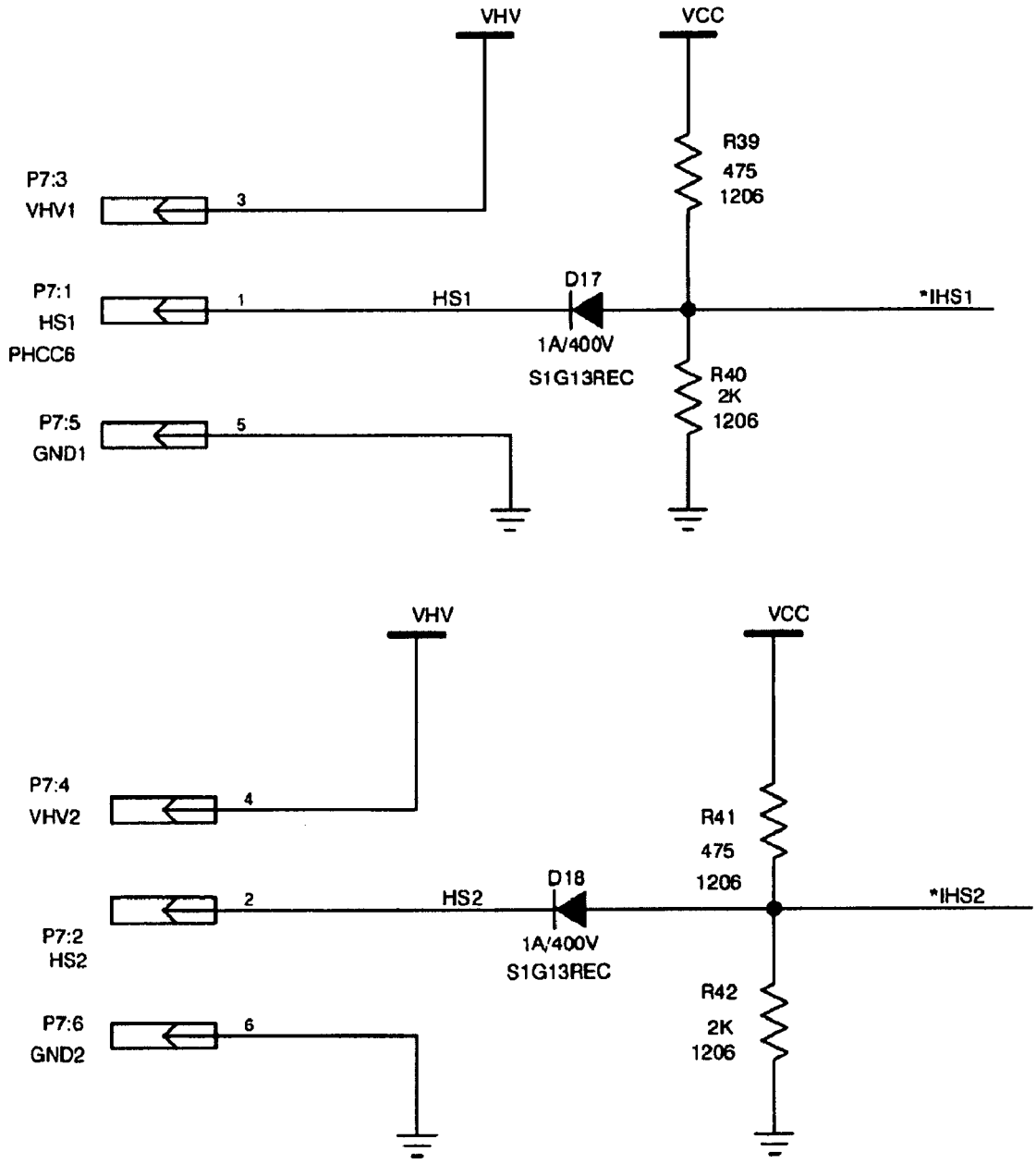
FIG. 29A(13)

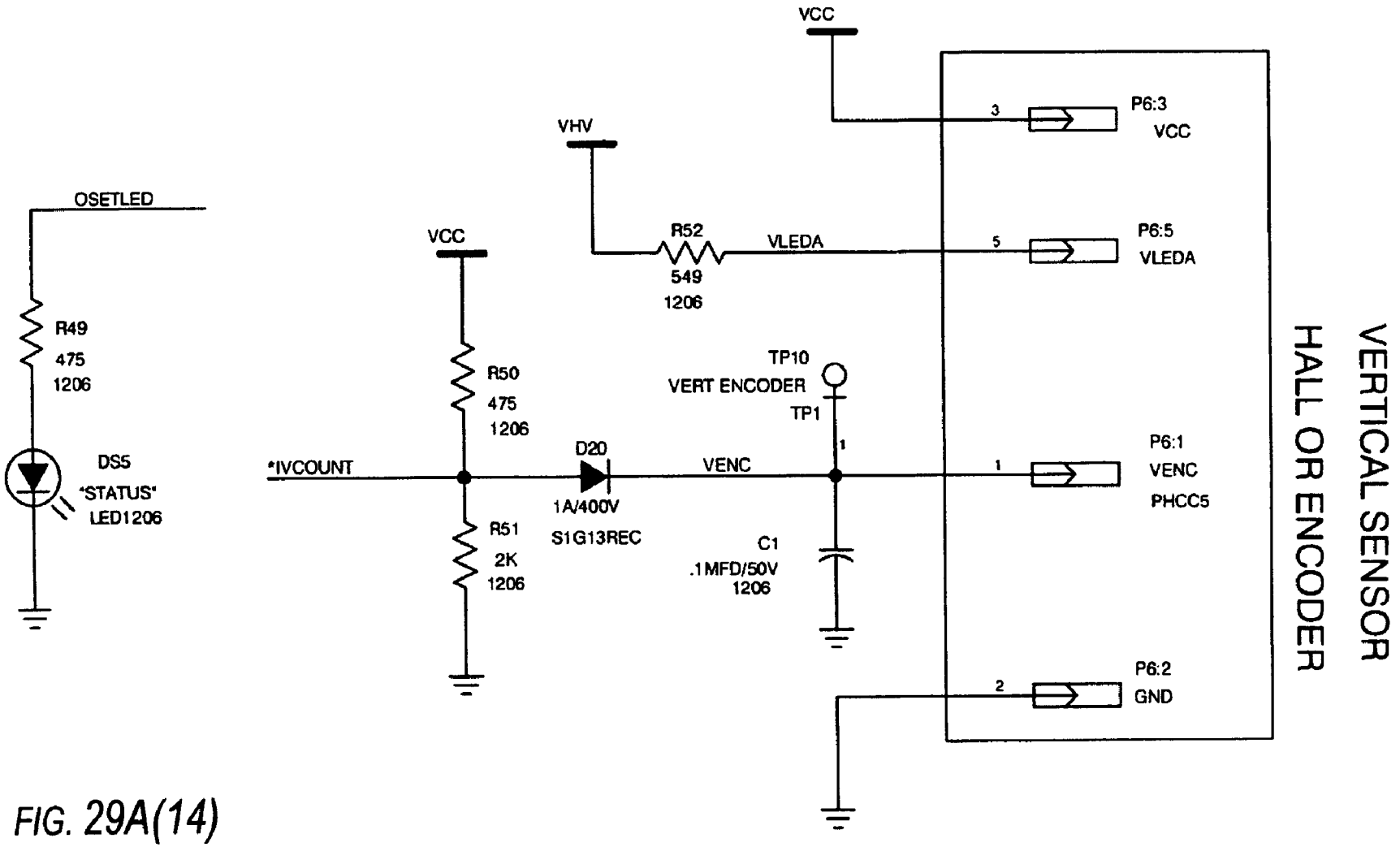
FIG. 29A(14)

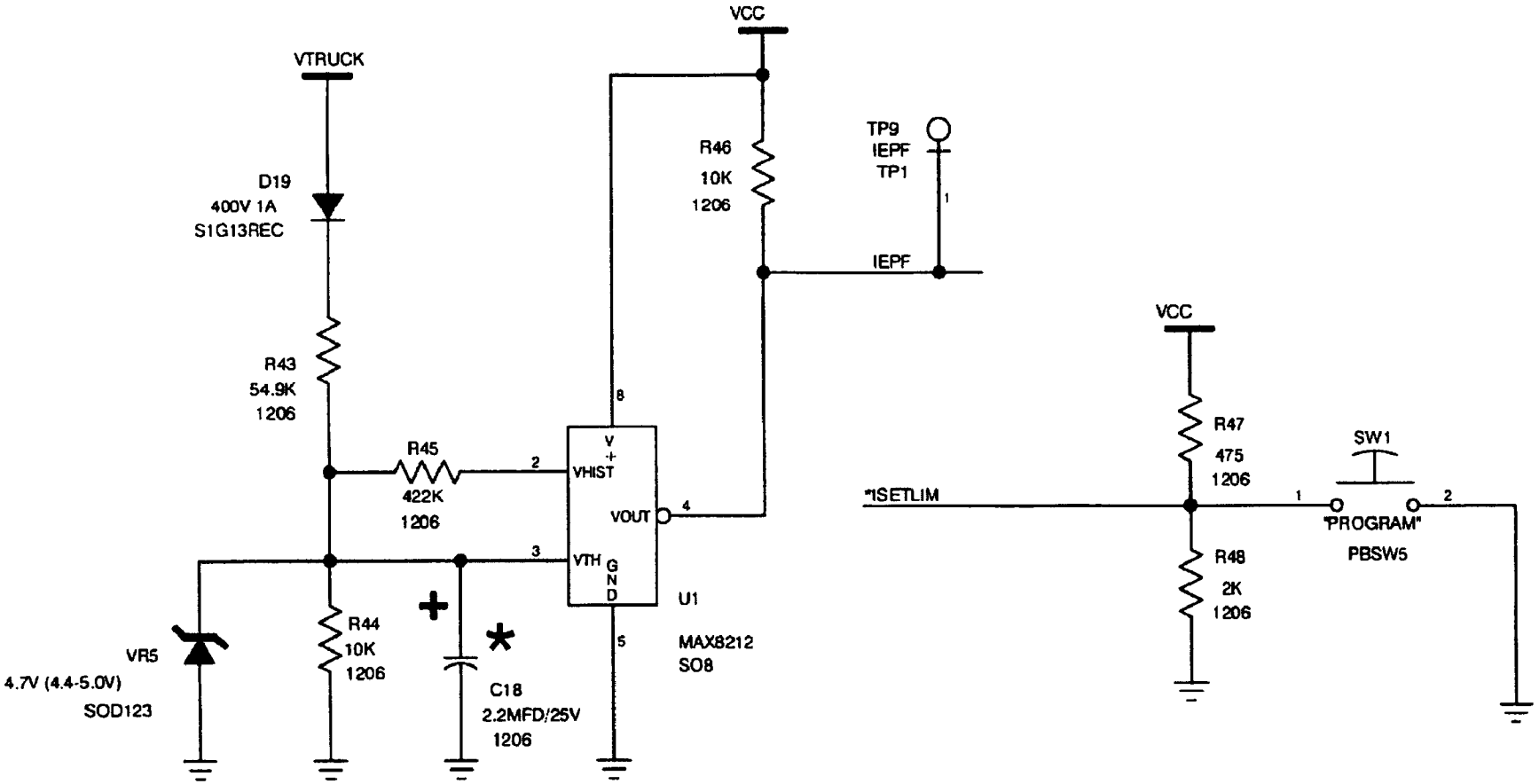
FIG. 29A(15)

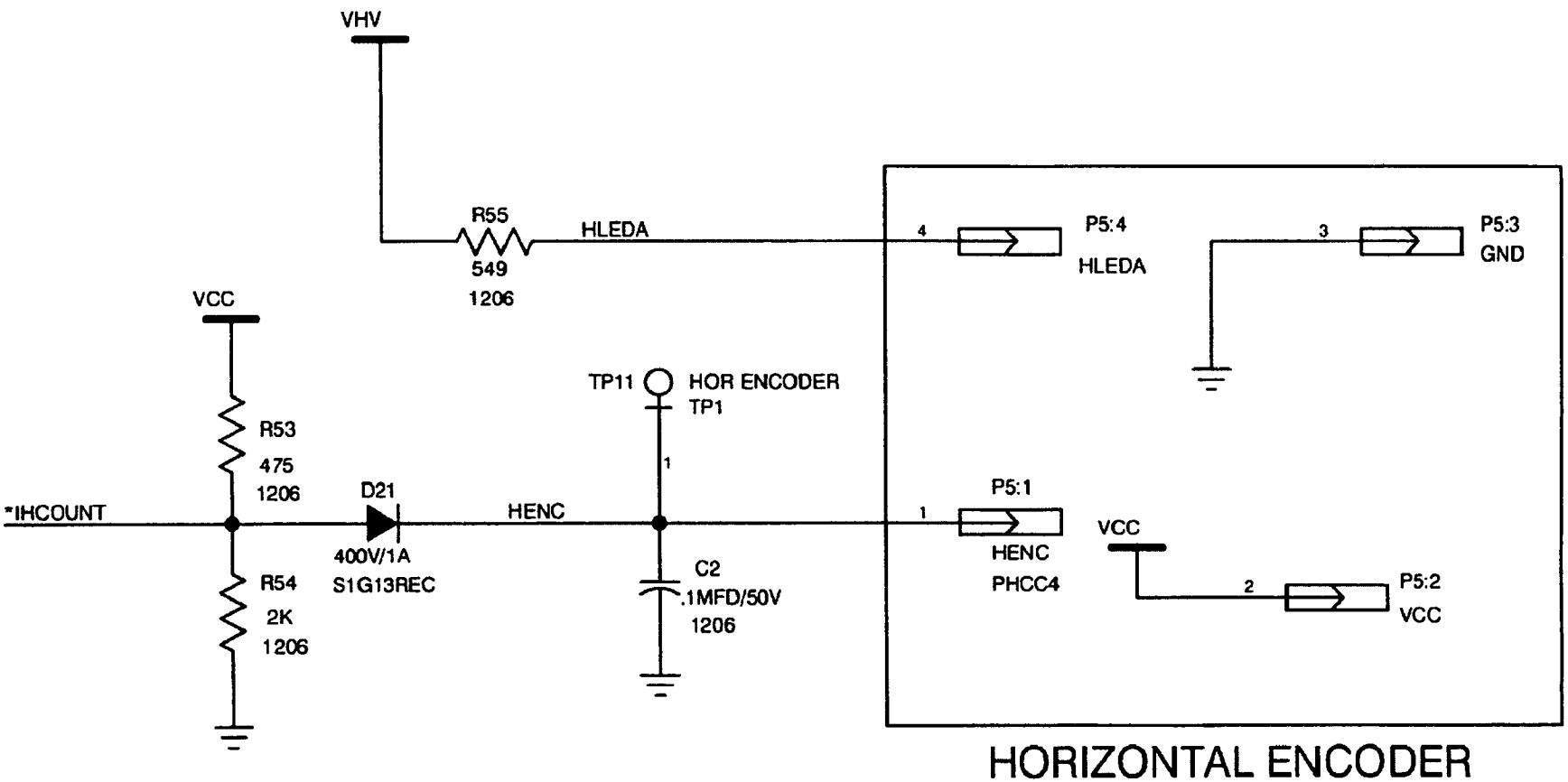
FIG. 29A(16)

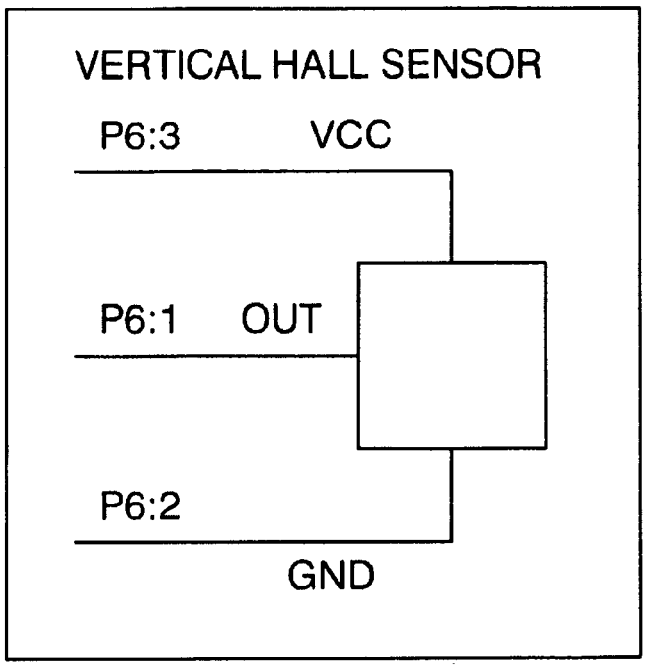
FIG. 29A(17)

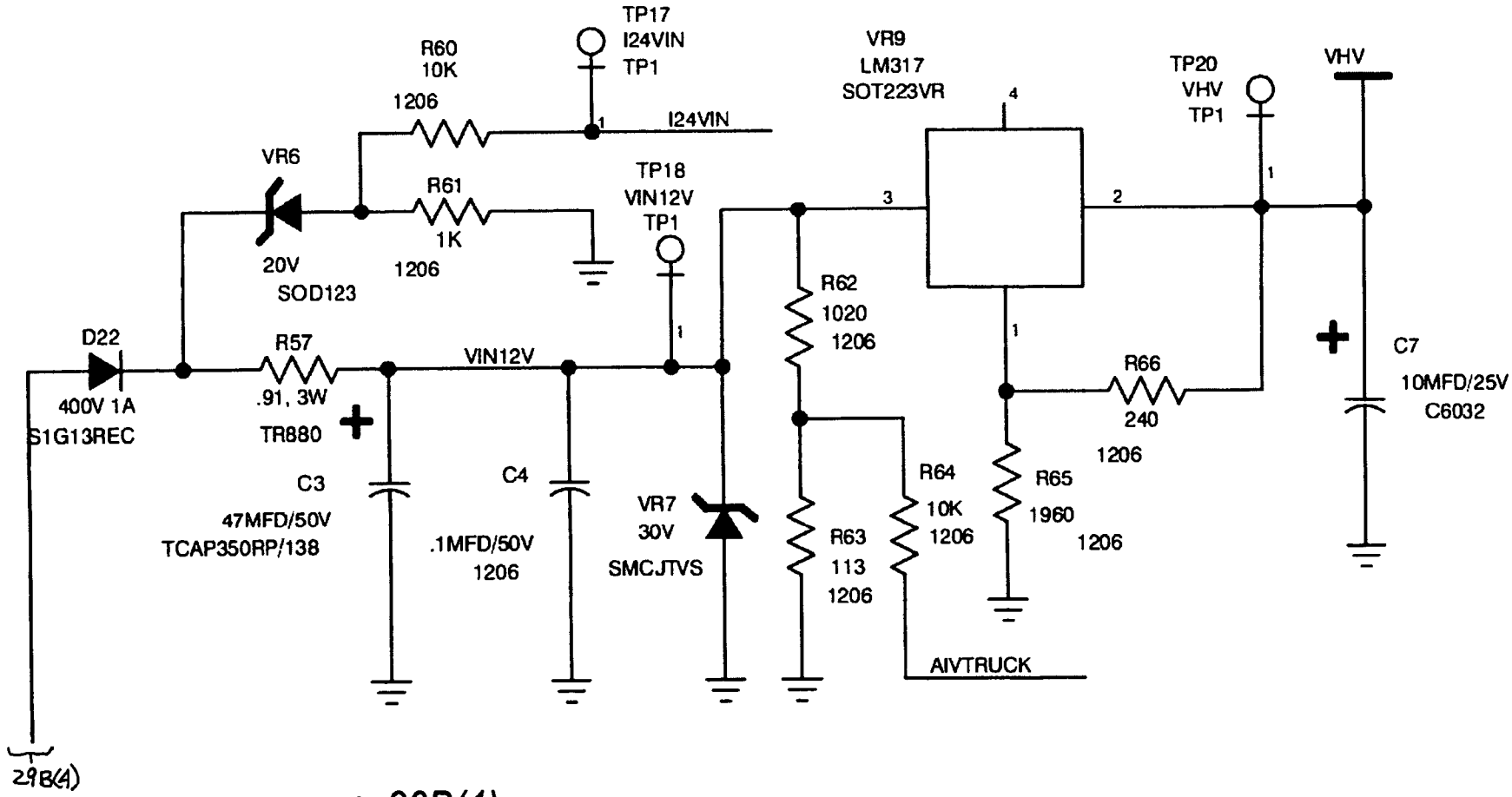
FIG. 29B(1)

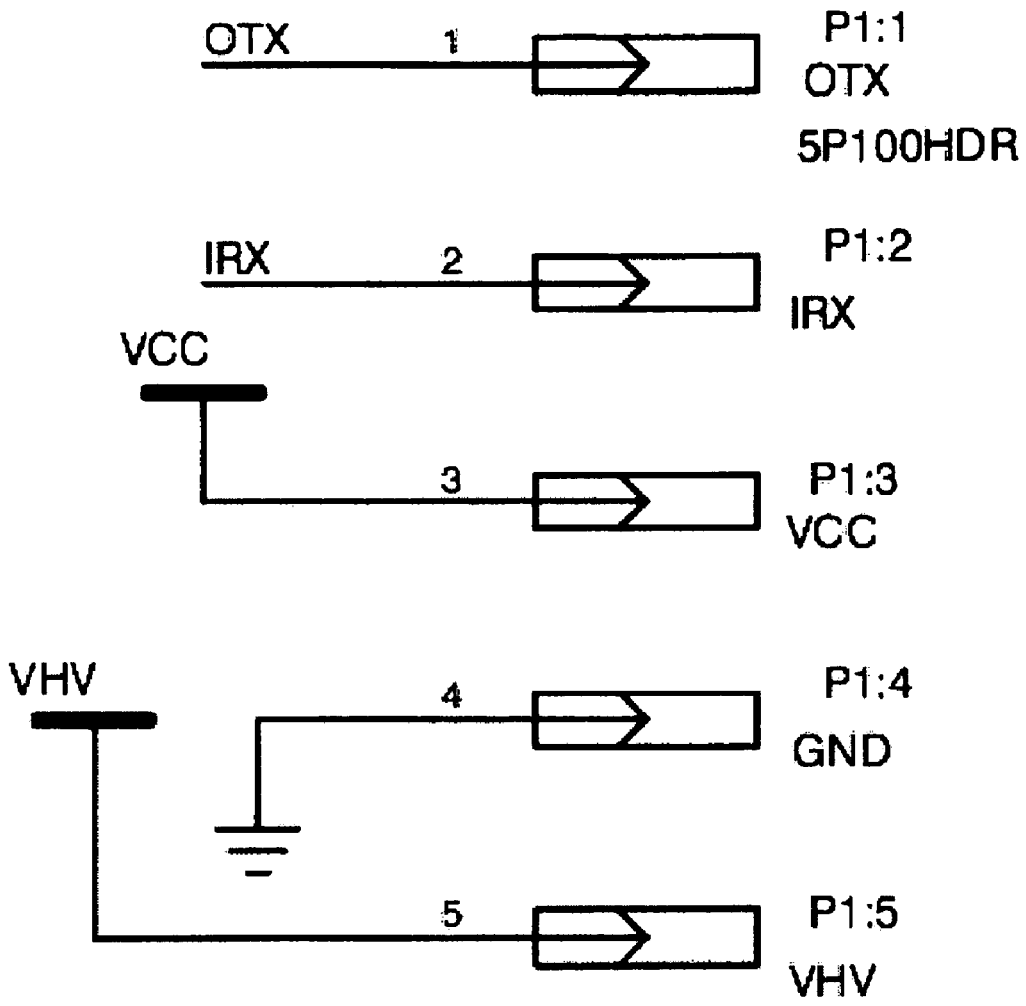
FIG. 29B(2)

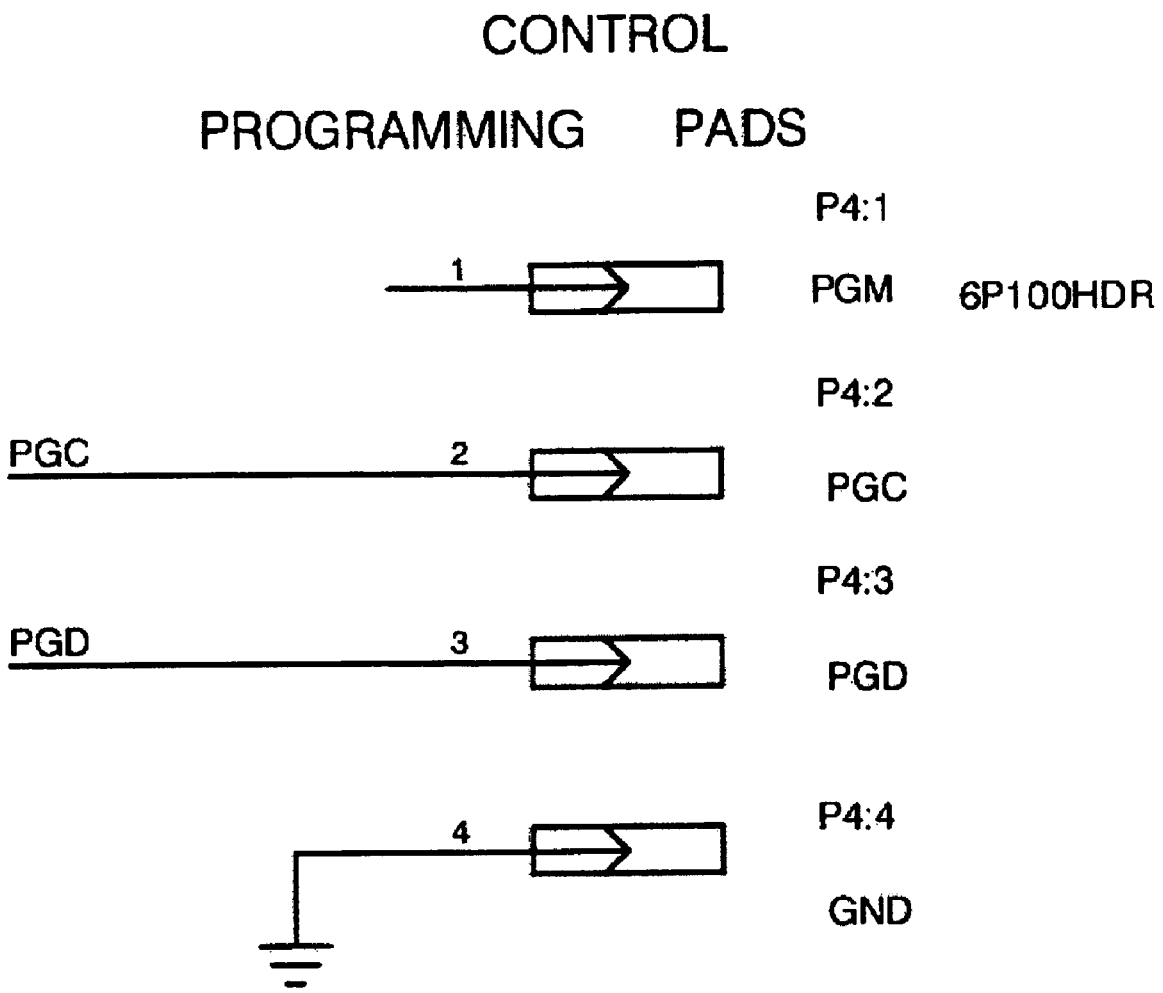
FIG. 29B(3)

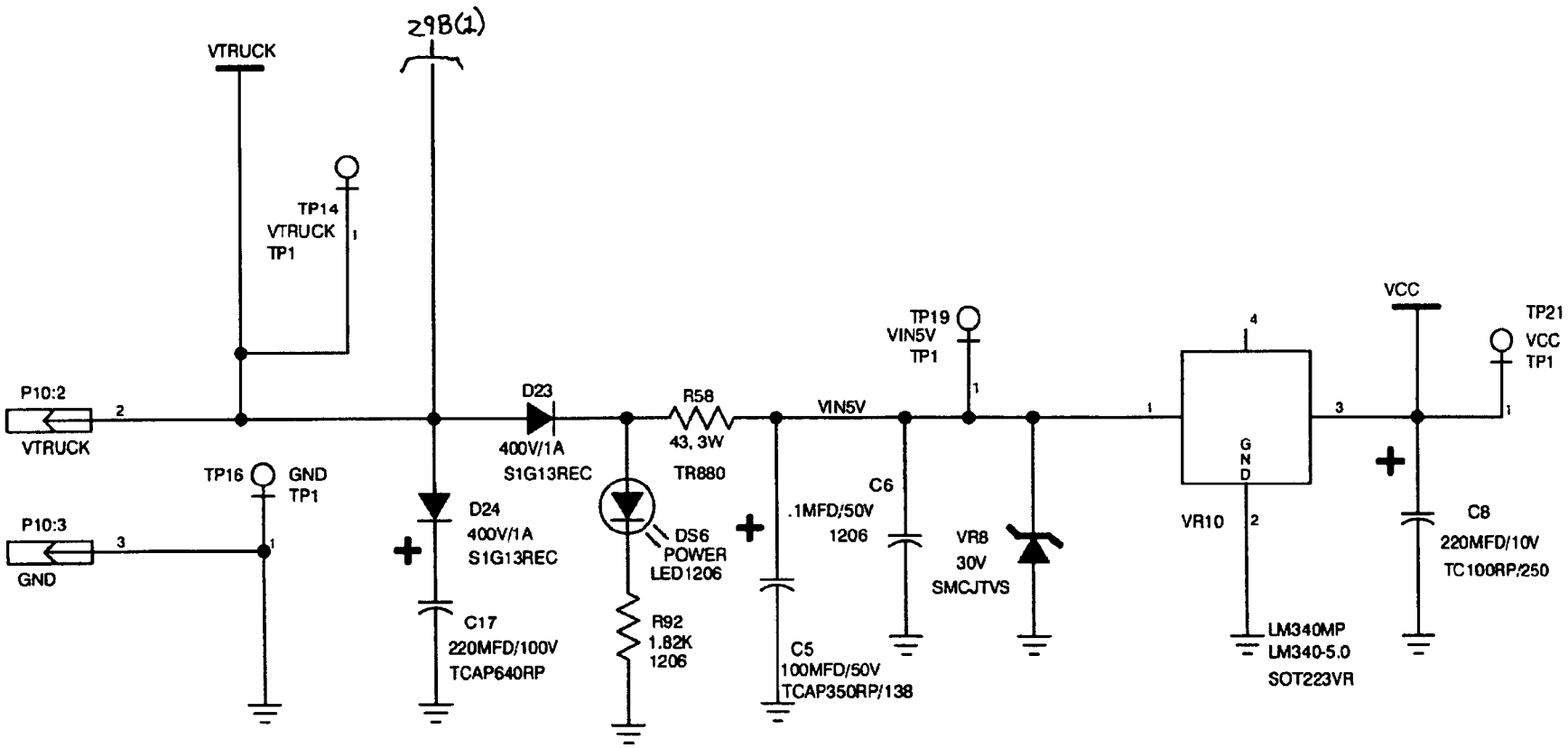
FIG. 29B(4)

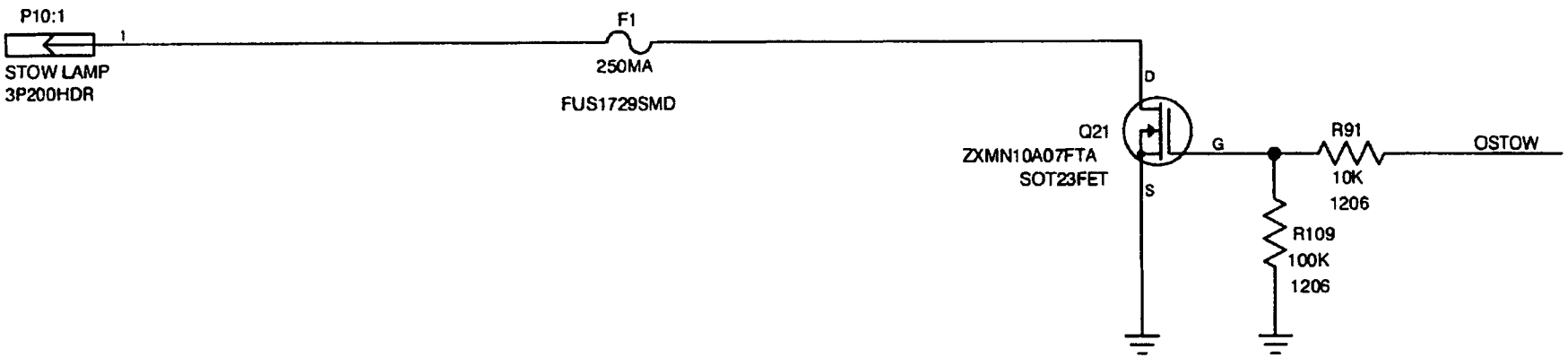
FIG. 29B(5)

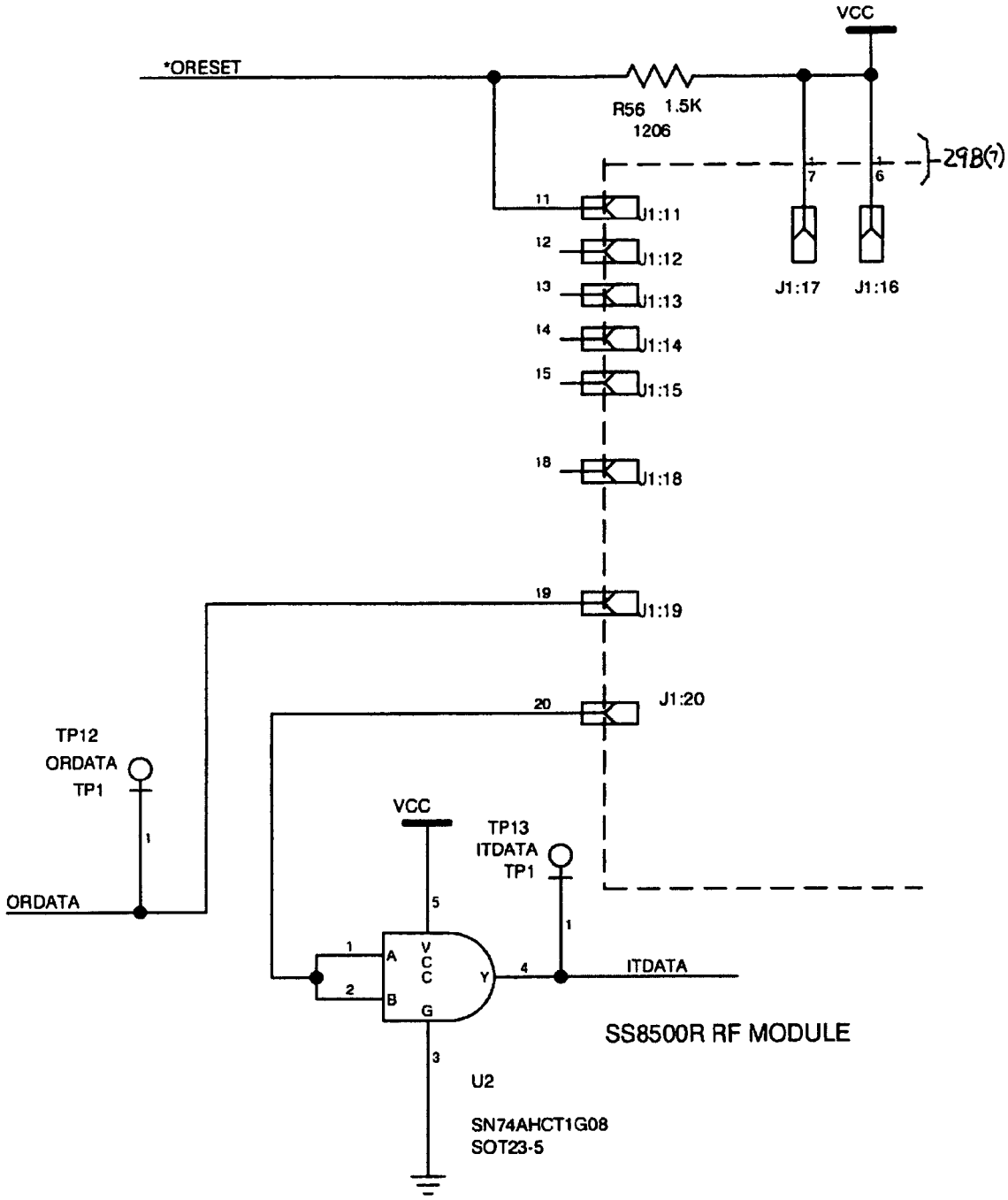
FIG. 29B(6)

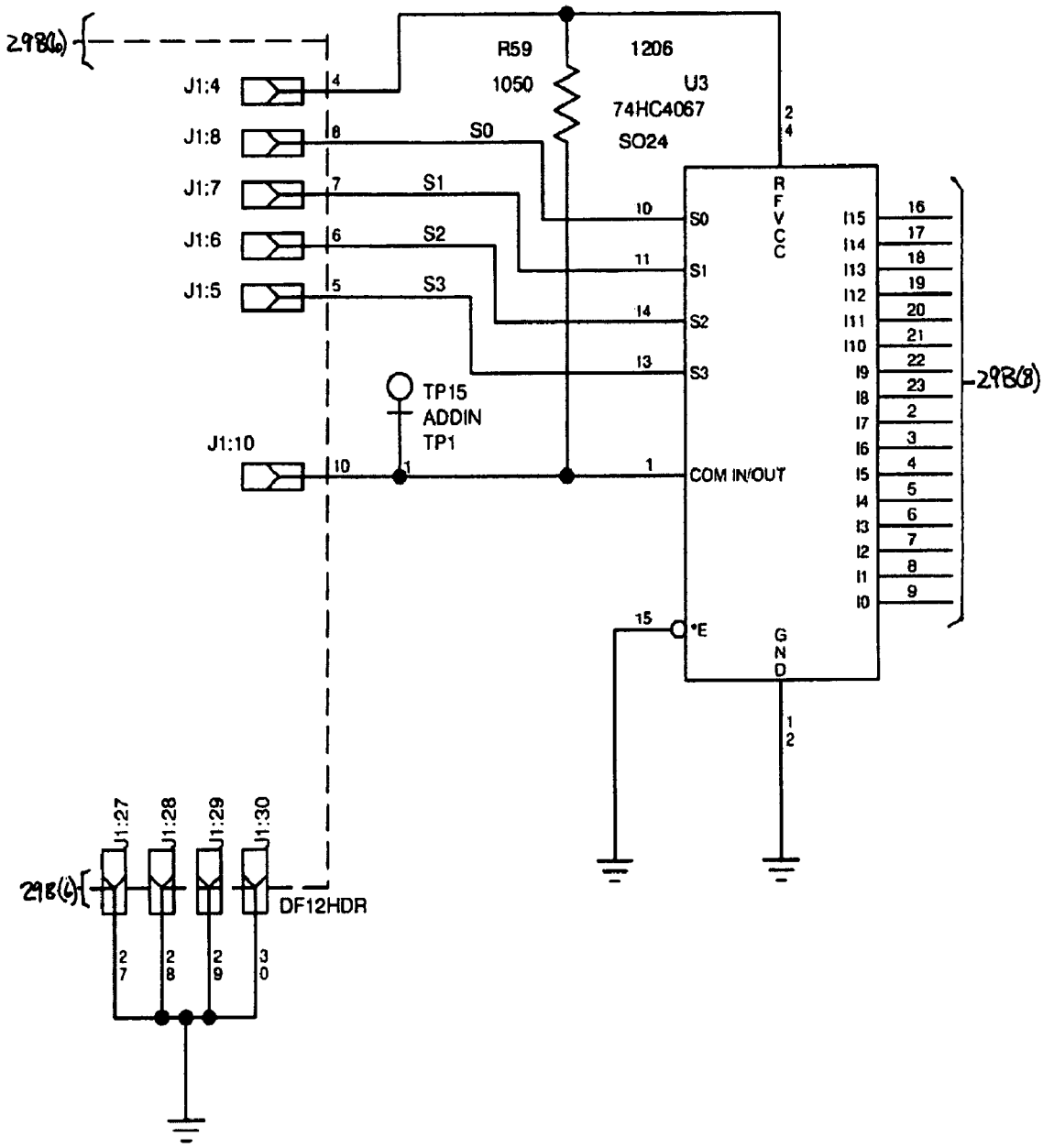
FIG. 29B(7)

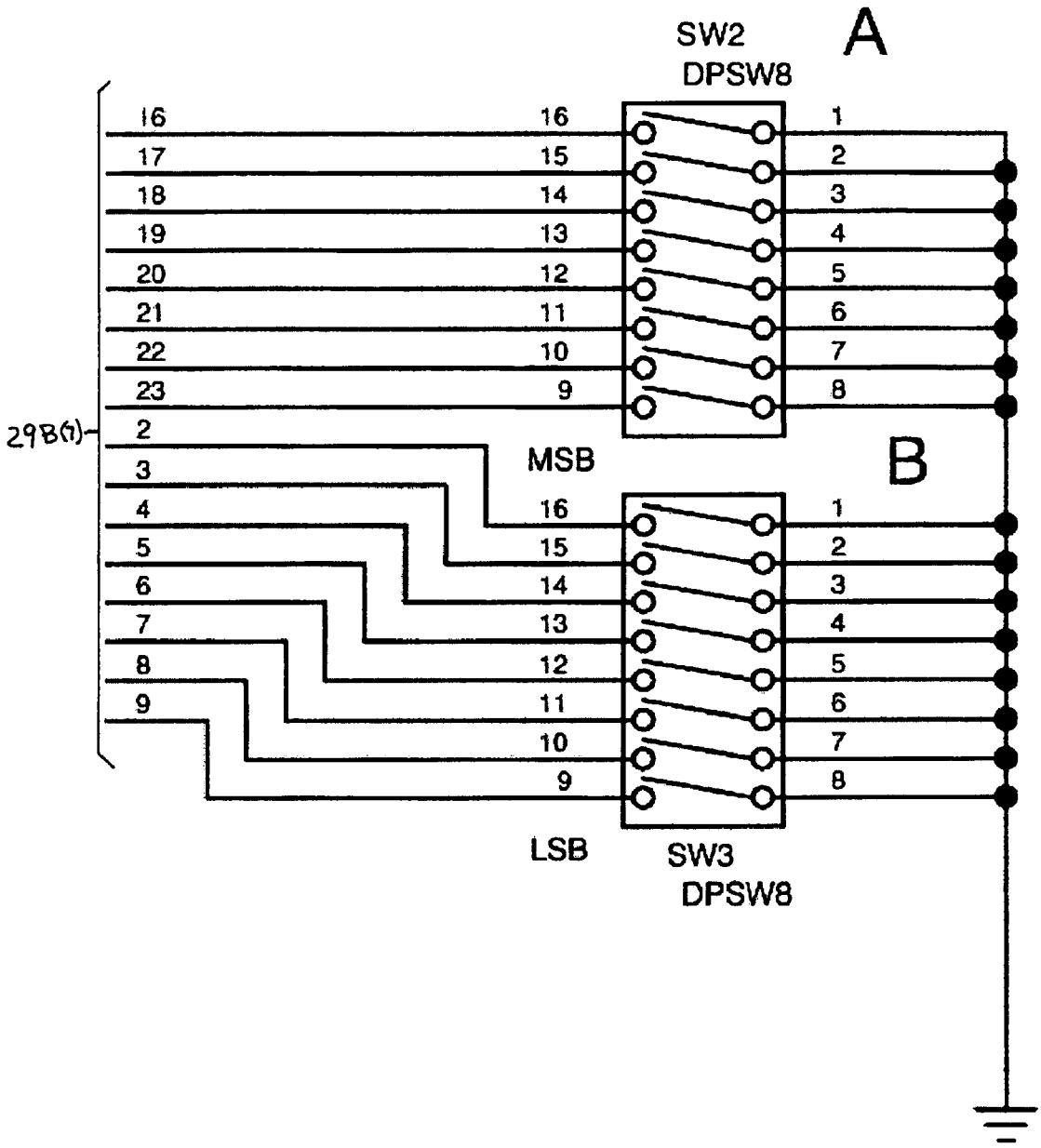
FIG. 29B(8)

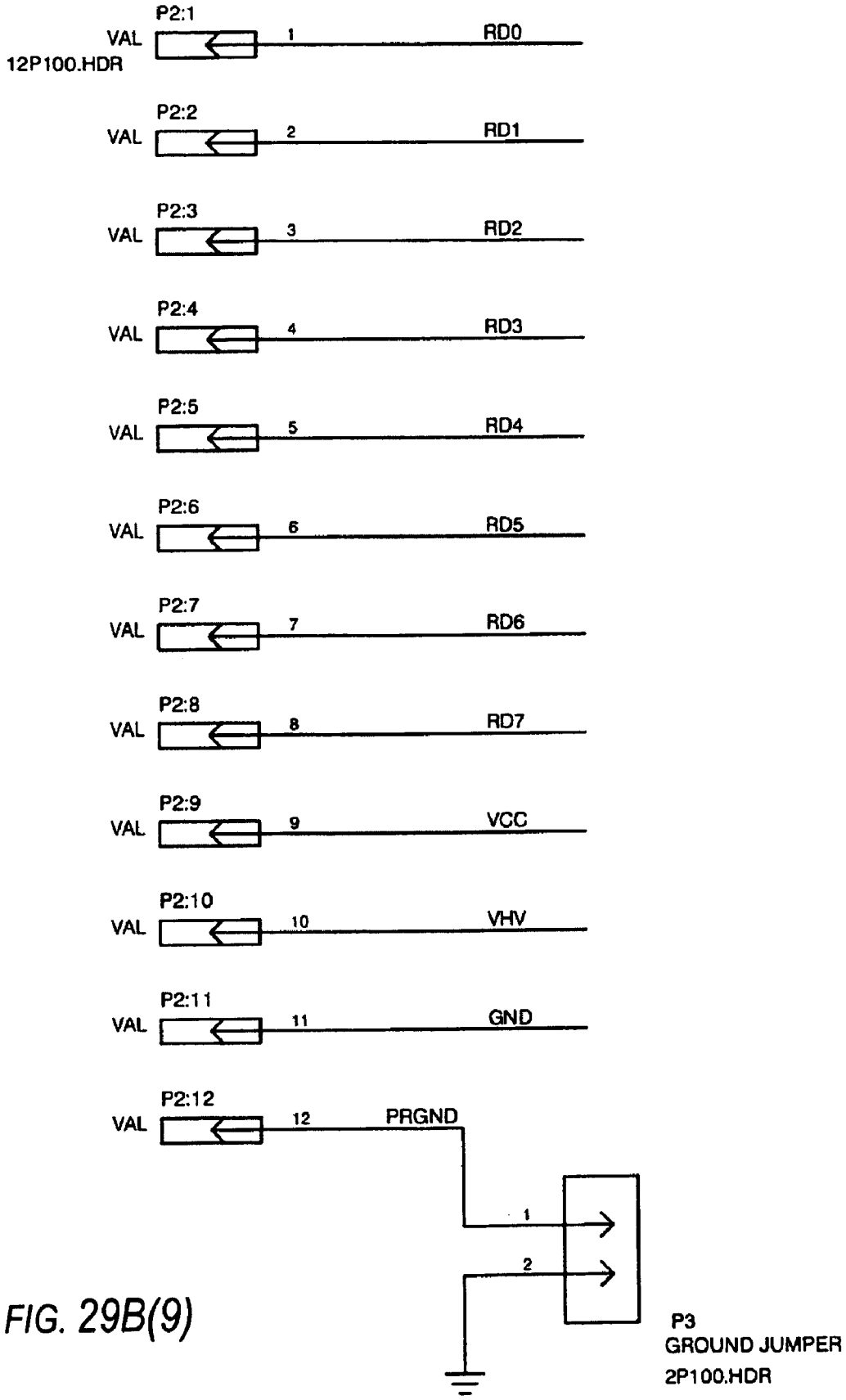
FIG. 29B(9)

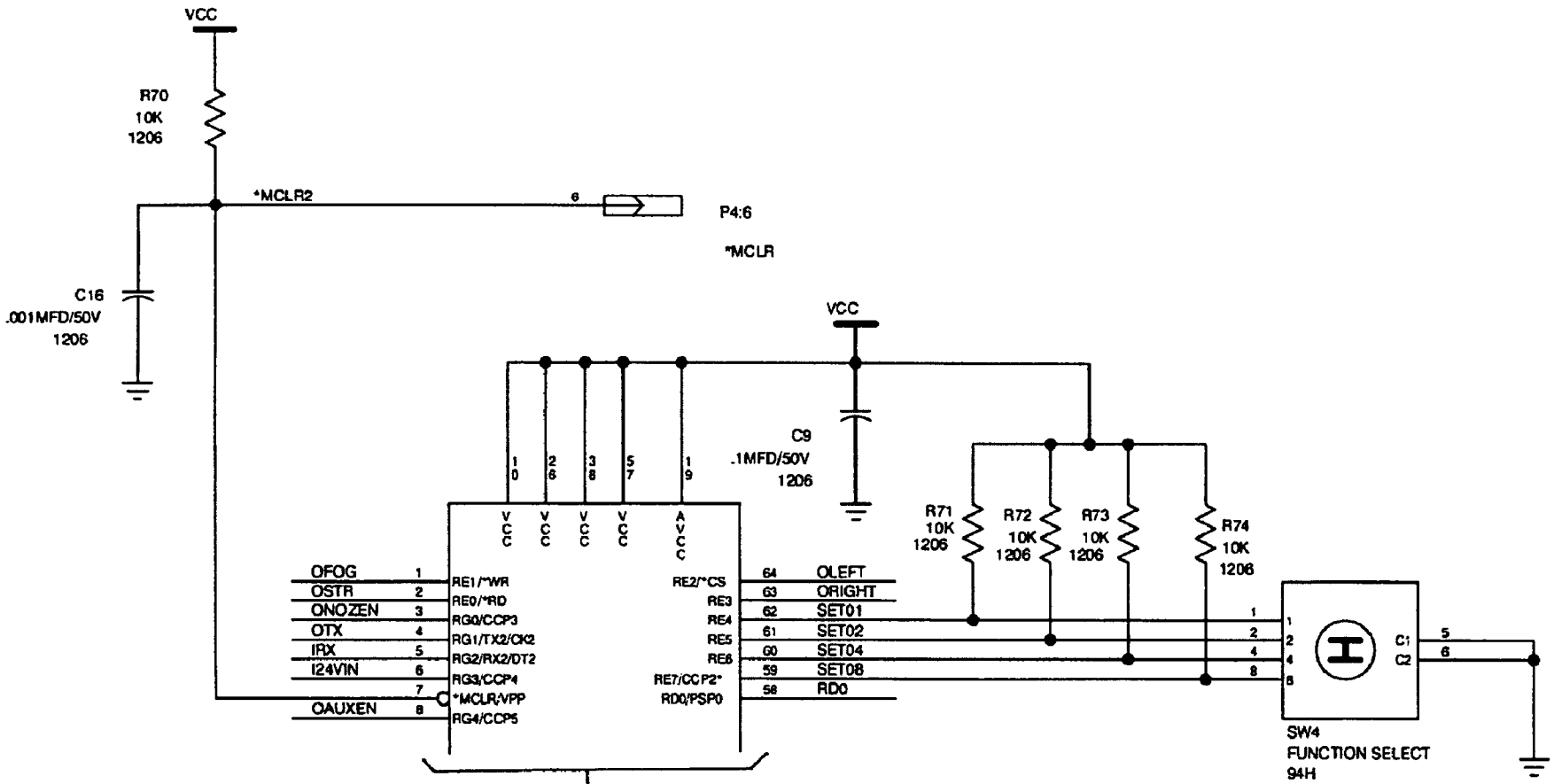
FIG. 29B(10)

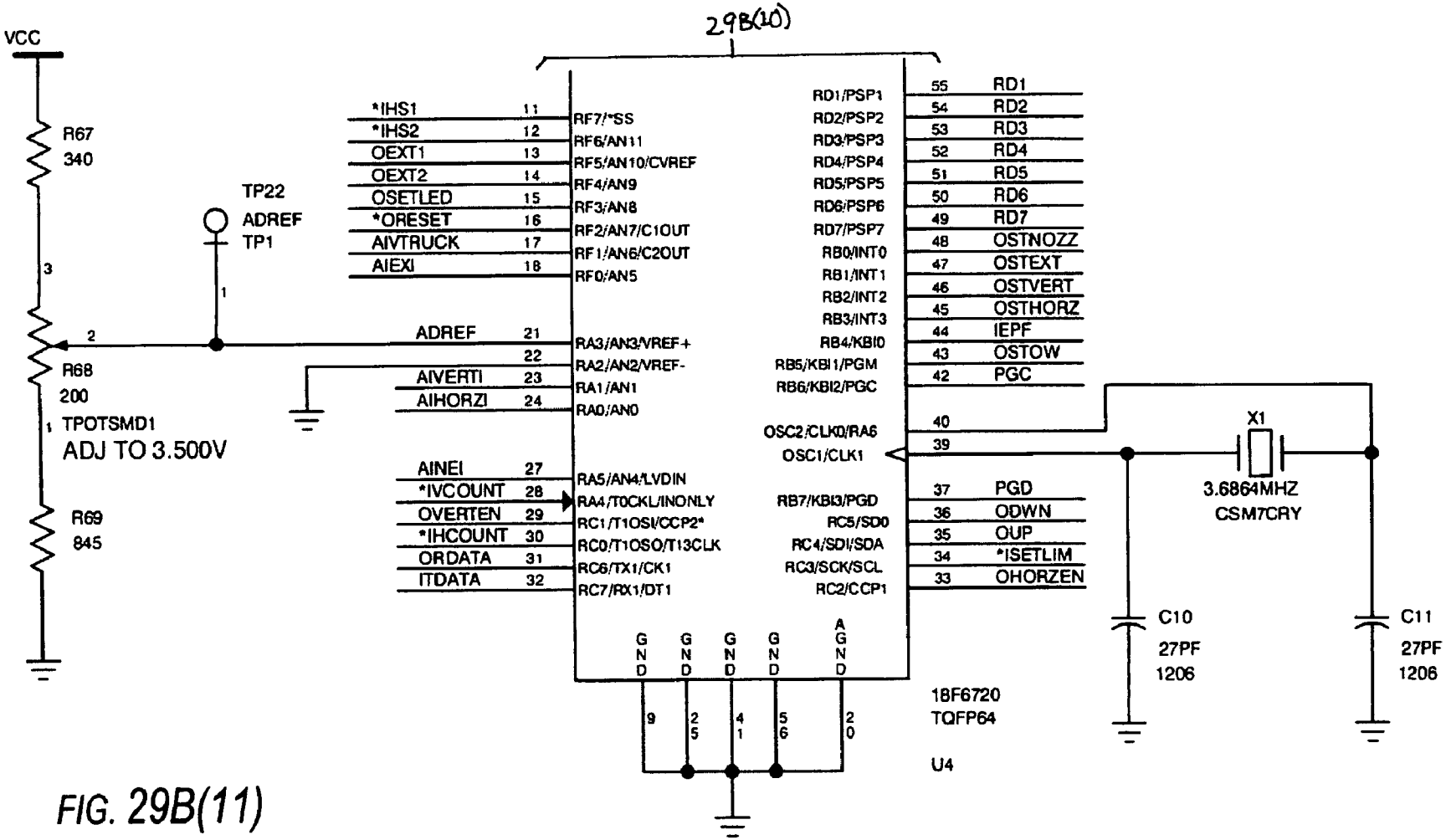
FIG. 29B(11)

FIRE-FIGHTING MONITOR WITH REMOTE CONTROL

The present application is a continuation-in-part of application entitled RADIO CONTROLLED LIQUID MONITOR, Ser. No. 10/405,372, filed Apr. 2, 2003 now U.S. Pat. No. 6,994,282, which is incorporated herein in its entirety.

TECHNICAL FIELD AND BACKGROUND OF THE INVENTION

The present invention is directed to a fire-fighting monitor and, more specifically, to a remote controlled fire-fighting monitor that can be used as a deck gun or as a portable monitor.

Portable fire-fighting monitors are specialized fire-fighting equipment that are used in conjunction with a nozzle, such as a fixed nozzle or adjustable nozzle, such as a stream shaper, to direct water at a high flow rate. Portable monitors are typically interchangeable between a deck-gun mount or base on a fire truck and a portable mount or base, such as described in U.S. Pat. No. 4,674,686, which is incorporated by reference herein in its entirety. Other portable monitors incorporate a base into the monitor body itself.

Most monitors are operated manually. However, when manually operating a monitor, the firefighter may run the risk of entering the collapse zone of the building or getting too close to hazardous materials. Further, given the operating position of the firefighter, either immediately behind or adjacent to the monitor, accurate aiming of the nozzle and, hence the water stream, is often difficult to achieve. Without accurate stream placement, water can be wasted.

Consequently, there is a need for a monitor that can be remotely controlled to allow remote operation of the stream of fluid from the monitor while keeping firefighters out of collapse zones and/or away from hazardous materials. Further, there is a need for a monitor than can be more accurately controlled to conserve water and minimize water damage.

SUMMARY OF THE INVENTION

Accordingly, the present invention provides a monitor that can be remotely controlled and, further, controlled in a manner to achieve greater accuracy in the positioning of the nozzle and, hence, the direction of water stream from the nozzle to conserve water, reduce water damage, and hasten fire suppression.

In one form of the invention, a fire-fighting monitor includes a base and a monitor housing. The base is adapted to be in fluid communication with a fluid source and comprises a fixed base or a portable base. The monitor housing has an inlet and an outlet, with the inlet releasably mounted on the base for receiving fluid through the base. The outlet is in fluid communication with the inlet for discharging fluid from the housing. A rotatable connection is provided between the inlet and the base so that the inlet is rotatable about the base at the rotatable connection about a first axis. A drive mechanism associated with the rotatable connection selectively rotates the inlet about the base at the rotatable connection. The monitor further includes a control system for selectively actuating the drive mechanism. The control system includes a receiver for receiving an input signal from a transmitter remote from the monitor and actuates the drive mechanism in response to the receiver receiving an input signal.

In one aspect, the housing includes a latch mechanism for releasably engaging the base.

In another aspect, the drive mechanism is mounted to the housing and includes a motor and a drive gear, with the base including a driven gear engaged by the drive gear. The motor selectively drives the drive gear to selectively drive the driven gear in response to the control system when the receiver receives an input signal. For example, the drive gear may comprise a pinion gear, and the driven gear may comprise a ring gear with gear teeth provided over its full 360° circumference.

In a further aspect, the drive gear and the driven gear each have a plurality of gear teeth, which mesh in a manner to allow the drive gear to drive the driven gear but also to allow the gear teeth of the drive gear to be separated from the gear teeth of the driven gear when the housing is lifted off the base along the first axis. For example, the gear teeth of the gears may be aligned along and generally parallel to the first axis so that the drive gear and the driven gear may be disengaged when the housing is lifted off the base along the first axis. In addition, each gear tooth has first and second ends and a longitudinal extent extending between the opposed ends and along the first axis. The first ends or the second ends of the gear teeth of one of the gears are rounded or tapered to facilitate alignment with the gear teeth of the other gear. Optionally, the first ends or the second ends of the gear teeth of both of the gears are rounded or tapered to facilitate alignment of the gear teeth of the gears.

In accordance with another aspect, the housing has a second drive mechanism and a second rotatable connection wherein the outlet is rotatable at the second connection about a second axis. The second drive mechanism selectively rotates the outlet at the second rotatable connection. The control system selectively actuates one or more of the drive mechanisms in response to the receiver receiving an input signal from the remote transmitter.

In yet a further aspect, the monitor includes a spray nozzle and an actuator for adjusting the stream shape of the spray nozzle. The control system selectively operates the actuator in response to the receiver receiving an input signal from the transmitter.

In another form of the invention, a fire-fighting monitor for directing the flow of fluid from a fluid source includes a base and a monitor housing. The base is adapted to be in fluid communication with a fluid source and comprises either a fixed base or a portable base. The monitor housing has an inlet and an outlet, with the inlet releasably mounted on the base and for receiving fluid through the base. The outlet is in fluid communication with the inlet for discharging fluid from the housing. The housing includes a rotatable connection wherein the outlet is rotatable at the connection about an axis. A drive mechanism, associated with the rotatable connection, selectively rotates the outlet at the rotatable connection. The monitor also includes a control system for selectively actuating the drive mechanism. The control system includes a receiver for receiving an input signal from a transmitter remote from the monitor and actuates the drive mechanism in response to the receiver receiving an input signal.

In one aspect, the drive mechanism includes a motor and a drive shaft, which includes a drive gear. The housing includes a first pipe section and an outlet pipe section, which is rotatable about the first pipe section at the rotatable connection. The outlet pipe section forms the outlet and has a driven gear selectively driven by the drive gear of the drive shaft. In a further aspect, the drive mechanism also includes a motor gear for selectively driving the drive shaft wherein the drive shaft drives the driven gear on the outlet pipe section when the drive shaft is driven by the motor gear. Optionally, the drive shaft further includes a handle for manually driving the driving gear. For example, the handle may be removable from the drive shaft.

In yet a further aspect, the motor gear comprises a bevel drive gear, and the shaft has a bevel driven gear, which is selectively driven by the bevel drive gear to thereby drive the drive shaft.

According to another form of the invention, a fire-fighting monitor for directing the flow of fluid from a fluid source includes a base, which is adapted to be in fluid communication with a fluid source, and a monitor housing. The monitor housing has an inlet and an outlet, with the inlet mounted on the base for receiving fluid through the base. The outlet is in fluid communication with the inlet for discharging fluid from the housing. A first rotatable connection is provided between the inlet and the base so that the inlet is rotatable about the base at the first rotatable connection about a first axis. The housing includes a second rotatable connection wherein the outlet is rotatable at the second connection about a second axis. A first drive mechanism is associated with the first rotatable connection for rotating the inlet at the first rotatable connection about the base. A second drive mechanism is associated with the second rotatable connection for rotating the outlet at the second rotatable connection. The monitor also includes a control system for selectively actuating the drive mechanisms, with the control system including a receiver for receiving an input signal from a transmitter remote from the monitor and actuating at least one of the drive mechanisms in response to the receiver receiving an input signal.

In one aspect, the monitor includes the base.

In another aspect, the base may comprise a portable base or a fixed base. In addition, the housing preferably includes a latch mechanism for releasably engaging the base.

According to yet another aspect, the first drive mechanism is mounted to the housing and includes a motor and a drive gear. The base includes a driven gear engaged by the drive gear, with the motor selectively driving the drive gear to selectively drive the driven gear in response to the control system when the receiver receives an input signal. In addition, the drive gear and the driven gear each have a plurality of gear teeth, with the gear teeth meshing in a manner to allow the drive gear to drive the driven gear but also to allow the gear teeth of the drive gear to be separated from the gear teeth of the driven gear when the housing is lifted along the first axis. For example, the gear teeth of the gears may be aligned along the first axis wherein the drive gear and the driven gear may be disengaged when the housing is lifted off the base along the first axis.

In yet another form of the invention, a fire-fighting monitor for directing the flow of fluid from a fluid source includes a base and a monitor housing. The monitor also includes a first rotatable connection between the inlet of the monitor housing and the base, with the inlet being rotatable about the base at the first rotatable connection about a first axis. The housing includes a second rotatable connection wherein the outlet is rotatable at the second connection about a second axis. The monitor also includes a control system for selectively rotating the inlet about the base about the first axis and for selectively rotating the outlet about the second axis. The control system includes a receiver for receiving an input signal from a transmitter remote from the monitor and rotates the inlet and/or the outlet about their respective rotatable axes in response to the receiver receiving an input signal.

In one aspect, the control system is configured to detect when the monitor moves in a direction opposite to the stream direction. For example, the control system may include a sensor, such as an accelerometer, which is mounted in a manner to detect movement of the monitor in the direction opposite the stream direction.

In yet another aspect, the control system may be configured to detect either the position of the nozzle or when the nozzle is moved into a preselected position. For example, the control system may include a sensor, such as a hall effect sensor, that detects when the nozzle has reached its lowest safe operating elevation. For example, a magnet may be mounted to the outlet elbow and located so that it coincides with the lowest safe operating elevation of the nozzle. In addition, the control system may be configured to limit to movement beyond the lowest safe operating position and/or configured to allow this "control stop" to be overridden. For example, the control system may include a manual override button, which when pushed, allows an operator to lower the nozzle below the "control stop".

Accordingly, as would be understood, the monitor of the present invention provides a remote controlled monitor than can be configured as a portable monitor or a deck gun monitor on a truck. The position of the nozzle mounted to the monitor is remotely controlled so that the operator of the monitor can stay clear of the collapse zone of the building and stay at a safe distance from any hazardous materials. Further, the positioning of the nozzle can be achieved with greater accuracy, which reduces waste, water damage, and hastens fire suppression.

These and other objects, advantages, purposes, and features of the invention will become more apparent from the study of the following description taken in conjunction with the drawings.

DETAILED DESCRIPTION OF THE DRAWINGS

Figure 28:
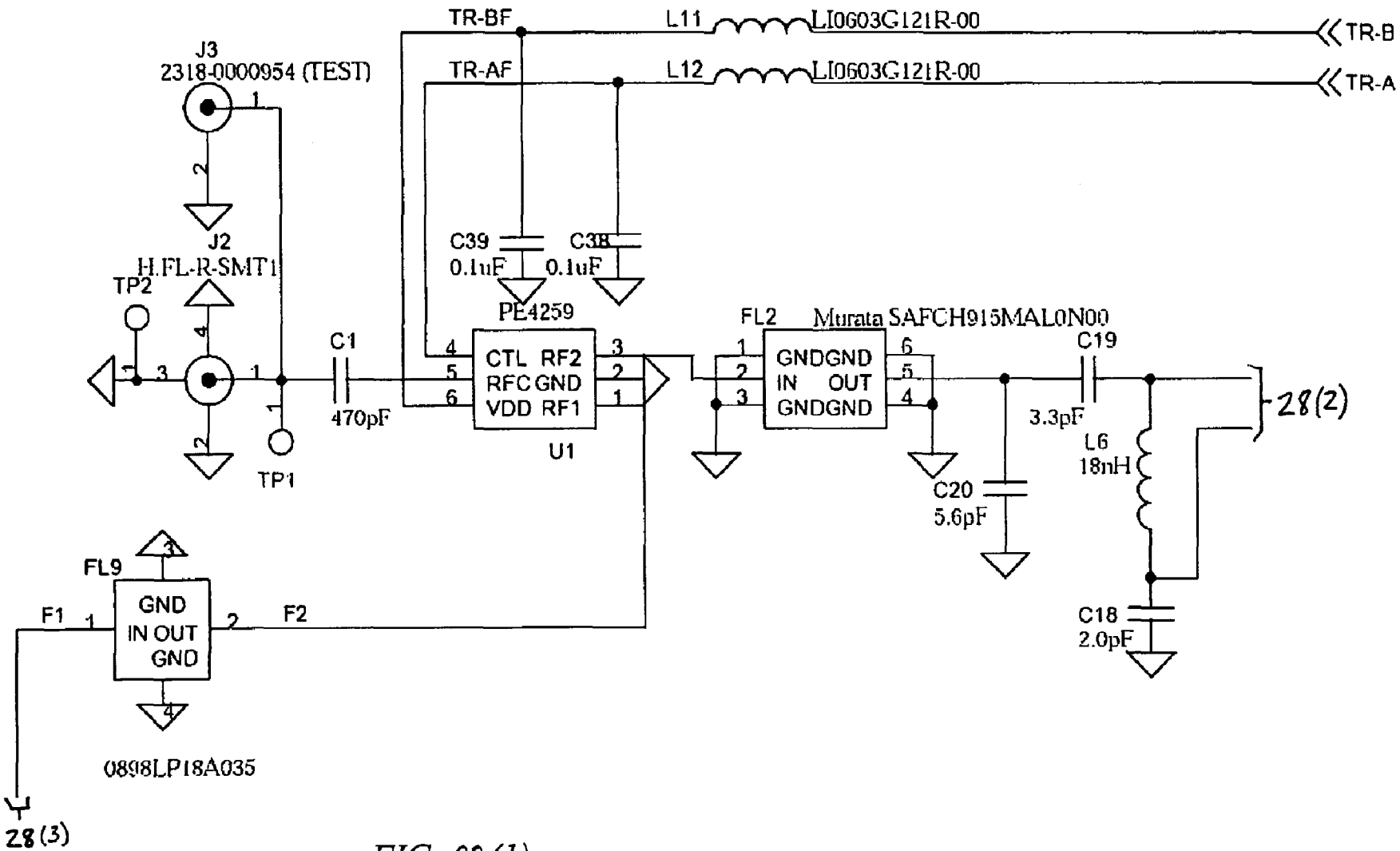
Figure 28:
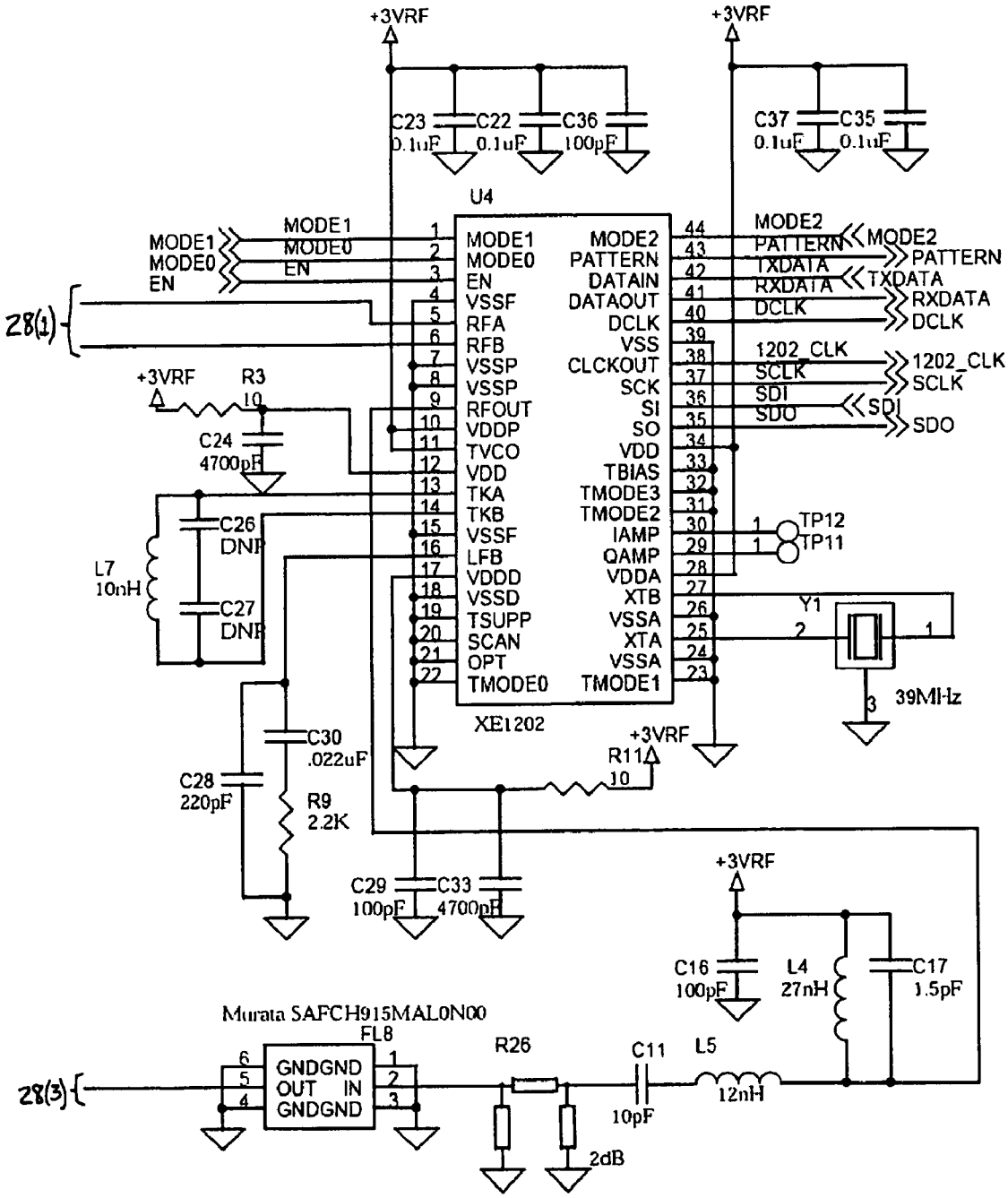
Figure 28:
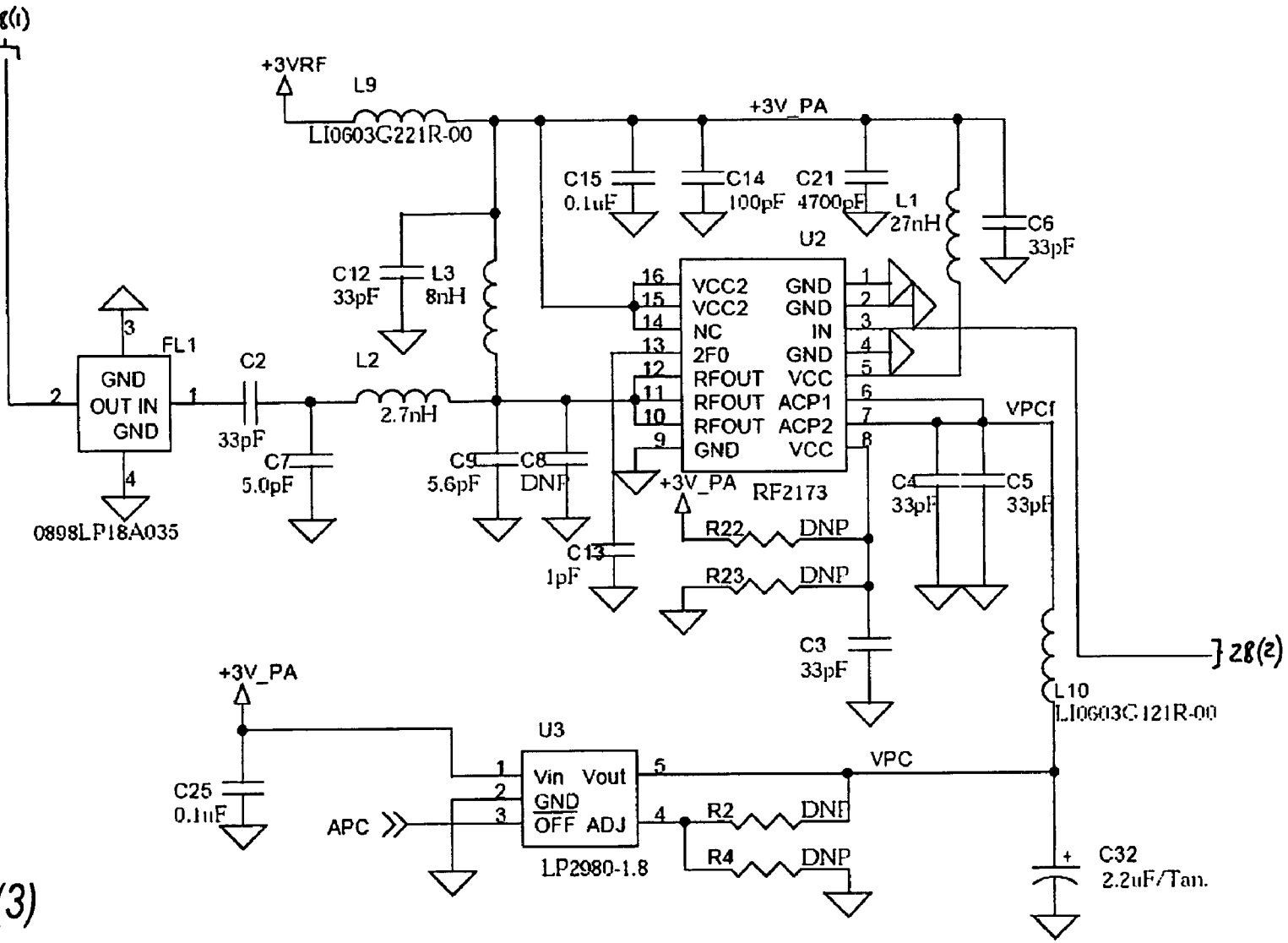

FIGS. 27A(1)–(3) and 27B(1)–(4) are schematic diagrams of frequency hopping spread spectrum transceiver;

FIG. 28(1)–(3) is a schematic diagram of the transmitter controller; and FIGS. 29A(1)–(17) and 29B(1)–(11) are schematic diagrams of the receiver control board.

DETAILED DESCRIPTION OF THE PREFERRED EMBODIMENTS

Figure 1:
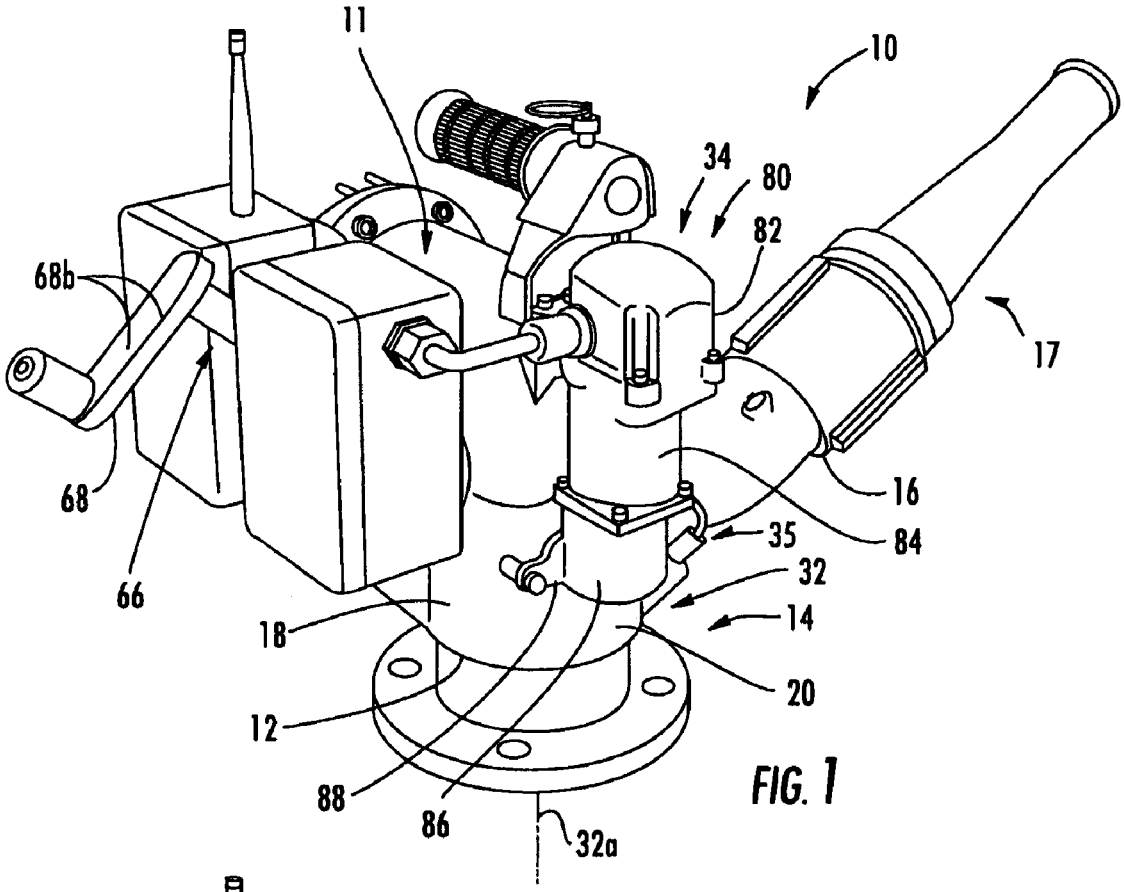
FIG. 1 is a perspective view of a monitor of the present invention incorporating a remotely controlled drive mechanism for positioning a solid stream nozzle mounted to the monitor.

Referring to FIG. 1, the numeral 10 generally designates a monitor of the present invention. As will be more fully described below, monitor 10 is adapted to be remotely controlled so that the monitor can be positioned closer to a fire while allowing the operator of the monitor to stay out of the collapse zone of a building and away from hazardous materials that may be present at the fire scene and, further, to achieve greater accuracy in the positioning of the nozzle that is mounted to the monitor. In addition, monitor 10 is configured so that it can be mounted to a fixed base (14) or portable base (214), while still retaining its remotely controlled function on either base and, further, so that it can be readily transferred between the bases.

Figure 12A:
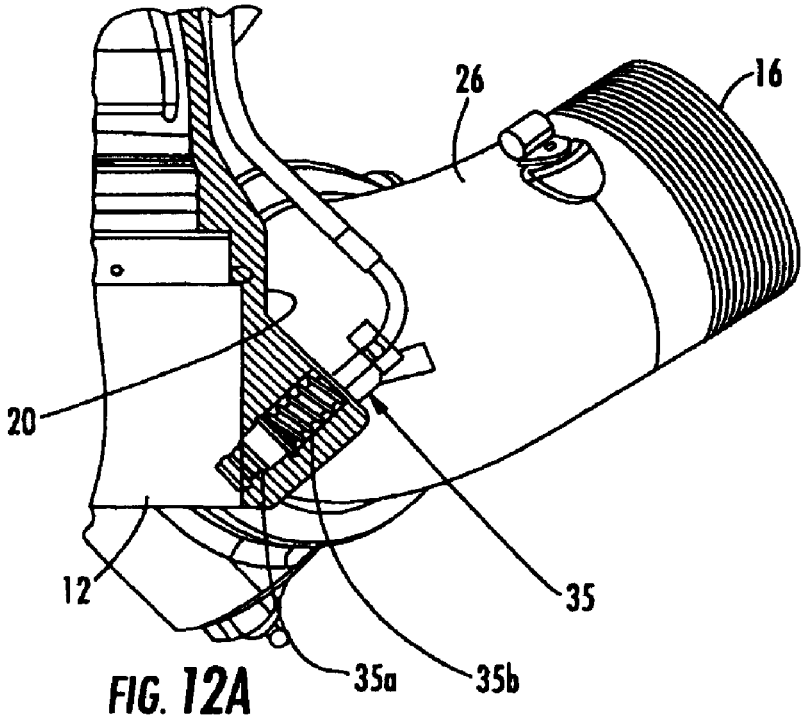
FIG. 12A is a cross-section taken along line XIIA—XIIA of FIG. 5.
Figure 12B:
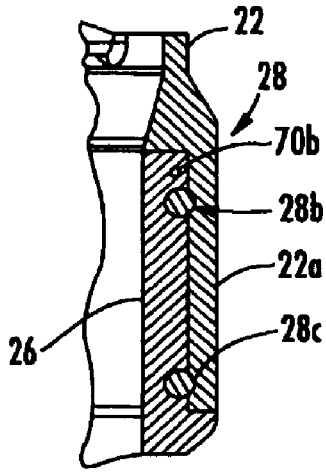
FIG. 12B is a cross-section taken alone line XIIB—XIIB of FIG. 5.

Referring to FIGS. 1–4, monitor 10 includes a housing 11 with an inlet 12, which is adapted to connect to a fixed deck gun base 14 (FIG. 1) or a portable base 214 (FIG. 23), and an outlet 16 which is adapted for mounting a nozzle 17 (FIG. 1), such as a fixed nozzle (FIG. 1) or an adjustable nozzle 117 (FIG. 2) to the monitor. Housing 11 is formed from a plurality of curved pipe sections, including a curved, first or inlet pipe section 18, a curved, second or intermediate pipe section 22, and a curved, third or outlet pipe section 26. Inlet pipe section 18 comprise a 90° elbow with an enlarged collar 20 for mounting on the base (14 or 214) and forms inlet 12. Intermediate pipe section 22 comprises a 180° elbow with an enlarged collar 22*a* and is fixed to the end of pipe section 18 by a flanged connection 24. Outlet pipe section 26 comprises a 90° elbow with a threaded end to receive a nozzle coupler 17*a*, which mounts the respective nozzle to monitor 10. Outlet pipe section 26 is rotatably mounted to intermediate pipe section 22 by a pivot joint 28 with a generally horizontal pivot axis 28*a*, which allows the position of the nozzle to vertically be adjusted. Pivot joint 28 is formed by enlarged collar 22*a* and bearings 28*b* and 28*c* (FIG. 12B), which ride on grooves formed in the proximate end of pipe section 26. To provide adjustment, outlet pipe section 26 is adapted to selectively rotate about pipe section 22 about generally horizontal axis 28*a* by a drive mechanism 30, which will be more fully described below. Further, as will be more fully described below in reference to the control system, the position of the outlet pipe section 26 may be monitored and used as feedback input into the control system to provide a safety feature.

Similarly, inlet pipe section 18 is rotatably mounted to the base by a pivot joint 32 at inlet 12 and is adapted to rotate about the base about a generally vertical axis 32*a* by a drive mechanism 34 to provide horizontal adjustment to the position of the nozzle, which will also be more fully described below. The pivot joint 32, as well as the monitor, is configured to allow a full 360° rotation or more of the monitor about the base. Further, as will be described in greater detail below, each drive mechanism is remotely controlled but optionally configured to allow manual rotation of the respective pipe sections at their respective pivot joints.

In addition, where an adjustable nozzle is mounted to outlet pipe section 26, the shape of the stream may be adjusted by an actuator 130.

Referring to FIGS. 4–7, collar 20 includes a pair of latch mechanism 35, which releasably secure housing 11 to base 14. Each latch mechanism 35 includes a latch pin 35*a* (FIG. 12A) that is urged into engagement with the base by a spring 35*b* (FIG. 12A) but releases engagement when activated to allow removal of the monitor from the base. For further details of the latch mechanism reference is made herein to application entitled FIRE APPARATUS MONITOR, Ser. No. 10/217,684, now U.S. Pat. No. 6,786,426, which is herein incorporated by reference in its entirety.

Figure 13:
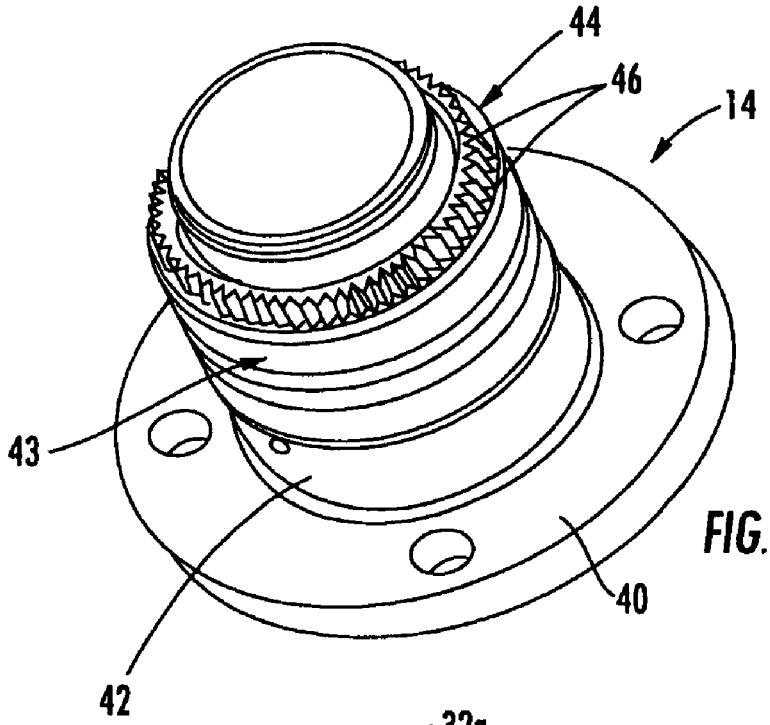
FIG. 13 is a perspective view of a deck gun base illustrating the ring gear mounted on the base.
Figure 14:
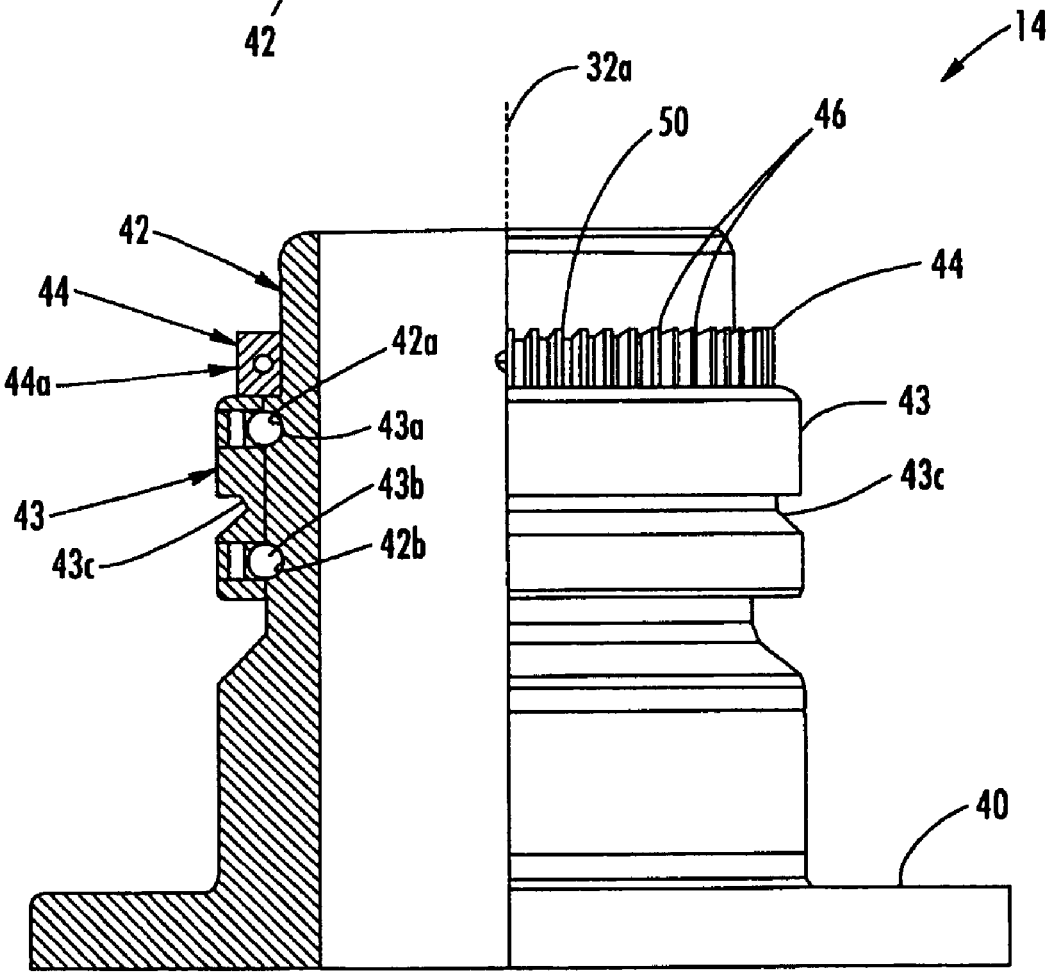
FIG. 14 is a partial fragmentary view of the base of FIG. 13.
Figure 23:
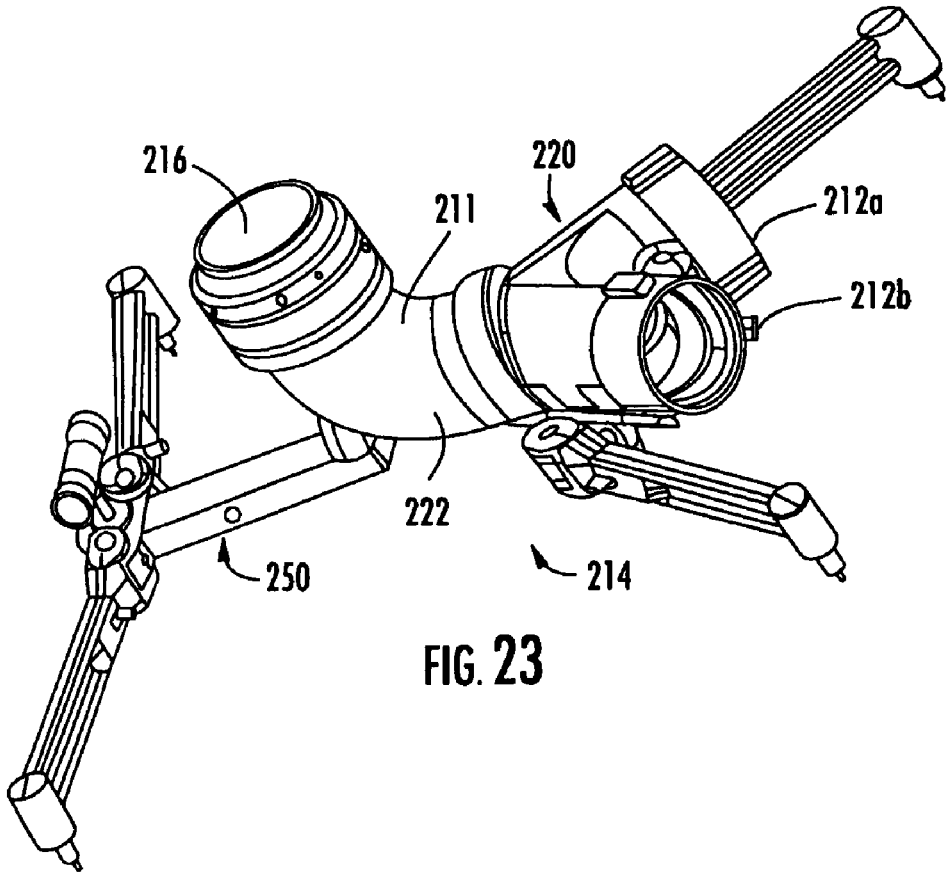
FIG. 23 is a perspective view of a portable base illustrating the ring gear mounted to the base.
Figure 24:
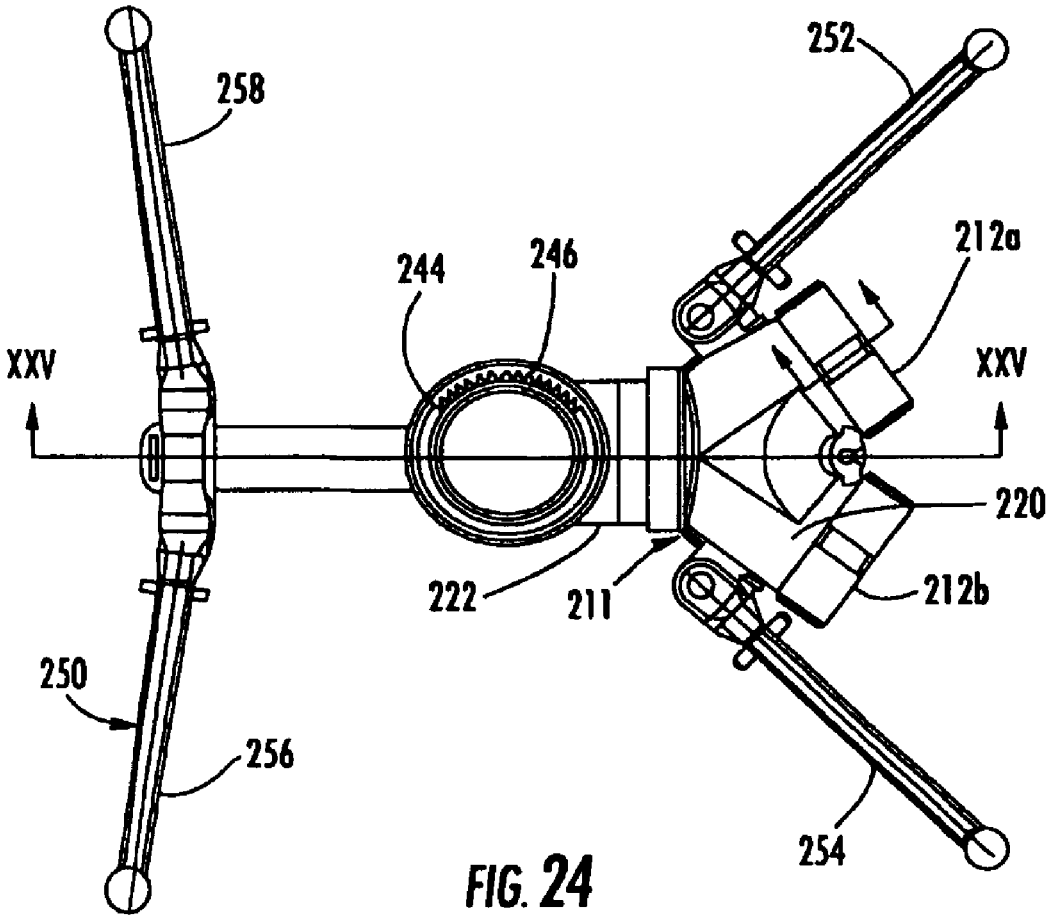
FIG. 24 is a plan view of the base of FIG. 23.
Figure 25:
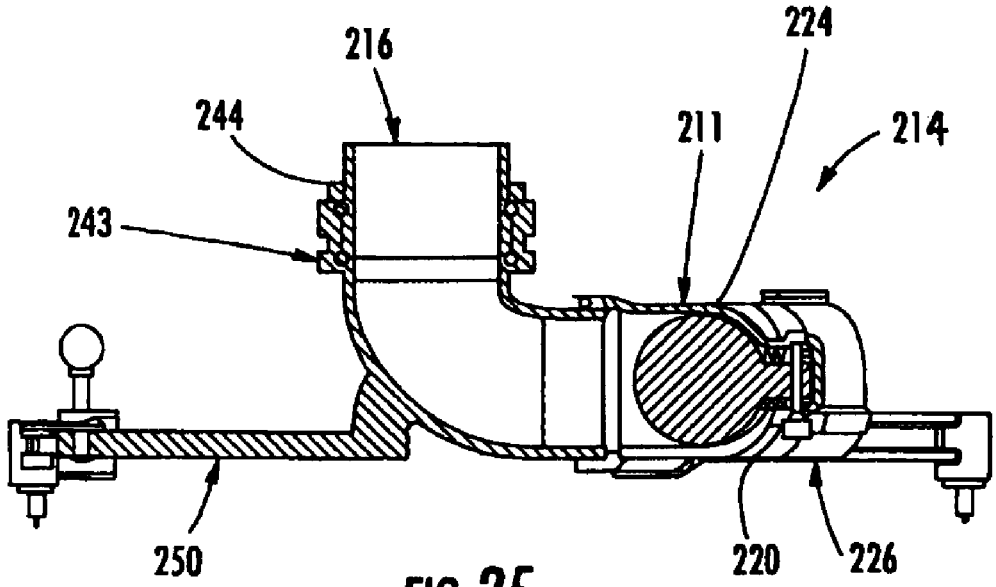
FIG. 25 is a cross-section taken along line XXV—XXV of FIG. 24.

Referring again to FIGS. 1–6, monitor 10 may be mounted to either a deck gun base 14, which is a fixed mount and positioned on top of a tire engine pumper, or a portable base 214 (FIGS. 23–25). Referring to FIG. 13 and the deck gun base, base 14 includes a mounting flange 40 and an upstanding pipe section or annular flange 42. Flange 40 is bolted to a fire truck pump discharge pipe for securing base 14 to the fire truck. Pipe section 42 includes a pair of annular grooves or tracks 42*a* and 42*b*, for receiving ball bearings 43*a* of swivel collar or base 43, and a gear ring 44, which is mounted to collar 42 by a set screw 44*a*. Swivel base 43 includes an annular groove 43*c*, which provides a safety groove, with the latch pins (35*a*) of the respective latch mechanisms 35 engaging the underside of swivel base 43 to releasably secure the monitor to base 14. Gear ring 44 provides radially spaced driven gear teeth 46 that are aligned and generally parallel to vertical axis 32*a*. Gear ring 44 preferably includes gear teeth 46 throughout its full 360° circumference. In this manner, gear ring 44 allows for a full 360° rotation or greater of monitor 10 on base 14. Though it should be understood that the gear teeth may extend only over a portion of the gear ring circumference. However, this would limit the monitor's range of motion. Further, each gear tooth 46 has a tapered or rounded upper end 50 to ease alignment with the gear of the drive mechanism, as will be more fully described below. As best seen in FIG. 3, gear ring 44 is aligned with an opening 52 formed in collar 30 of monitor 10 and, further, is accessible through opening 52 to be driven by driver mechanism 34.

Figure 2:
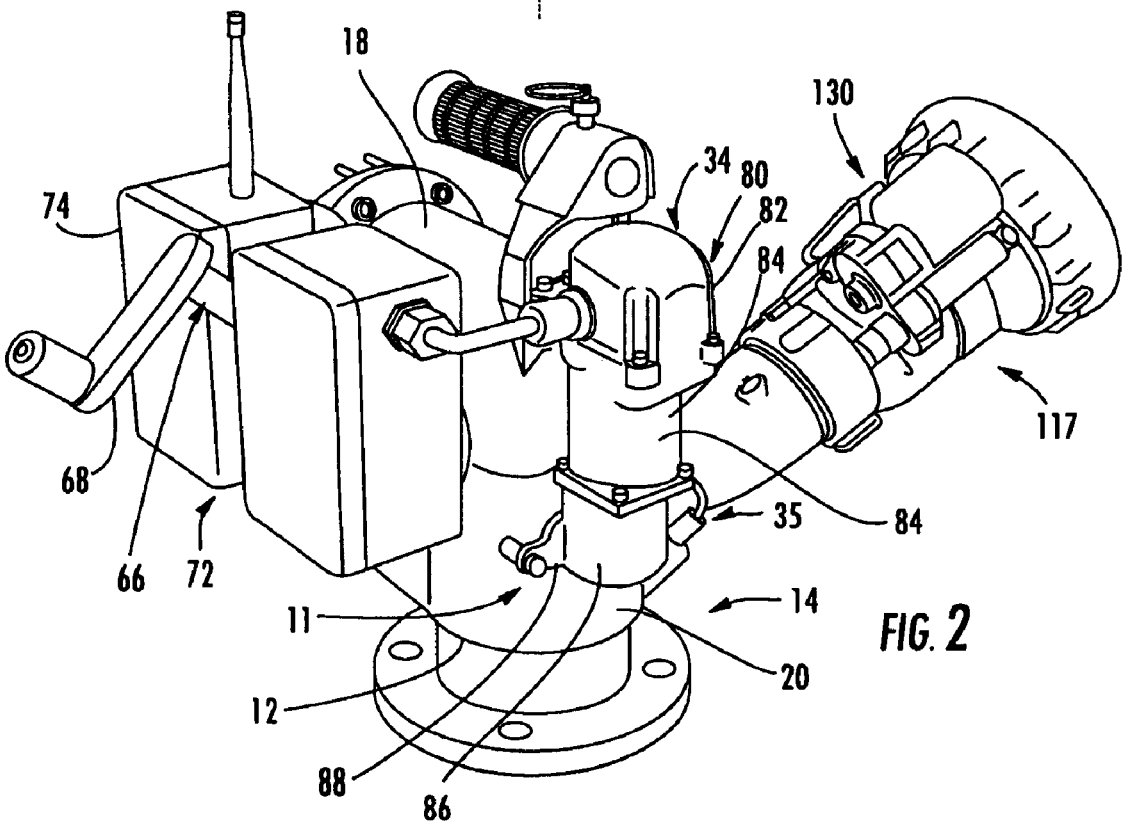
FIG. 2 is a similar view to FIG. 1 illustrating an adjustable spray nozzle mounted to the monitor.
Figure 3:
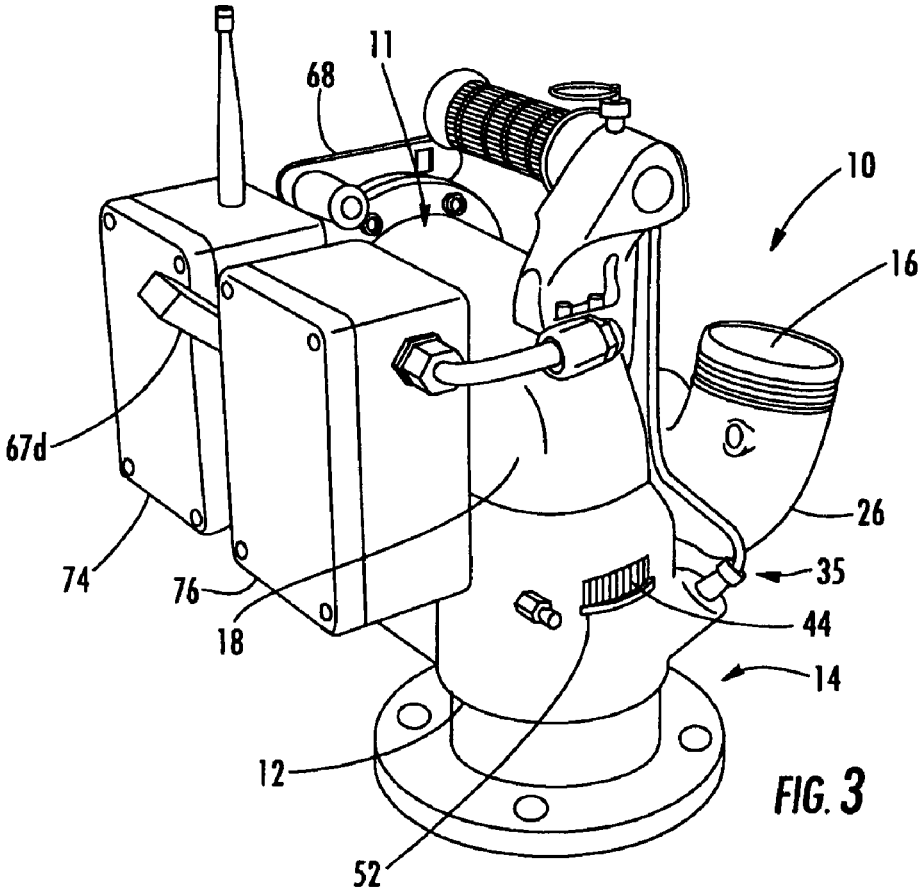
FIG. 3 is a similar view to FIG. 1 with the drive mechanism and nozzle and nozzle coupler removed for clarity.
Figure 4:
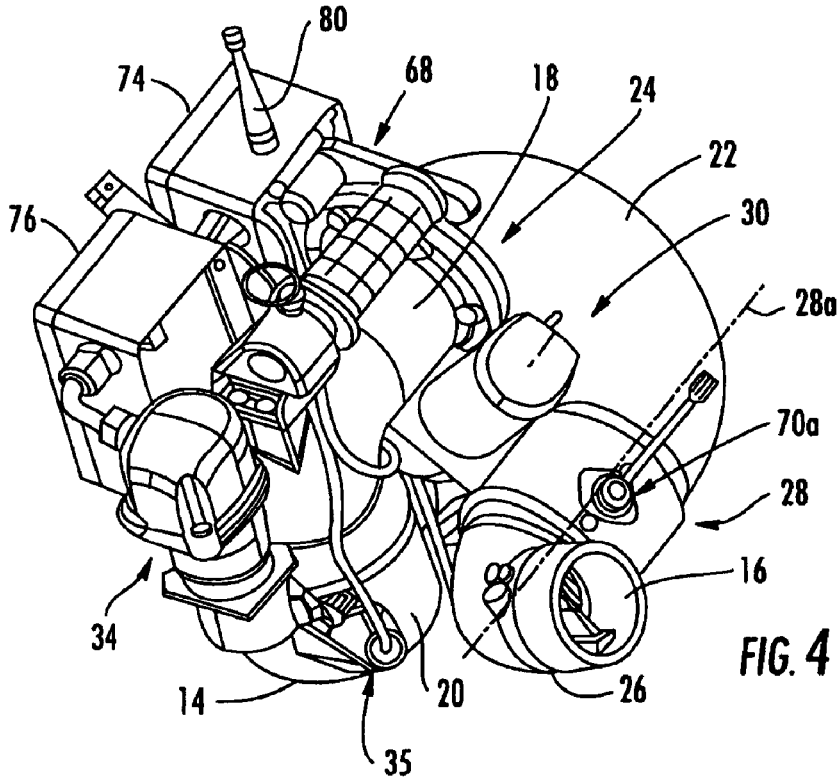
FIG. 4 is another perspective view of the monitor with the nozzle and nozzle coupler and base removed for clarity.
Figure 5:
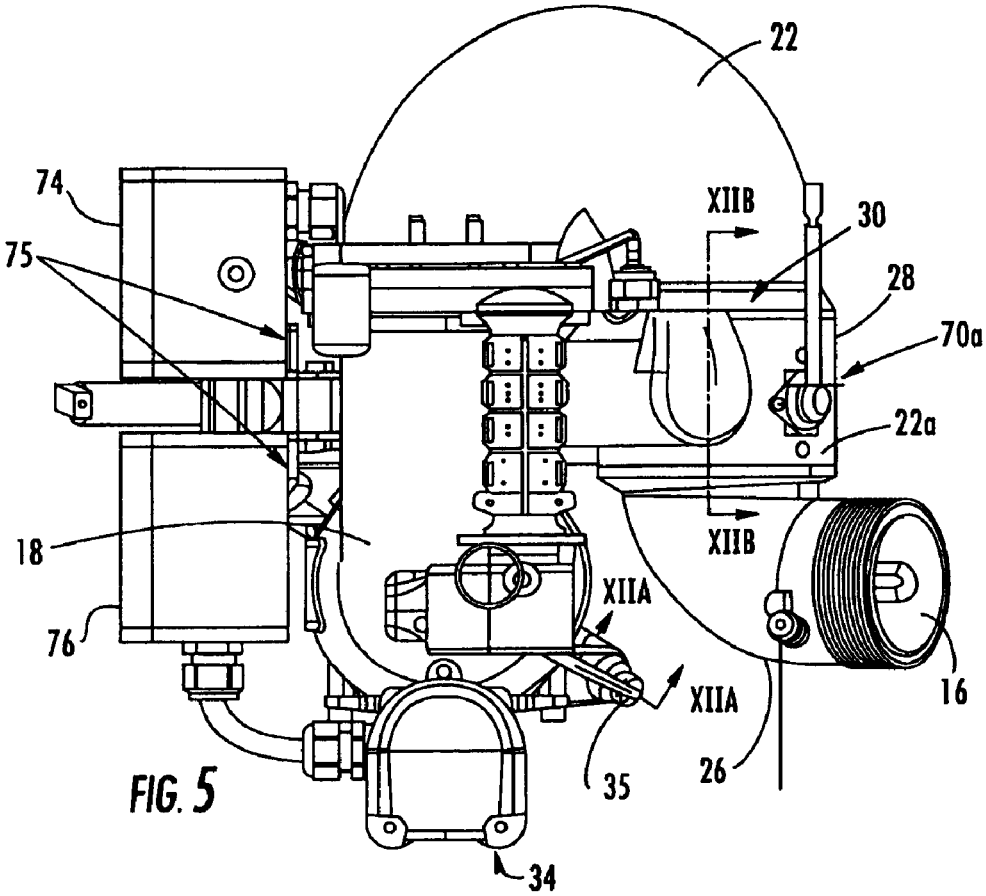
FIG. 5 is a plan view of the monitor of FIG. 4.
Figure 6:
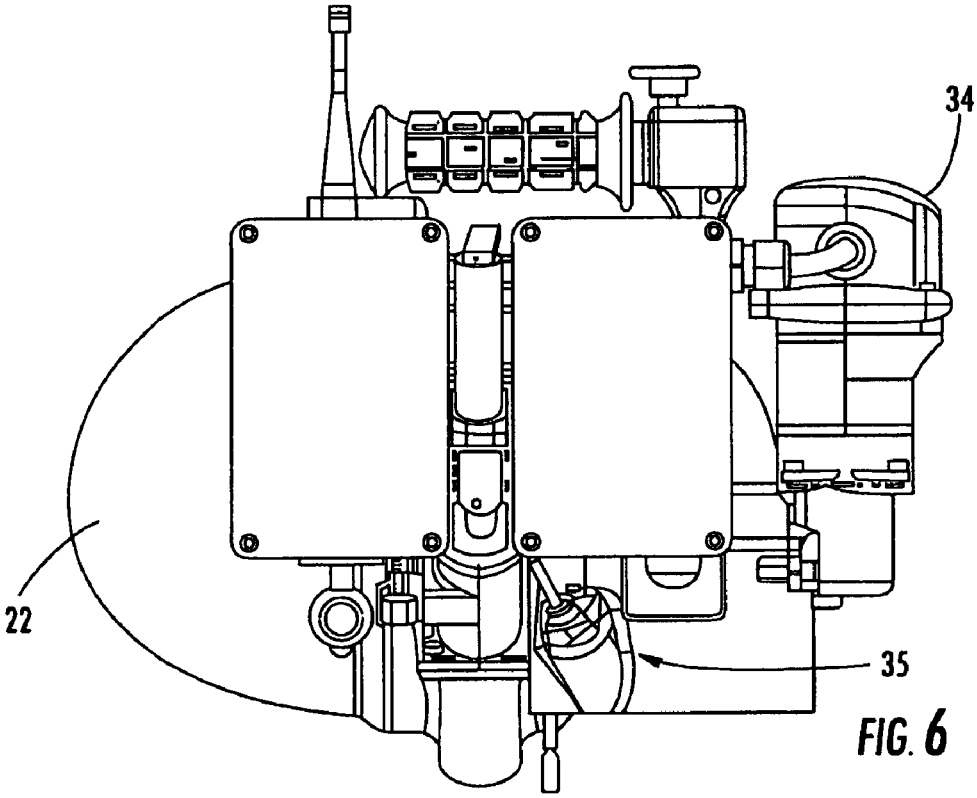
FIG. 6 is an elevation view of the monitor of FIG. 4.
Figure 7:
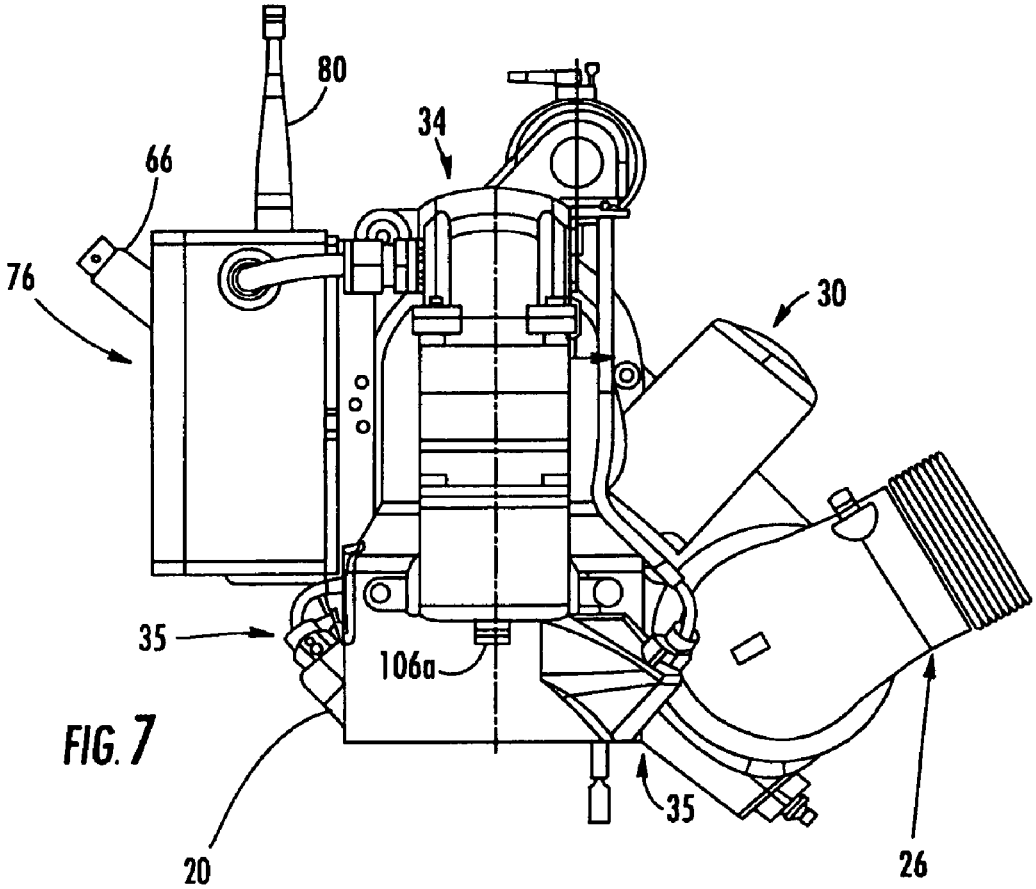
FIG. 7 is another elevation view of the monitor of FIG. 4.
Figure 8:
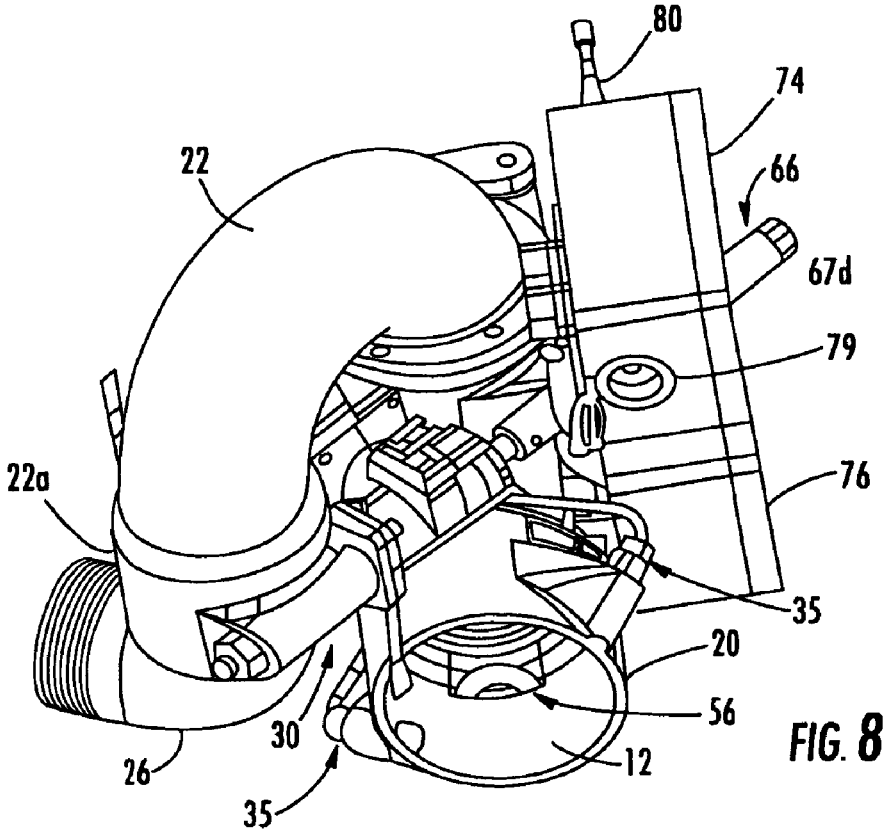
FIG. 8 is a bottom perspective view of inlet of the monitor showing the driver gear for engaging the base.
Figure 9:
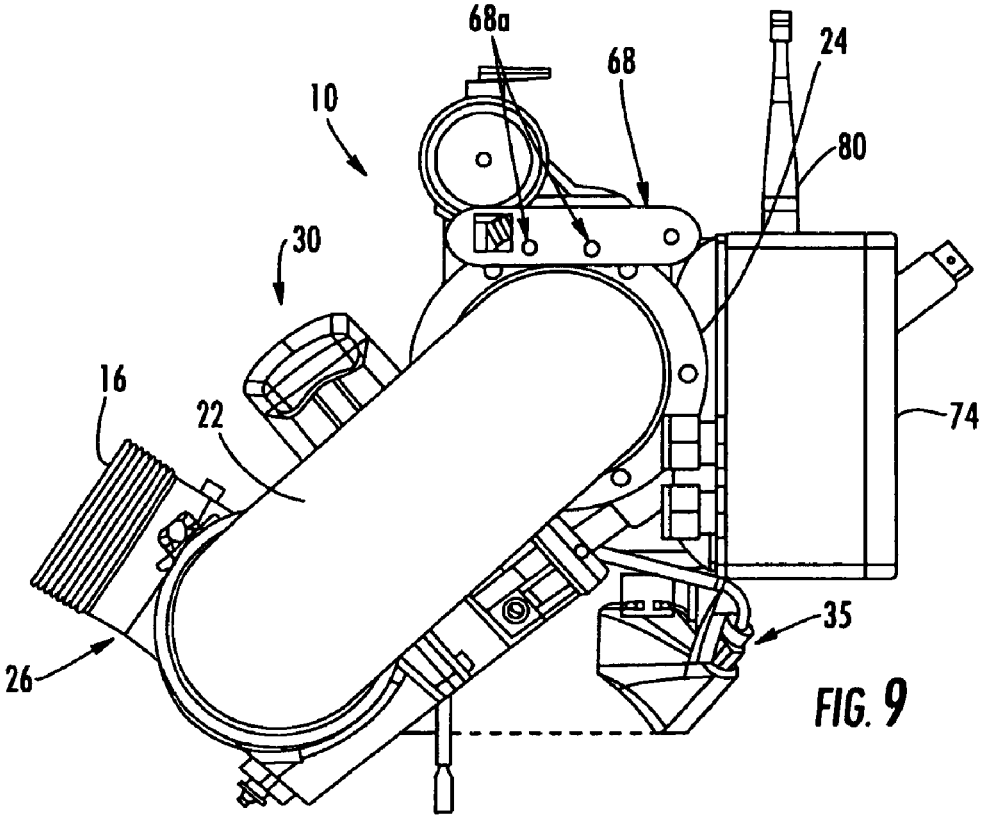
FIG. 9 is another elevation view of the monitor of FIG. 4.
Figure 10:
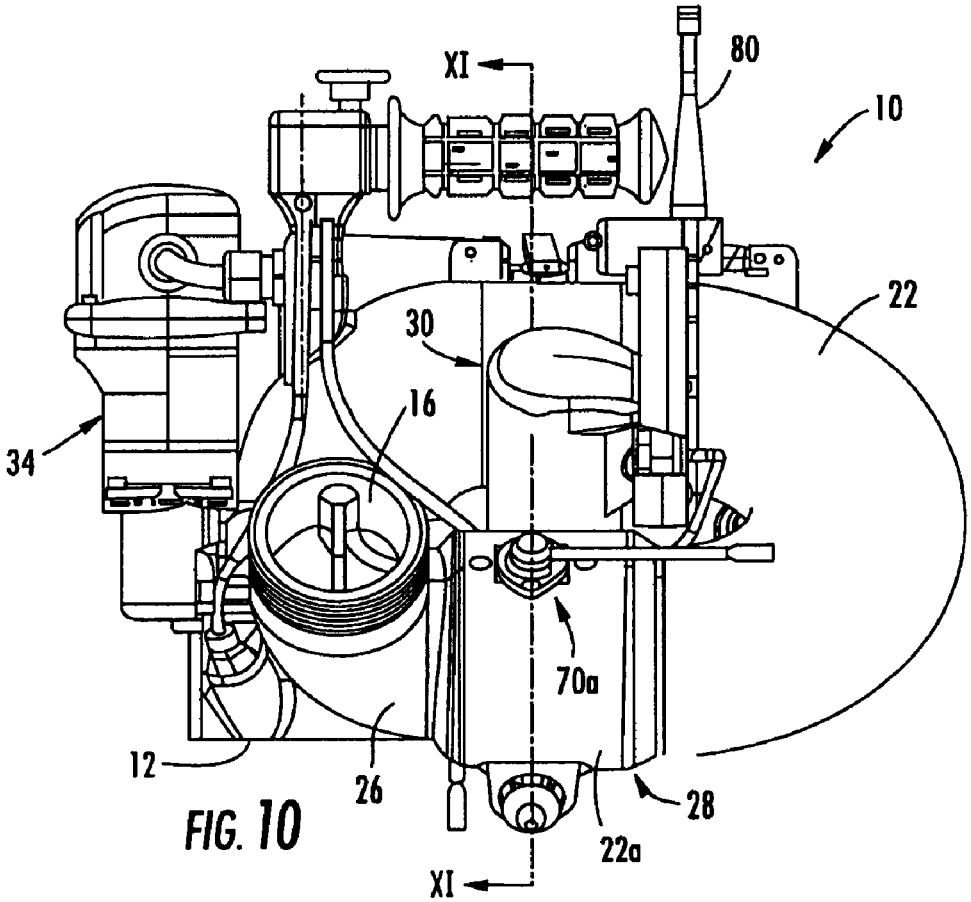
FIG. 10 is another elevation view of the monitor of FIG. 4.

As best seen in FIGS. 1 and 2, drive mechanism 34 is mounted to monitor 10 at collar 20 and, further, is mounted so that its drive gear 56 is aligned with opening 52 and with gear ring 44. Drive mechanism 34 also includes a motor 57

Figure 15:
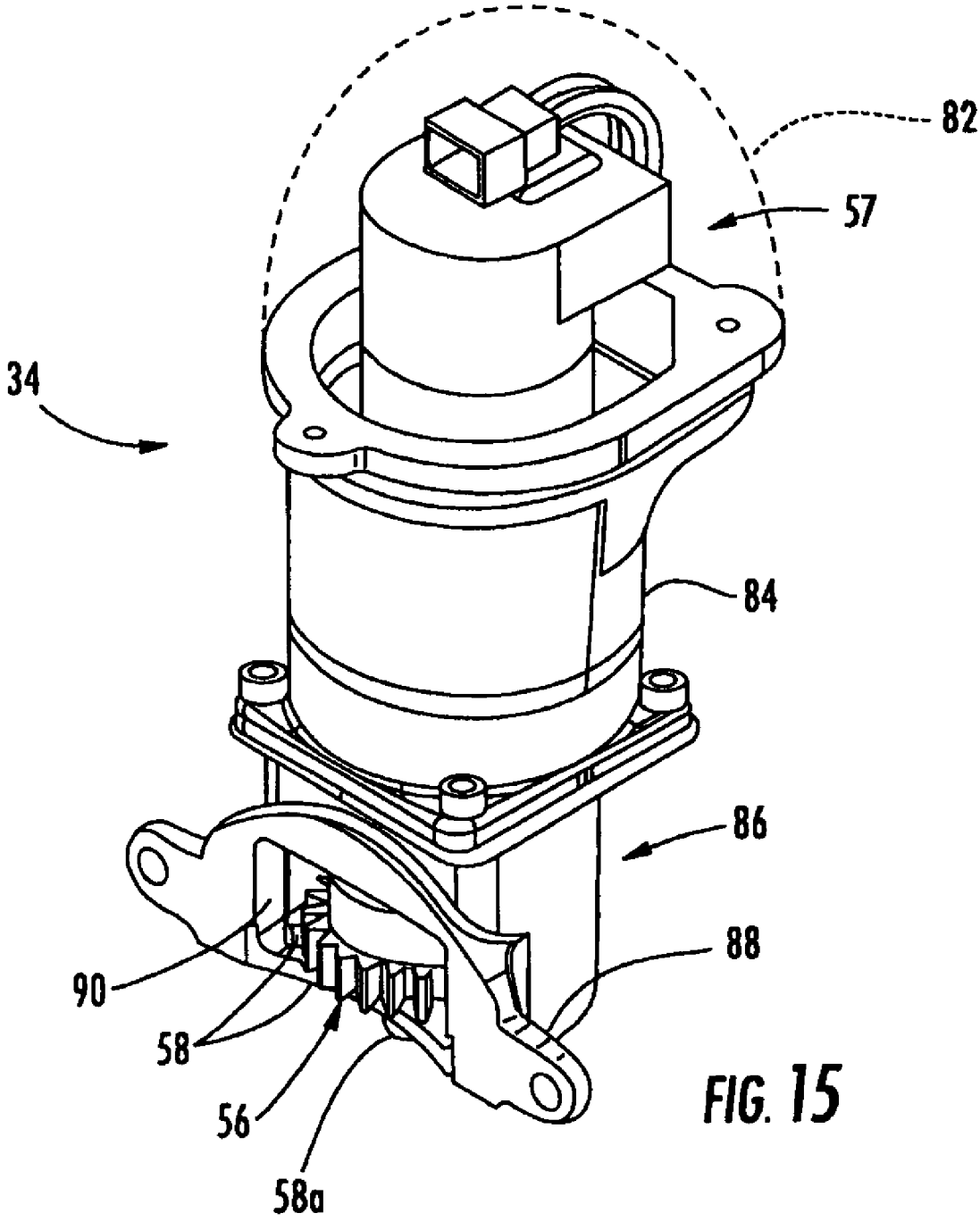
FIG. 15 is a perspective view of the drive mechanism of FIG. 4 removed from the monitor for clarity.

(FIG. 15) to drive gear 56, which will be more fully described below. Further, gear teeth 58 of drive gear 56 are also similarly aligned and generally parallel to vertical axis 32*a* and, further, include tapered or rounded ends 58*a* to facilitate the meshing of the two sets of gear teeth. In this manner, when mounting monitor 10 on base 14, gear teeth 58 will mesh with teeth 46 of gear ring 44 in a manner to permit removal of monitor 10 from base 14 by simply lifting the monitor off base after latch mechanisms 35, which are noted above, are disengaged from base 14.

Figure 11:
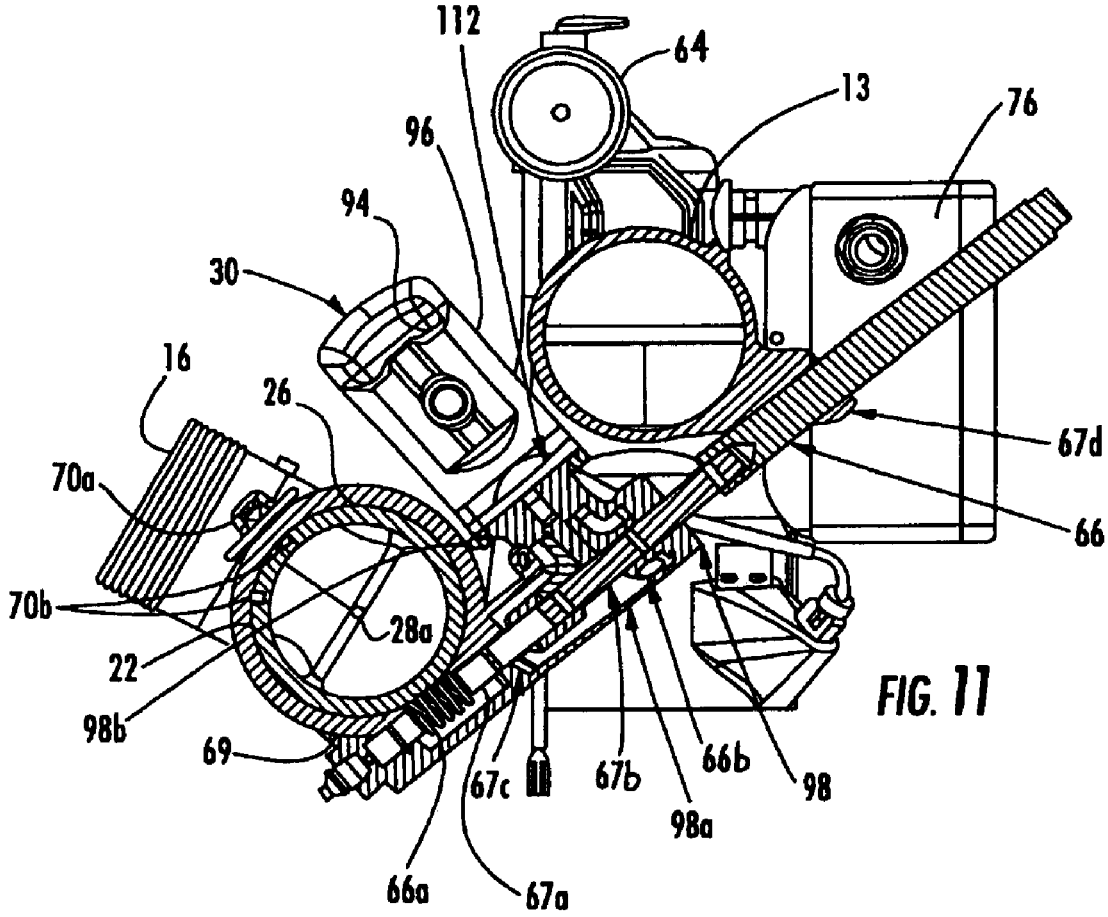
FIG. 11 is a cross-section taken along line XI—XI of FIG. 10.

Similarly, as noted, monitor 10 includes a second drive mechanism 30 for pivoting outlet 16 at pivot joint 28. Drive mechanism 30 is of similar construction to drive mechanism 34 and includes a drive gear 64 and a motor 65. In the illustrated embodiment, outlet 16 may also be manually rotated about pivot joint 28. Accordingly, as best seen in FIG. 11, monitor 10 includes a drive shaft 66 with a worm gear 66*a* and a handle 68 (FIGS. 1 and 2). Gear teeth 69 are provided or formed on pipe section 26 and are driven by worm gear 66*a* on shaft 66. In this manner, when shaft 66 is rotated, third pipe section 26 will rotate about horizontal axis 28*a*. Shaft 66 also includes a bevel gear 66*b* that is engaged and selectively driven by drive gear 64 of drive mechanism 30, which is also a bevel gear. In this manner, outlet 16 may be rotated about axis 28*a* either manually by rotation of handle 68 or remotely by drive mechanism 30.

In the illustrated embodiment, shaft 66 is assembled from several shaft sections—a first shaft section 67*a*, on which worm gear 66*a* is formed or provided, an intermediate shaft section 67*b*, which is coupled to shaft section 67*a* by a coupling 67*c*, and a terminal shaft section 67*d*, which projects from housing 11 and on which handle 68 is mounted. Handle 68 is preferably a detachable handle, which provides for a manual override over drive mechanism 30, as noted above, so that the position of outlet 16 may be manually adjusted by rotation of handle 68. Handle 68 preferably include a release mechanism, such as detent mechanism (not shown) to allow handle 68 to be removed from shaft section 67*d* to reduce the risk of injury when the shaft is driven by drive mechanism 30 and, further, to make the monitor more compact. In addition, handle 68 includes a set of mounting openings 68*a* for mounting handle 68 to, for example, housing 11, such as flange 24.

As previously noted, monitor 10 may include an adjustable nozzle 117 (FIG. 2). In which case, the shape of the stream from nozzle 117 may be adjusted by a nozzle actuator 130 (FIG. 2), such as the actuator available under part number 81185001 from Elkhart Brass Manufacturing Co., Inc. of Elkhart, Ind. Similar to drive mechanisms 30 and 34, actuator 130 is also preferably selectively remotely controlled by the control system so that the entire operation/control of monitor 10 can be achieved remotely, with the exception of the initial placement of the monitor at the scene.

Figure 20:
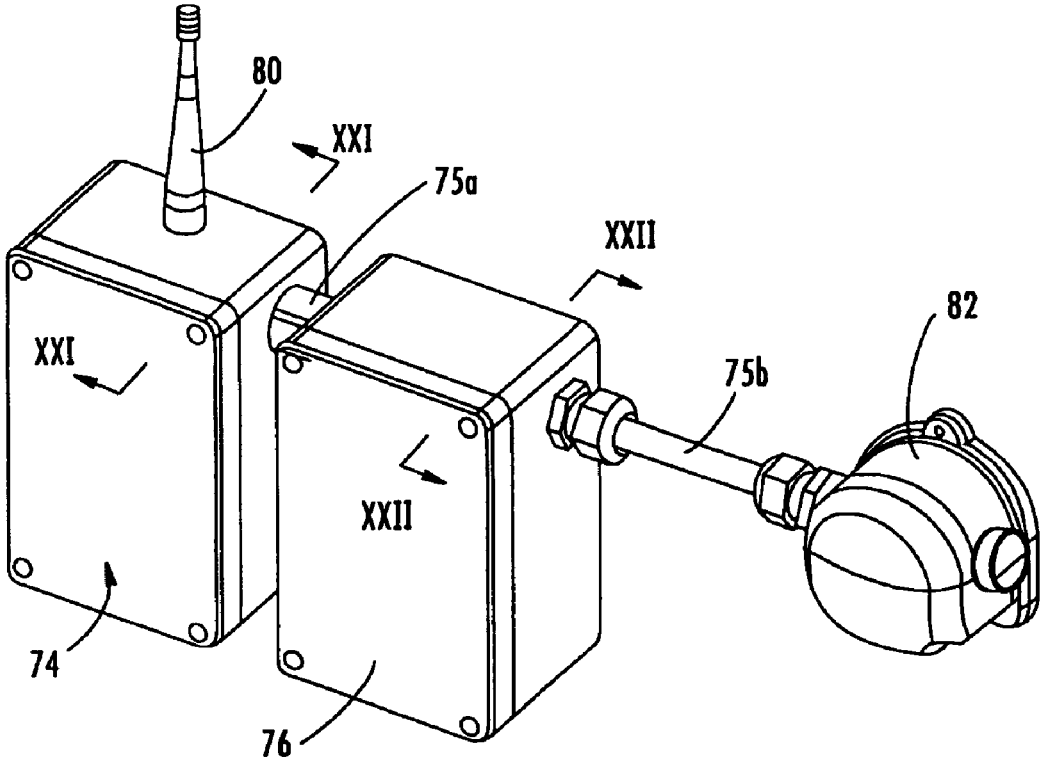
FIG. 20 is a perspective view of the housings and covers of control system.
Figure 21:
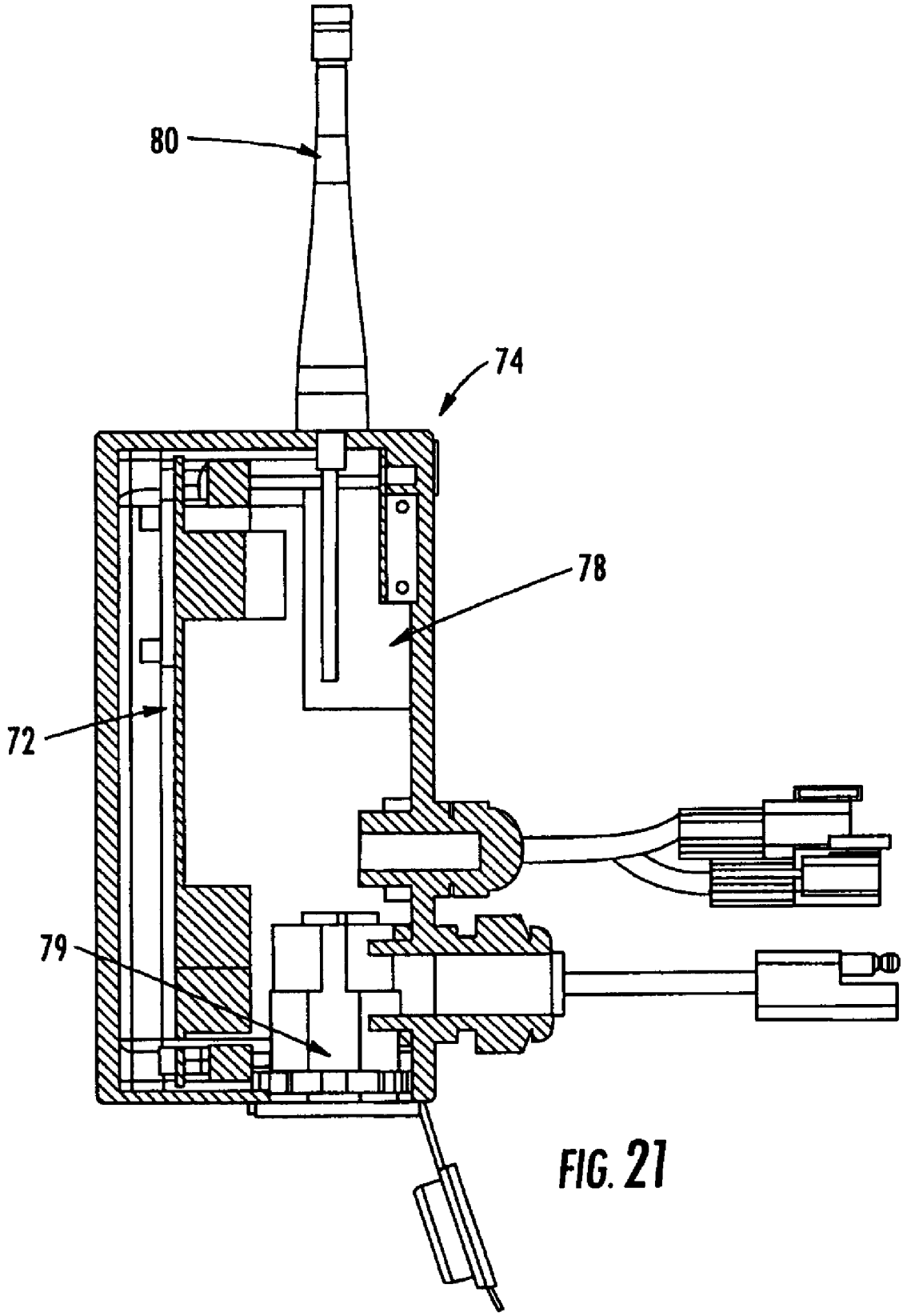
FIG. 21 is a cross-section taken along line XXI—XXI of FIG. 20.
Figure 22:
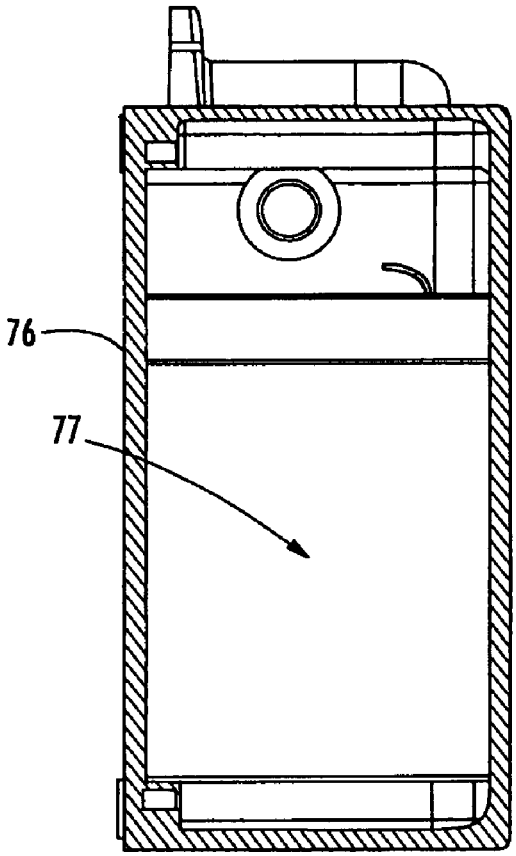
FIG. 22 is a cross-section taken along line XXII—XXII of FIG. 20.
Figure 26:
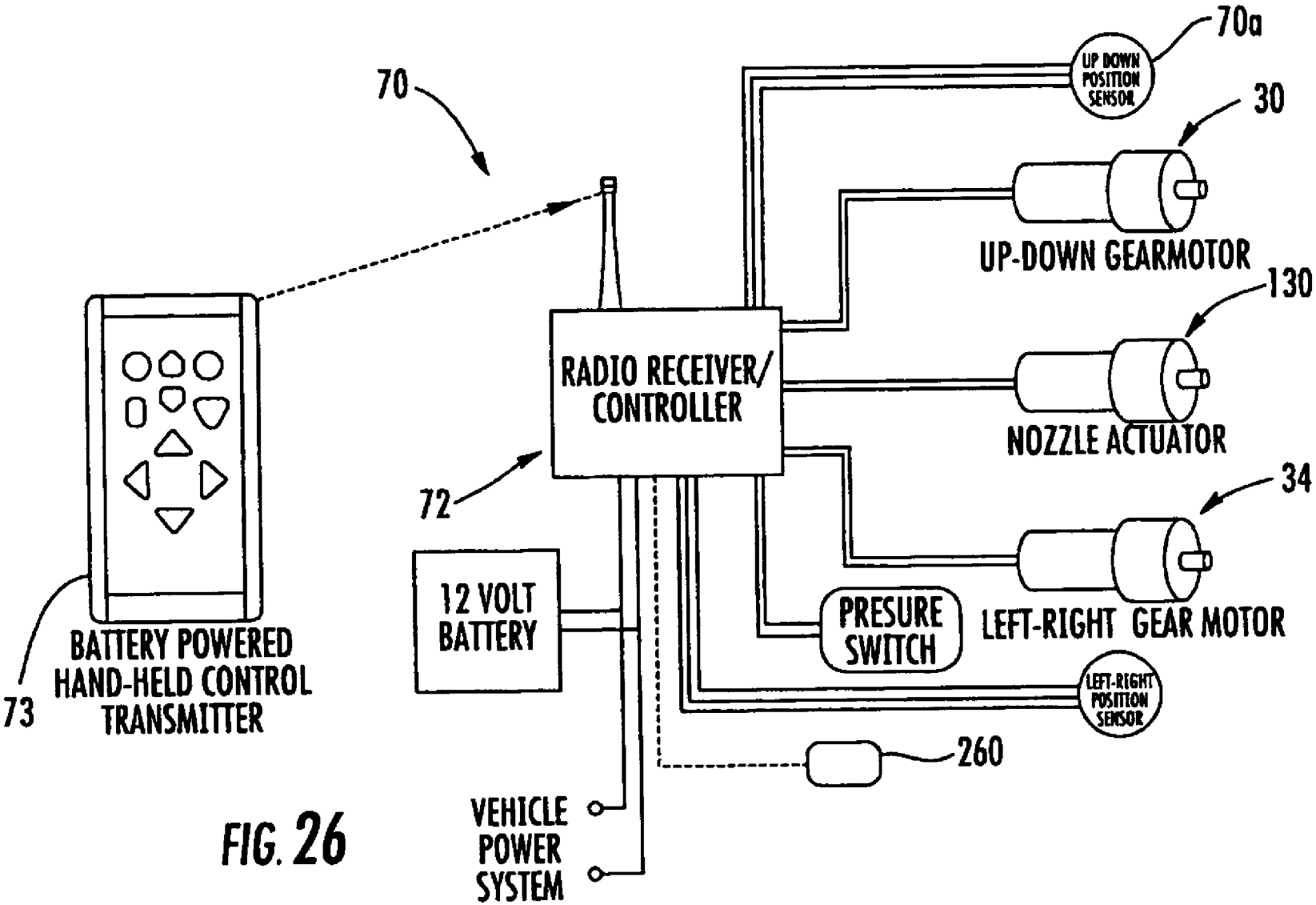
FIG. 26 is a schematic drawing of the control system of the monitor of the present invention.

In order to remotely control the motors of the respective drive mechanisms 34 and 30 and actuator 130, monitor 10 includes a control system 70 with a control module 72 and a remote control device 73 (FIG. 26). For further details of the remote control device 73, reference is made to application Ser. No. 10/405,372, filed Apr. 2, 2003, commonly owned by Elkhart Brass Manufacturing Co., Inc. of Elkhart, Ind. In the illustrated embodiment, control module 72 is located in a housing 74, which is mounted to monitor 10 by a bracket 75. As will be more fully described below, monitor 10 includes a second housing 76, which is also mounted to monitor 10 by a similar bracket 75, for housing a power source 77. Referring to FIG. 27B(1)–(4), control module 72 includes a microcontroller 71, such as a microprocessor, and a receiver, which is in communication with microcontroller 71 and is mounted to a circuit board 78 (FIG. 21), which in turn is mounted in housing 74. The receiver is coupled to an antenna 80, also mounted to housing 74, for receiving input signals from remote control device 73. In preferred form, remote control device 73 includes an RF transmitter for transmitting RF input signals to control module 72, which in turn generates drive signals based on the input signals for driving one or more of the drive mechanisms and/or the nozzle actuator. Drive signals from control module 72 to the respective motors are transmitted through wires or cables that extend from control module 72 to the respective drive mechanisms and actuator. As seen in FIG. 20, extending between housings 74 and 76 is a conduit 75*a*, which houses wiring or cabling that extends from housing 74 to housing 76. A second conduit 75*b* extends from housing 76 to cover 82 of drive mechanism 34 to house the wires or cables that power the drive mechanisms and actuator.

As noted above, housing 76 houses a power source 77, such as a battery, that powers control module 72 so that monitor 10 may be a stand alone unit. Optionally, the control module may be powered, or the power source may be rechargeable from, an external power source, such as the fire truck DC power system. Therefore, housing 74 (or housing 76) may include a port 79 for coupling to an external power source to power or recharge, for example the battery or batteries within the housing, or may provide an override so that the external power supply powers the control module. Alternately, the control module may be powered exclusively by an external power source.

In addition to actuating the drive mechanisms and actuator in response to a signal or signals from remote control device 73, control system 70 may be configured to detect when the nozzle has been moved to a preselected stop position or positions, for example, when the nozzle has been lowered to its lowest safe operating elevation or to its upper most safe operating elevation. To detect when the nozzle has reached one or more "stop positions", control system 70 may include a sensor 70*a*, such as a Hall effect sensor, which is mounted to pipe section 22 at joint 28, and one or more magnets 70*b* (FIG. 11) that are mounted to pipe section 26 at joint 28 at locations that correspond to the selected "stop positions". When the sensor detects the magnet, the sensor generates a signal, such as an RF signal or an electrical signal, that is transmitted to the receiver of control module 72, which is configured to prevent further movement of the pipe section 26, and hence the nozzle, about joint 28, when control module 72 receives a signal corresponding to a "stop position". Optionally, control system 70 may include an override device, such as a button, which can be actuated to override the "stop position".

Similarly, control system 70 may include a sensor to detect the "left-right" position of the monitor about the base. For example, the sensor may comprise an encoder provided in the motor of drive mechanism 34, which generates a signal indicative of the position of the monitor. The encoder, therefore, may be used by control system 70 to set the horizontal position of the monitor and, further, configured to move the monitor to one or more preset positions in response to input signals from a remote transmitter such as remote transmitter 23 or another remote transmitter.

As best seen in FIGS. 1, 2, and 15–17, drive mechanism 34 includes a housing 80. Housing 80 may comprise a monolithic housing or may be assembled, such as shown from more than one component. In the illustrated embodiment, housing 80 includes a first or upper housing portion

82, which forms a motor cover, a second or intermediate housing portion 84, and a third or lower housing portion 86, which are joined by flange connections. As seen in FIG. 20, motor cover 82 may be connected to and assembled with housings 74 and 76. Lower housing portion 86 includes a mounting flange 88 for mounting drive mechanism 34 to monitor 10 and is formed about an opening 90 in housing portion 86 to allow drive gear 56 to project through the opening and mesh with the gear on gear ring 44, as previously described.

Drive mechanism 30 similarly includes a housing 94 assembled from an upper housing portion 96 and a shared lower housing portion 98, which are joined by a flange connection. Lower housing portion 98 comprises T-shaped housing, with shaft 66 extending through the straight cylindrical section 98*a* of lower housing portion 98. Gear 64 of driver 62 extends through the intersecting cylindrical section 98*b* of lower housing portion 98 to thereby engage gear 66*b* on shaft 66.

Figure 15A:
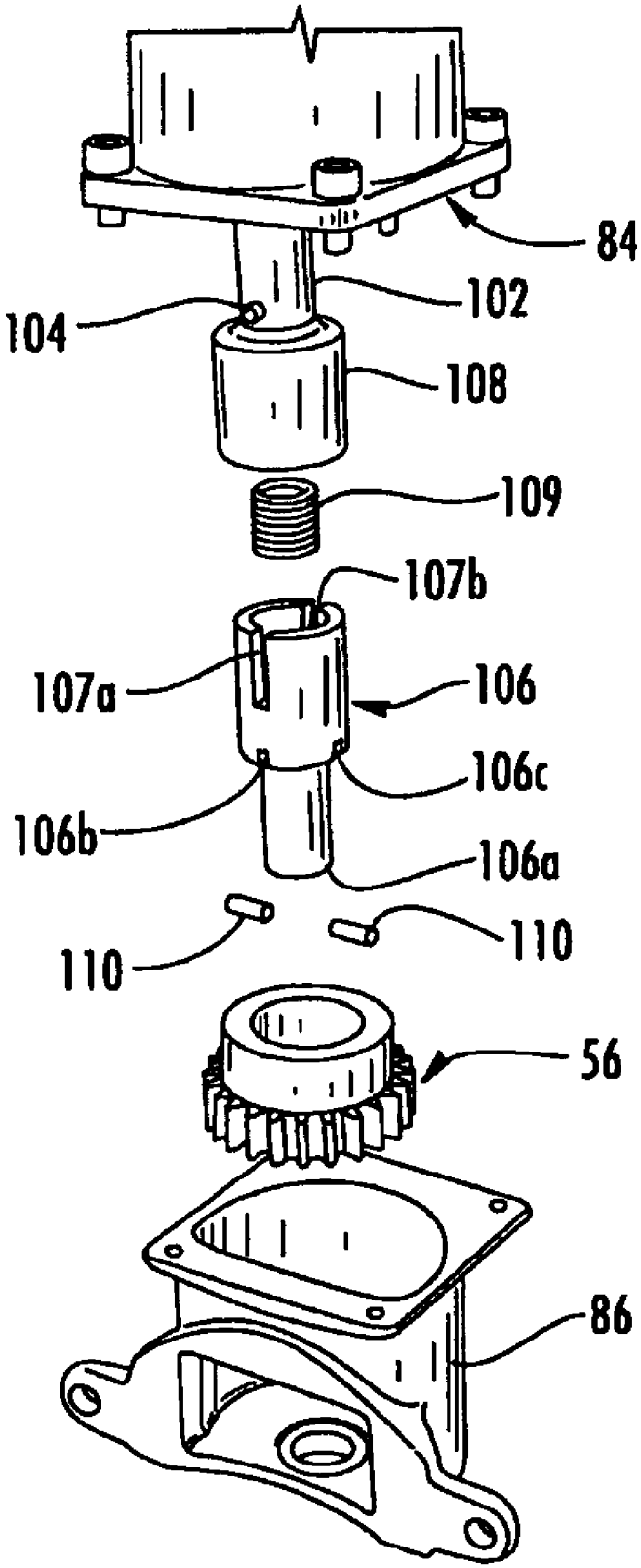
FIG. 15A is a fragmentary exploded perspective view of the drive mechanism of FIG. 15.
Figure 16:
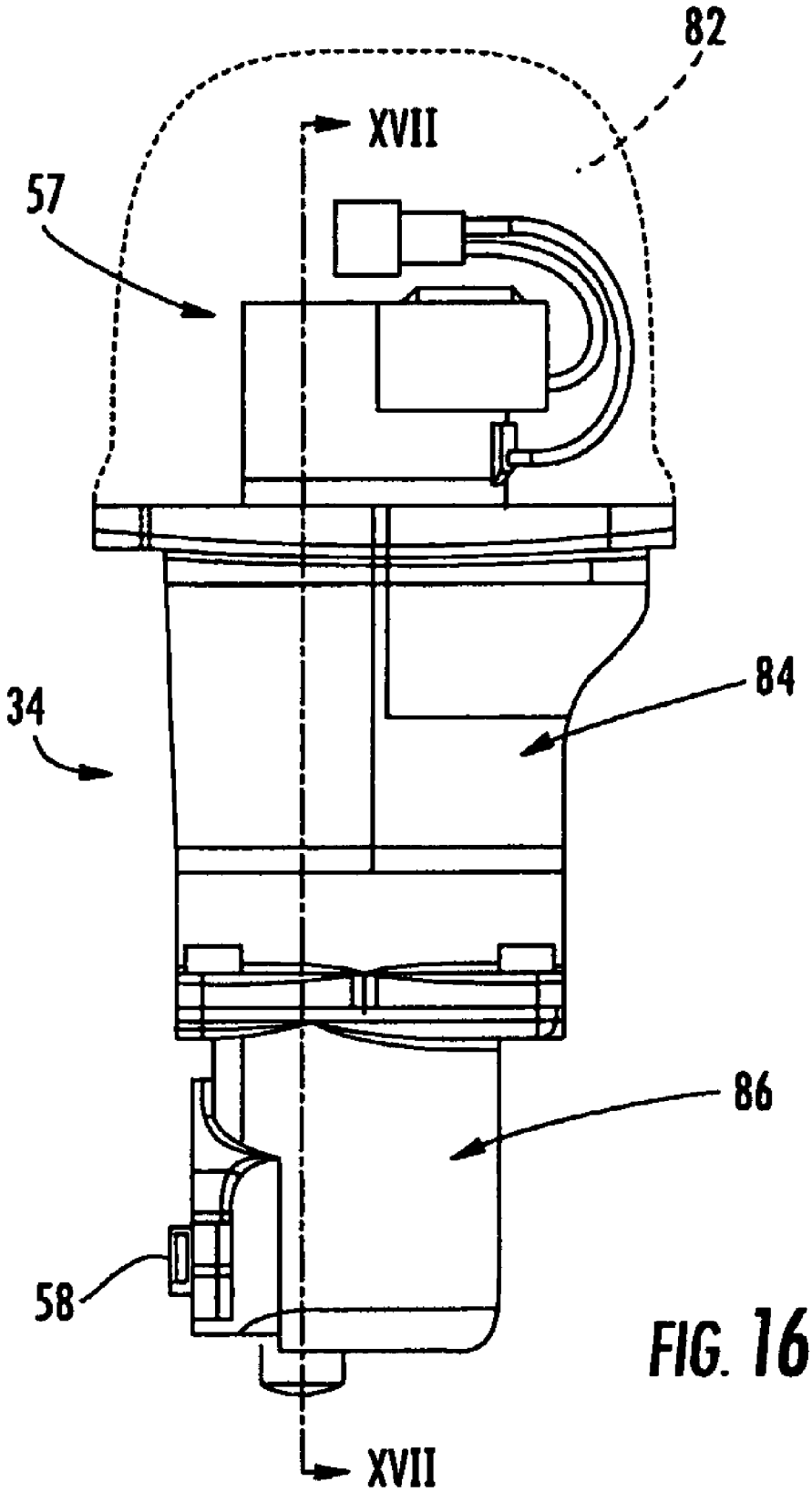
FIG. 16 is an elevation view of the drive mechanism of FIG. 15.
Figure 17:
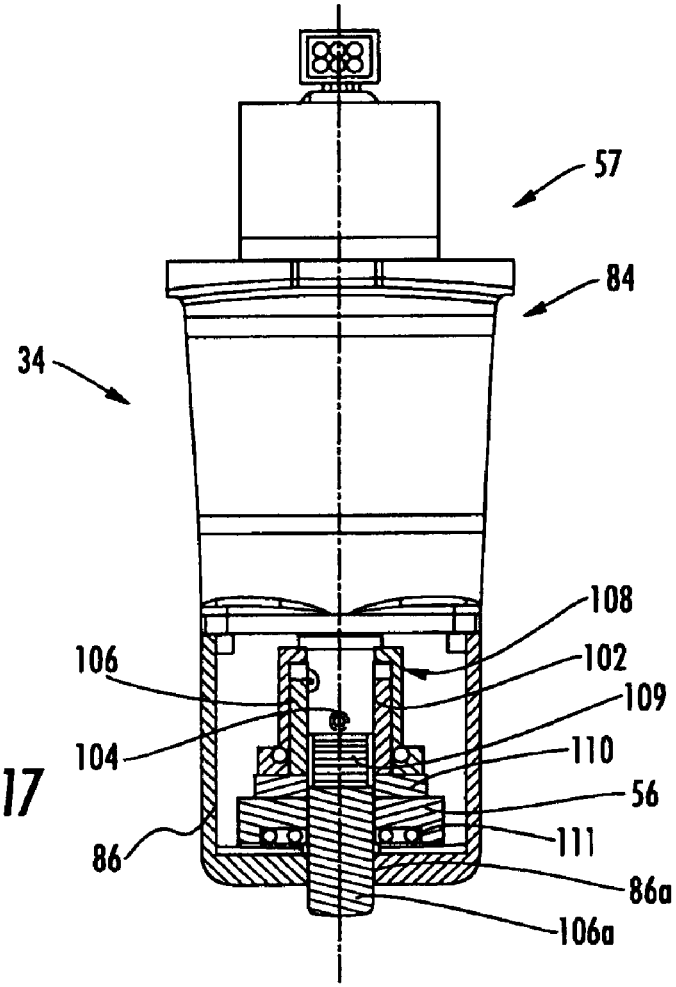
FIG. 17 is a cross-section taken along line XVII—XVII of FIG. 16.
Figure 18:
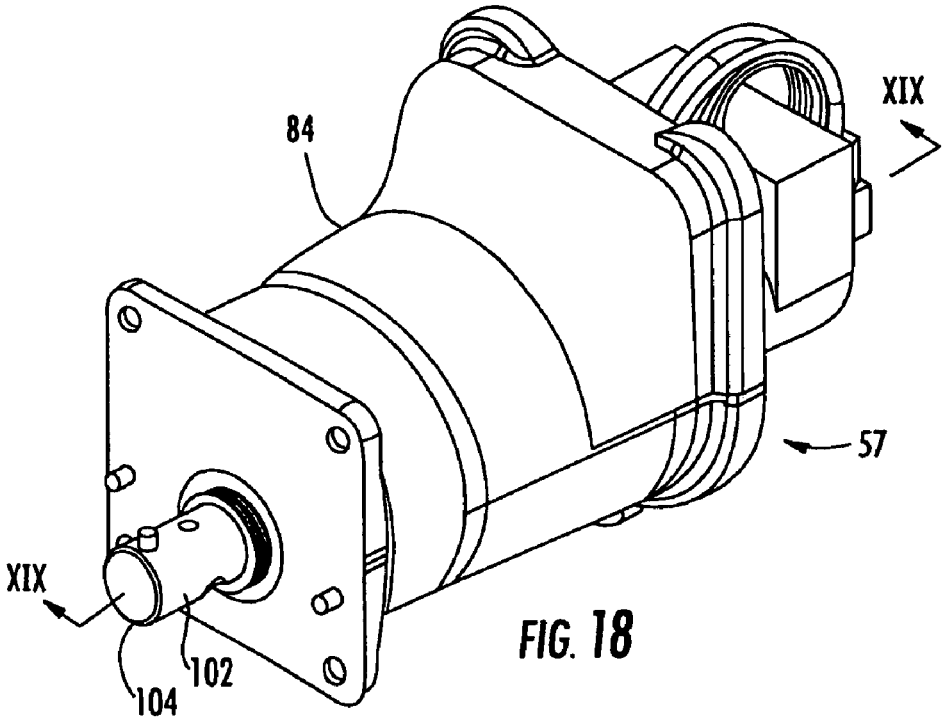
FIG. 18 is an enlarged bottom perspective of the motor assembly of the drive mechanism.
Figure 19:
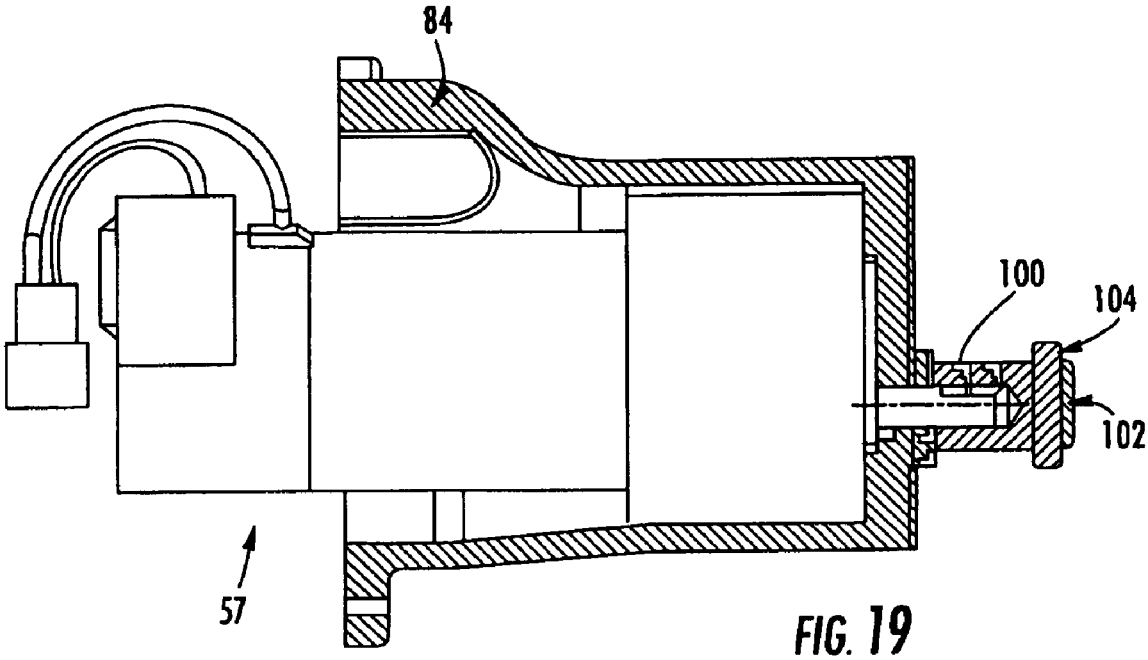
FIG. 19 is a cross-section taken alone line XIX—XIX of FIG. 18.

Referring to FIG. 19, the motors of drive mechanisms 30, 34 each includes a shaft 100, which couples to the respective drive gear. In reference to FIGS. 17 and 19 and to drive mechanism 34, a female coupler 102 is mounted to shaft 100 by a set screw and includes a pin 104 for coupling coupler 102 to a pinion shaft 106. Pin 104 is received in a pair of slotted openings 107*a* and 107*b* formed in pinion shaft 106. Mounted about pinion shaft 106 and coupler 102 is a spacer sleeve 108. Positioned between the end of coupler 102 and pinion shaft 106, in the upper annular portion of shaft 106, is a spring 109, which urges the distal end 106*a* of shaft 106 outwardly from lower housing 86 through opening 86*a* to provide a drive release mechanism described below. Gear 56, such as a pinion gear, is driven by shaft 106 by pins 110 which engage slots 106*b*, 106*c* located in shaft 106. In this manner, when end 106*a* of pinion shaft 106 is pushed upwardly as viewed in FIG. 15A, pins 110 will be disengaged from slots 106*b* and 106*c* so that gear 56 is decoupled from the motor. This decoupling then allows monitor 10 to be rotated manually about base 14.

Referring to FIG. 11, in reference to drive mechanism 30, shaft 100 of motor 65 includes an adapter 112 mounted to shaft 100, similarly by a set screw or pin, on which drive gear 64 is mounted. In addition, mounted about adapter 112 is a bushing 114.

As previously noted, monitor 10 may be mounted to a portable base 214. Referring to FIGS. 23–25, base 214 includes a housing 211 with a Y-shaped pipe section 220, which forms two inlets 212*a* and 212*b*, and a 90° elbow pipe section 222, which provides a single outlet 216. Positioned in Y-shaped pipe section is a clapper 224, which is mounted to housing 211 by a pin/bolt 226, which allows clapper 224 to move to block one of the inlets, when only one inlet is being used, or positioned between the inlets when both inlets are coupled to water hoses. Sections 220 and 222 are interconnected by, for example welding or a threaded connection.

Base 214, similar to base 14, includes a swivel base 243 and a gear ring 244. For further details of swivel base 243 and gear ring 244 reference is made to the previous embodiment. However, in the illustrated embodiment, ring gear 244 includes gear teeth 246 over a limited portion of its outer circumference, for example over a 90° portion of its outer circumference, to thereby limit the rotation of monitor 10 about base 214. In addition, base 214 is supported by a support assembly 250, which includes a plurality of foldable legs 252, 254, 256, and 258 to provide a portable, but compact assembly. For further details of support 250, reference is made to U.S. patent application Ser. No. 10/962,271, filed Oct. 8, 2004, entitled FIRE-FIGHTING MONITOR, which is incorporated herein by reference in its entirety.

As described in reference to the previous embodiment, the gear teeth of the ring gear are preferably aligned along and parallel to the vertical axis so that monitor 10 can be disengaged from the base by simply lifting the monitor along the vertical axis. Further, the teeth of ring gear 246 are also preferably rounded or tapered at their upper ends to facilitate alignment with the gear of drive mechanism 34. As would be understood, monitor 10 can be easily interchanged between base 14 and base 214 by simply releasing the latch mechanism and lifting the monitor off the respective base.

In this application, control system 70 may be adapted to detect the sliding of monitor 10. For example, control system 70 may include a sensor 260 that detects movement of monitor 10 in a direction opposite the direction of water flow. For example, sensor 260, such as a motion sensor, may be mounted to monitor 10, for example, in housing 74. Further, the sensor may be mounted to circuit board 78. In addition, control system 70 may be configured to actuate driver mechanism 30 to lift the nozzle in response to sensor 260 detecting translational movement of the monitor.

While several forms of the invention have been shown and described, other forms will now be apparent to those skilled in the art. As would be understood, in order to minimize water infusion into the components comprising the control system, the components preferably include seals, for example o-rings, at their respective interfaces. For example, each motor housing portion includes an o-ring seal at its interface with the lower housing portion. Similarly, the conduit connections to the housing also incorporate seals. Port 79 similarly incorporates a sealing cap or cover.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A fire-fighting monitor for directing the flow of fluid from a fluid source, said monitor comprising:

a base being adapted to be in fluid communication with a fluid source;

a monitor housing having an inlet and an outlet, said inlet releasably mounted on said base and for receiving fluid through said base, said outlet in fluid communication with said inlet for discharging fluid from said housing;

a rotatable connection (1) between said inlet and said base, wherein said inlet is rotatable about said base about a first axis or (2) at said outlet wherein said outlet is rotatable about a second axis;

a drive mechanism associated with said rotatable connection for (1) rotating said inlet about said base about said first axis or (2) rotating said outlet about said second axis; and a control system for selectively actuating said drive mechanism, said control system including a receiver for receiving an input signal from a transmitter remote from said monitor, said control system actuating said drive mechanism in response to said receiver receiving an input signal and being capable of causing said inlet or said outlet to rotate back and forth in oscillation between predetermined positions established by said control system.

2. A fire-fighting monitor for directing the flow of fluid from a fluid source, said monitor comprising:

a base being adapted to be in fluid communication with a fluid source, said base comprising a base chosen from a fixed base and a portable base;

a monitor housing having an inlet and an outlet, said inlet releasably mounted on said base and for receiving fluid through said base, said outlet in fluid communication with said inlet for discharging fluid from said housing;

a rotatable connection between said inlet and said base, said inlet being rotatable about said base at said rotatable connection about a first axis;

a drive mechanism associated with said rotatable connection for rotating said inlet about said base at said rotatable connection;

a control system for selectively actuating said drive mechanism, said control system including a receiver for receiving an input signal from a transmitter remote from said monitor, said control system actuating said drive mechanism in response to said receiver receiving an input signal; and wherein said housing comprises a latch mechanism for releasably engaging said base.

3. The fire-fighting monitor according to claim 1, wherein said drive mechanism is mounted to said housing and includes a motor and a drive gear, said motor selectively driving said drive gear to selectively rotate (1) said inlet or (2) said outlet in response to said control system when said receiver receives an input signal.

4. A fire-fighting monitor for directing the flow of fluid from a fluid source, said monitor comprising:

a base being adapted to be in fluid communication with a fluid source;

a monitor housing having an inlet and an outlet, said inlet releasably mounted on said base and for receiving fluid through said base, said outlet in fluid communication with said inlet for discharging fluid from said housing;

a rotatable connection between said inlet and said base, said inlet being rotatable about said base at said rotatable connection about a first axis;

a drive mechanism associated with said rotatable connection for rotating said inlet about said base at said rotatable connection;

a control system for selectively actuating said drive mechanism, said control system including a receiver for receiving an input signal from a transmitter remote from said monitor, said control system actuating said drive mechanism in response to said receiver receiving said input signal;

wherein said drive mechanism is mounted to said housing and includes a motor and a drive gear, said base including a driven gear engaged by said drive gear, said motor selectively driving said drive gear to selectively drive said driven gear in response to said control system when said receiver receives said input signal; and wherein said drive gear and said driven gear each have a plurality of gear teeth, said gear teeth of said drive gear and said driven gear meshing in a manner to allow said drive gear to drive said driven gear but also to allow said gear teeth of said drive gear to be separated from said gear teeth of said driven gear when said housing is lifted along said first axis.

5. The fire-fighting monitor according to claim 4, wherein said drive gear and said driven gear each have a plurality of gear teeth, said gear teeth of said gears being aligned along said firs axis wherein said drive gear and said driven gear may be disengaged when said housing is lifted along said first axis.

6. The fire-fighting monitor according to claim 5, wherein each of said gear teeth has first and second ends and a longitudinal extent extending between said opposed ends and along said first axis, said first ends or said second ends of said gear teeth of one of said gears being rounded or tapered to facilitate alignment with the gear teeth of the other of said gears.

7. The fire-fighting monitor according to claim 6, wherein said first ends or said second ends of said gear teeth of both of said gears are rounded or tapered to facilitate alignment of said gear teeth of said gears.

8. The fire-fighting monitor according to claim 3, wherein said drive gear comprises a pinion gear.

9. The fire-fighting monitor according to claim 8, wherein said driven gear comprises a ring gear, with gear teeth over the full circumference of said ring gear.

10. The fire-fighting monitor according to claim 1, wherein said housing has a second drive mechanism and a second rotatable connection wherein said outlet is rotatable at said second connection about a second axis, said second drive mechanism selectively rotating said outlet at said second rotatable connection, and said control system for selectively actuating one of said drive mechanisms in response to said receiver receiving an input signal.

11. The fire-fighting monitor according to claim 1, wherein said drive mechanism is configured to allow said inlet to be selectively manually rotated about said base.

12. A fire-fighting monitor for directing the flow of fluid from a fluid source, said monitor comprising:

a base being adapted to be in fluid communication with a fluid source;

a monitor housing having an inlet and an outlet, said inlet releasably mounted on said base and for receiving fluid through said base, said outlet in fluid communication with said inlet for discharging fluid from said housing;

a rotatable connection between said inlet and said base, said inlet being rotatable about said base at said rotatable connection about a first axis;

a drive mechanism associated with said rotatable connection for rotating said inlet about said base at said rotatable connection;

a control system for selectively actuating said drive mechanism, said control system including a receiver for receiving an input signal from a transmitter remote from said monitor, said control system actuating said drive mechanism in response to said receiver receiving, said input signal;

wherein said drive mechanism is mounted to said housing and includes a motor and a drive gear, said base including a driven gear engaged by said drive gear, said motor selectively driving said drive gear to selectively drive said driven gear in response to said control system when said receiver receives said input signal; and wherein said motor includes a drive shaft, said drive gear being releasably coupled to said drive shaft, said drive gear being decoupled from said motor when no longer coupled to said drive shaft wherein said inlet is manually rotatable about said base when said drive gear is decoupled from said motor.

13. A fire-fighting monitor for directing the flow of fluid from a fluid source, said monitor comprising:

a base being adapted to be in fluid communication with a fluid source;

a monitor housing having an inlet and an outlet, said housing further including, a latch mechanism for releasably mounting said inlet on said base for receiving fluid through said base, said outlet in fluid communication with said inlet for discharging fluid from said housing;

said housing having a rotatable connection wherein said outlet is rotatable at said connection about an axis;

a drive mechanism associated with said rotatable connection for rotating said outlet at said rotatable connection; and a control system for selectively actuating said drive mechanism, said control system including a receiver for receiving an input signal from a transmitter remote from said monitor, said control system actuating said drive mechanism in response to said receiver receiving an input signal.

14. The fire-fighting monitor according to claim 13, wherein said drive mechanism includes a motor and a drive shaft, said drive shaft including a drive gear, said housing including a first pipe section and an outlet pipe section, said outlet pipe section rotatable about said first pipe section at said rotatable connection, said outlet pipe section forming said outlet and having a driven gear selectively driven by said drive gear.

15. The fire-fighting monitor according to claim 14, wherein said drive mechanism further includes a motor gear for selectively driving said drive shaft wherein said drive shaft drives said driven gear on said outlet pipe section when said drive shaft is driven by said motor gear.

16. The fire-fighting monitor according to claim 15, wherein said drive shaft further includes a handle for manually driving said driven gear.

17. The fire-fighting monitor according to claim 16, wherein said handle is removable from said drive shaft.

18. The fire-fighting monitor according to claim 16, wherein said motor gear comprises a bevel drive gear, said shaft having a bevel driven gear selectively driven by said bevel drive gear to thereby drive said drive shaft.

19. The fire-fighting monitor according to claim 18, further comprising a second rotatable connection between said inlet and said base and a second drive mechanism for selectively rotating said inlet about said base at said second connection about a second axis, said control system selectively driving at least one of said drive mechanisms in response to said receiver receiving a input signal from the remote transmitter.

20. The fire-fighting monitor according to claim 19, wherein said second drive mechanism is configured to allow said input to be selectively, manually rotated about said base.

21. A fire-fighting monitor for directing the flow of fluid from a fluid source, said monitor comprising:

a base being adapted to be in fluid communication with a fluid source;

a monitor housing having an inlet and an outlet, said inlet releasably mounted on said base and for receiving fluid through said base, said outlet in fluid communication with said inlet for discharging fluid from said housing;

said housing having a rotatable connection wherein said outlet is rotatable at said connection about an axis;

a drive mechanism associated with said rotatable connection for rotating said outlet at said rotatable connection, said drive mechanism including a motor and a drive shaft, said drive shaft including a drive gear, said housing including a first pipe section and an outlet pipe section, said outlet pipe section rotatable about said first pipe section at said rotatable connection, said outlet pipe section forming said outlet and having a driven gear selectively driven by said drive gear, said drive mechanism further including a motor gear for selectively driving said drive shaft wherein said drive shaft drives said driven gear on said outlet pipe section when said drive shaft is driven by said motor gear; and wherein said drive shaft further includes a handle for manually driving said driven gear;

wherein said motor gear comprises a bevel drive gear, said shaft having a bevel driven gear selectively driven by said bevel drive gear to thereby drive said drive shaft;

a control system including a receiver for receiving an input signal from a transmitter remote from said monitor;

a second rotatable connection between said inlet and said base and a second drive mechanism for selectively rotating said inlet about said base at said second connection about a second axis, said control system selectively driving at least one of said drive mechanisms in response to said receiver receiving said input signal from the remote transmitter; and wherein said second drive mechanism includes a drive gear, said base having a driven gear, each gear at said second rotatable connection having a plurality of gear teeth, said gear teeth meshing in a manner to allow said gears at said second rotatable connection to be disengaged when said housing is lifted off said base along said second axis.

22. The fire-fighting monitor according to claim 21, wherein said drive gear of said second drive mechanism comprises a pinion gear.

23. The fire-fighting monitor according to claim 22, wherein said driven gear on said base comprises a ring gear, said ring gear having gear teeth over the full circumference of said ring gear.

24. A fire-fighting monitor for directing the flow of fluid from a fluid source, said monitor comprising:

a base being adapted to be in fluid communication with a fluid source;

a monitor housing having an inlet and an outlet said inlet mounting on said base and for receiving fluid through said base, said outlet in fluid communication with said inlet for discharging fluid from said housing;

a first rotatable connection between said inlet and said base, said inlet being rotatable about said base at said first rotatable connection about a first axis;

said housing having a second rotatable connection wherein said outlet is rotatable at said second connection about a second axis;

a first motorized drive mechanism at said first rotatable connection for rotating said inlet at said first rotatable connection about said base, and said first motorized drive mechanism capable of rotating said inlet about said base over an infinite arc wherein said inlet can rotate 360° about said base;

a second drive mechanism associated with said second rotatable connection for rotating said outlet at said second rotatable connection; and a control system for selectively actuating said drive mechanisms, said control system including a receiver for receiving an input signal from a transmitter remote from said monitor, said control system actuating at least one of said drive mechanisms in response to said receiver receiving an input signal.

25. The fire-fighting monitor according to claim 24, wherein said monitor includes said base.

26. The fire-fighting monitor according to claim 24, wherein said base comprises a portable base.

27. The fire-fighting monitor according to claim 24, wherein said base comprises a fixed base.

28. A fire-fighting monitor for directing the flow of fluid from a fluid source, said monitor comprising:

a base being adapted to be in fluid communication with a fluid source;

a monitor housing having an inlet and an outlet, said inlet mounting on said base and for receiving fluid through said base, said outlet in fluid communication with said inlet for discharging fluid from said housing;

a first rotatable connection between said inlet and said base, said inlet being rotatable about said base at said first rotatable connection about a first axis;

said housing having a second rotatable connection wherein said outlet is rotatable at said second connection about a second axis;

a first drive mechanism associated with said first rotatable connection for rotating said inlet at said first rotatable connection about said base;

a second drive mechanism associated with said second rotatable connection for rotating said outlet at said second rotatable connection; and a control system for selectively actuating said drive mechanisms, said control System including a receiver for receiving an input signal from a transmitter remote from said monitor, said control system actuating at least one of said drive mechanisms in response to said receiver receiving said input signal, wherein said housing includes a latch mechanism for releasably engaging said base.

29. The fire-fighting monitor according to claim 28, wherein said first drive mechanism is mounted to said housing and includes a motor and a drive gear, said base including a driven gear engaged by said drive gear, said motor selectively driving said drive gear to selectively drive said driven gear in response to said control system when said receiver receives said input signal.

30. The fire-fighting monitor according to claim 29, wherein said drive gear and said driven gear each have a plurality of gear teeth, said gear teeth of said drive gear and said driven gear meshing in a manner to allow said drive gear to drive said driven gear but also to allow said gear teeth of said drive gear to be separated from said gear teeth of said driven gear when said housing is lifted along said first axis.

31. The fire-fighting monitor according to claim 30, wherein said drive gear and said driven gear each have a plurality of gear teeth, said gear teeth of said gears being aligned along said first axis wherein said drive gear and said driven gear may be disengaged when said housing is lifted along said first axis.

32. The fire-fighting monitor according to claim 31, wherein said drive gear comprises a pinion gear.

33. The fire-fighting monitor according to claim 32, wherein said driven gear comprises a ring gear, said ring gear having gear teeth over the full circumference of said ring gear.

34. A fire-fighting monitor for directing the flow of fluid from a fluid source, said monitor comprising:

a base being adapted to be in fluid communication with a fluid source;

a monitor housing having an inlet and an outlet, said inlet releasably mounted on said base and for receiving fluid through said base, said outlet in fluid communication with said inlet for discharging fluid from said housing;

a first rotatable connection between said inlet and said base, said inlet being rotatable about said base at said first rotatable connection about a first axis;

said housing having a second rotatable connection wherein said outlet is rotatable at said second connection about a second axis;

a control system for selectively rotating said inlet about said base about said first axis and for selectively rotating said outlet about said second axis, said control system including a receiver for receiving an input signal from a transmitter remote from said monitor, said control system rotating said inlet or said outlet about their respective rotatable axes in response to said receiver receiving an input signal and further being capable of oscillating said inlet or said outlet between two positions.

35. The fire-fighting monitor according to claim 34, wherein said monitor includes said base.

36. The fire-fighting monitor according to claim 34, wherein said base comprises a portable base.

37. The fire-fighting monitor according to claim 34, wherein said base comprises a fixed base.

38. A fire-fighting monitor for directing the flow of fluid from a fluid source, said monitor comprising:

a base being adapted to be in fluid communication with a fluid source;

a monitor housing having an inlet and an outlet, said inlet mounting on said base for receiving fluid through said base, said outlet in fluid communication with said inlet for discharging fluid from said housing;

a first rotatable connection between said inlet and said base, said inlet being rotatable about said base at said first rotatable connection about a first axis;

said housing having a second rotatable connection wherein said outlet is rotatable at said second connection about a second axis;

a control system for selectively rotating said inlet about said base about said first axis and for selectively rotating said outlet about said second axis, said control system including a receiver for receiving an input signal from a transmitter remote from said monitor, said control system rotating said inlet or said outlet about their respective rotatable axes in response to said receiver receiving said input signal; and wherein said control system detects when said outlet is moved to a preselected elevation.

39. A fire-fighting monitor for directing the flow of fluid from a fluid source, said monitor comprising:

a base being adapted to be in fluid communication with a fluid source;

a monitor housing having an inlet and an outlet, said inlet mounting on said base and for receiving fluid through said base, said outlet in fluid communication with said inlet for discharging fluid from said housing;

a first rotatable connection between said inlet and said base, said inlet being rotatable about said base at said first rotatable connection about a first axis;

said housing having a second rotatable connection wherein said outlet is rotatable at said second connection about a second axis;

a control system for selectively rotating said inlet about said base about said first axis and for selectively rotating said outlet about said second axis, said control system including a receiver for receiving an input signal from a transmitter remote from said monitor, said control system rotating said inlet or said outlet about their respective rotatable axes in response to said receiver receiving said input signal; and an adjustable nozzle and an actuator for adjusting the shape of the stream through said nozzle, and said actuator being selectively controlled by said control system.

40. The fire-fighting monitor according to claim 3, wherein said motor includes a drive shaft, said drive gear being releasably coupled to said drive shaft, said drive gear being decoupled from said motor when no longer coupled to said drive shaft wherein (1) said inlet or (2) said outlet is manually rotatable when said drive gear is decoupled from said motor.

41. The fire-fighting monitor according to claim 34, wherein said two positions comprise predetermined limits established by said control system.

42. The fire-fighting monitor according to claim 34, wherein said control system is capable of oscillating said inlet between said two positions.

* * * * *

UNITED STATES PATENT AND TRADEMARK OFFICE

CERTIFICATE OF CORRECTION

PATENT NO. : 7,191,964 B2
APPLICATION NO. : 10/984047
DATED : March 20, 2007
INVENTOR(S) : James M. Trapp It is certified that error appears in the above-identified patent and that said Letters Patent is hereby corrected as shown below:

Column 6:
Line 37, “tire” should be --fire--.

Column 12:
Line 1, Claim 5, “firs” should be --first--.
Line 49, Claim 12, Delete “,” after “receiving”.

Column 13:
Line 2, Claim 13, Delete “,” after “including”.

Column 14:
Line 40, Claim 24, Insert --,-- after “outlet”.

Column 15:
Line 26, Claim 28, “System” should be --system--.

Signed and Sealed this

Twentieth Day of May, 2008

JON W. DUDAS
*Director of the United States Patent and Trademark Office*